US011554948B2

(12) United States Patent
Cady et al.

(10) Patent No.: US 11,554,948 B2
(45) Date of Patent: Jan. 17, 2023

(54) FUEL CONTROL AND DISTRIBUTION SYSTEM AND METHODS THEREOF

(71) Applicants: Sun Coast Resources, Inc., Houston, TX (US); Supreme Electrical Services, Inc. dba Lime Instruments, Houston, TX (US)

(72) Inventors: Charles Lee Cady, Midland, TX (US); Larry Dean Bothmann, Porter, TX (US); Cory Wayne Glass, Houston, TX (US); Chris Mark LeBlanc, Beaumont, TX (US); Ranjit K Singh, Houston, TX (US); Daniel Maurice Lerner, Missouri City, TX (US)

(73) Assignees: SUN COAST RESOURCES, INC., Houston, TX (US); SUPREME ELECTRICAL SERVICES, INC., Houston, TX (US)

( * ) Notice: Subject to any disclaimer, the term of this patent is extended or adjusted under 35 U.S.C. 154(b) by 336 days.

(21) Appl. No.: 16/879,034

(22) Filed: May 20, 2020

(65) Prior Publication Data

US 2020/0369507 A1 Nov. 26, 2020

Related U.S. Application Data

(60) Provisional application No. 62/850,955, filed on May 21, 2019.

(51) Int. Cl.
*B67D 7/04* (2010.01)
*B67D 7/36* (2010.01)
(Continued)

(52) U.S. Cl.
CPC ..... *B67D 7/0401* (2013.01); *B67D 7/36* (2013.01); *B67D 7/62* (2013.01); *B67D 7/76* (2013.01);
(Continued)

(58) Field of Classification Search
CPC ..... B67D 7/0401; B67D 7/36; B67D 7/62; B67D 7/76; B67D 7/78; B67D 2007/0415
See application file for complete search history.

(56) References Cited

U.S. PATENT DOCUMENTS 6,701,980 B2 * 3/2004 Rothrock ..... B67D 7/845 141/231
7,938,151 B2 * 5/2011 Hockner ..... B60P 3/228 141/237
9,346,662 B2 * 5/2016 Van Vliet ..... B67D 7/0401

* cited by examiner

*Primary Examiner* — Jason K Niesz
(74) *Attorney, Agent, or Firm* — Foley & Lardner LLP

(57) ABSTRACT

System and method relates to a fuel control and distribution system comprising a fuel source, a fuel line, wherein the fuel source is connected to the fuel line, a fuel pump, wherein the fuel line is connected to the fuel pump, a main fuel line, wherein the fuel pump is connected to the main fuel line, a first remote transport truck, wherein the first remote transport truck comprises a first remote transport truck fuel line, wherein the main fuel line is connected to the first remote transport truck and wherein the first remote transport truck fuel line is connected to the first remote transport truck, a first tap line, wherein the first remote transport truck is connected to the first tap line, and a first fuel cap, wherein the first fuel cap comprises a first fuel level sensor, wherein the first tap line is connected to the first fuel cap and wherein the first fuel cap is adapted to be removably attached to a first equipment fuel tank.

79 Claims, 36 Drawing Sheets

(51) Int. Cl.
*B67D 7/76* (2010.01)
*B67D 7/62* (2010.01)
*B67D 7/78* (2010.01)

(52) U.S. Cl.
CPC ..... *B67D 7/78* (2013.01); *B67D 2007/0415* (2013.01)

FUEL CONTROL AND DISTRIBUTION SYSTEM AND METHODS THEREOF

PRIOR RELATED APPLICATIONS

This application claims benefit of U.S. Provisional Patent Application Ser. No. 62/850,955 entitled "FUEL CONTROL AND DISTRIBUTION SYSTEM AND METHODS THEREOF," filed on May 21, 2019.

BACKGROUND

Hydraulic fracturing is a well stimulation process, utilizing pressurized fluids to fracture rock formations. The equipment used for hydraulic fracturing, namely pumps and other equipment, are located at or near the surface of the well site. The equipment operates semi-continuously, until refueling or repair is required, at which time the equipment may be shut down for refueling or replacement. Shut-downs are expensive and time consuming. To avoid such shut-downs, fuel needs to be replenished in a continuous manner to functioning equipment while malfunctioning equipment is quickly removed and replaced. This permits fracturing operations to continue with minimal disruption to the functioning equipment.

Therefore, there is a need for a modular fuel control and distribution system and methods thereof.

SUMMARY

The present invention provides a fuel control and distribution system and methods thereof, and, in particular, a modular fuel control and distribution system and methods thereof.

The fuel control and distribution system and methods thereof are designed to enhance efficiency and improve safety in setting up and using the system. For example, the fuel control and distribution system uses a remote transport truck and a universal fuel cap. The remote transport truck(s) provide numerous advantages:

- A remote transport track is designed to carry fuel lines and tap lines, and communication and power lines needed to connect to the remote transport truck to a main fuel line, and communication and power lines from a trailer and/or to a remote transport truck fuel line in another remote transport truck. Thus, through the use of the remote transport trucks, the fuel control and distribution system may be safely and quickly set up for use.
- The remote transport trucks are designed to be modular and to permit expansion of the fuel control and distribution system to use, for example, up to about twenty remote transport trucks and/or to refuel, for example, up to about forty equipment fuel tanks. Thus, through the use of remote transport trucks, the remote transport truck connected to malfunctioning equipment may be quickly isolated without disrupting the rest of the system while the malfunctioning equipment is removed and replace.
- The remote transport trucks are designed to be located adjacent to a front or a rear of equipment to be refueled instead of immediately next to an equipment fuel tank. Thus, through the use of the remote transport trucks, the remote transport trucks may provide fuel to, for example a first equipment fuel tank and a second equipment fuel tank from a less hazardous location than immediately next to the equipment fuel tanks.

- The remote transport trucks are designed to provide a local control system capable of controlling and/or monitoring, for example a first remote transport truck pressure regulator, a second remote transport truck pressure regulator, a first remote transport truck flow meter, a second remote transport truck flow meter, a first remote transport truck valve and a second remote transport truck valve on each of the remote transport trucks. Thus, through the use of remote transport trucks, operators may control and monitor the refueling of, for example, a first equipment fuel tank and a second equipment fuel tank from a less hazardous location than immediately next to the equipment fuel tanks.

Further, the universal fuel cap also provides numerous advances:

- The fuel cap is designed to provide a fuel cap body capable of mating with and/or sealing to a wide variety of equipment tanks. Thus, through the use of the fuel cap, an operator of the fuel control and distribution system may be safely and quickly connect a tap line from a remote transport truck to an equipment fuel tank without any adapter connections or fittings.
- The fuel cap is designed to provide a fuel cap retention means capable of securing the fuel cap to a wide variety of equipment tanks. Thus, through the use of the fuel cap, the operator of the fuel control and distribution system may safely and quickly secure the fuel cap to the equipment fuel tank without any adapter connections or fittings.

In one embodiment, a fuel control and distribution system, the system comprises a fuel source having an outlet, a fuel line having an inlet and an outlet, wherein the outlet of the fuel source is fluidly connected to the inlet to the fuel line, a fuel pump having an inlet and an outlet, wherein the outlet of the fuel line is fluidly connected to the inlet of the fuel pump, a main fuel line having an inlet and an outlet, wherein the main fuel line comprises an optional fuel filter, a pressure regulator, an optional pop-off pump gauge and a flow meter and wherein the outlet of the fuel pump is fluidly connected to the inlet to the main fuel line, a first remote transport truck having an inlet, a first outlet and a second outlet, wherein the first remote transport truck comprises a first remote transport truck fuel line having an inlet and an outlet, wherein the outlet of the main fuel line is fluidly connected to the inlet of the first remote transport truck and wherein the inlet of the first remote transport truck fuel line is fluidly connected to the first outlet of the first remote transport truck, a first tap line having an inlet and an outlet, wherein the first tap line comprises an optional first check valve, a first pressure regulator, a first flow meter, and a first valve, wherein the second outlet of the first remote transport truck is fluidly connected to the inlet of the first tap line, and a first fuel cap having an inlet and an outlet, wherein the first fuel cap comprises a first fuel level sensor, wherein the outlet of the first tap line is fluidly connected to the inlet of the first fuel cap and wherein the first fuel cap is adapted to be removably attached to a first equipment fuel tank.

In an embodiment, the system further comprises a control system comprising one or more processors and computer-readable instructions that when executed by the one or more processors, cause the one or more processors to determine a first fuel level outputted by the first fuel level sensor, determine a first fuel pressure outputted by the first pressure regulator, determine a first fuel rate outputted by the first flow meter, and control a first fuel flow based the first fuel level outputted by the first fuel level sensor, the first fuel pressure outputted by the first pressure regulator, the first fuel rate outputted by the first flow meter, or any combination thereof by opening or closing the first valve.

In an embodiment, the fuel source may be a fuel tanker. In an embodiment, the fuel source is an ISO tank.

In an embodiment, the fuel line is about a 3-inch diameter fuel line, about a 4-inch diameter fuel line, or any combination thereof.

In an embodiment, the fuel pump may be a centrifugal pump, a dynamic pump, a positive displacement pump, a reciprocating pump, a rotary pump, or any combination thereof.

In an embodiment, the main fuel line is about a 2-inch diameter fuel line, about a 3-inch diameter fuel line, or any combination thereof. In an embodiment, the main fuel line is about a 100-foot long fuel line.

In an embodiment, the optional fuel filter is a bowl-type fuel filter, a cartridge-type fuel filter, a coalescence-type fuel filter, or any combination thereof. In an embodiment, the fuel filter is a coalescence-type fuel filter.

In an embodiment, the pressure regulator is capable of controlling fuel pressure from about 18 to about 20 psi.

In an embodiment, the flow meter is a differential pressure flow meter, a mass flow meter, an open-channel flow meter, a positive displacement flow meter, a velocity flow meter, or any combination thereof.

In an embodiment, the system further comprises a spool, wherein an outlet of the fuel pump is fluidly connected to an inlet to the spool and an outlet to the spool is connected to the inlet of the main fuel line. In an embodiment, the spool is capable of spooling the main fuel line.

In an embodiment, the first tap line is about a ⅜-inch diameter tap line, about a ½-inch diameter tap line, about a ¾-inch diameter tap line, or any combination thereof.

In an embodiment, the first flow meter is a differential pressure meter, a mass flow meter, an open-channel flow meter, a positive displacement flow meter, a velocity flow meter, or any combination thereof.

In an embodiment, the first fuel level sensor is a capacitance fuel level sensor, a float fuel level sensor, an optical fuel level sensor, an ultrasonic fuel level sensor, or any combination thereof.

In an embodiment, the first valve is a shut-off valve, a zero-drip connector, or any combination thereof.

In an embodiment, the system further comprises a second remote transport truck having an inlet, a first outlet and a second outlet, wherein the first outlet of the first remote transport truck fuel line is fluidly connected to the inlet of the second remote transport truck, a second tap line having an inlet and an outlet, wherein the second tap line comprises an optional second check valve, a second pressure regulator, a second flow meter and a second valve, wherein the second outlet to the second remote transport truck is fluidly connected to the inlet of the second tap line, and a second fuel cap having an inlet and an outlet, wherein the second fuel cap comprises a second fuel level sensor, wherein the outlet of the second tap line is fluidly connected to the inlet of the second fuel cap, and wherein the second fuel cap is adapted to be removably attached to a second equipment fuel tank.

In an embodiment, the second tap line is about a ⅜-inch diameter tap line, about a ½-inch diameter tap line, about a ¾-inch diameter tap line, or any combination thereof.

In an embodiment, the second flow meter is a differential pressure meter, a mass flow meter, an open-channel flow meter, a positive displacement flow meter, a velocity flow meter, or any combination thereof.

In an embodiment, the second fuel level sensor is a capacitance fuel level sensor, a float fuel level sensor, an optical fuel level sensor, an ultrasonic fuel level sensor, or any combination thereof.

In an embodiment, the second valve is a shut-off valve, a zero-drip connector, or any combination thereof.

In an embodiment, the system further comprises a first flow control box comprising the inlet of the first remote transport truck, the first outlet of the first remote transport truck, the second outlet of the first remote transport truck, the optional first check valve, the first pressure regulator, the first flow meter, and the first valve.

In an embodiment, the system further comprises a second flow control box comprising the inlet of the second remote transport truck, the first outlet of the second remote transport truck, the second outlet of the second remote transport truck, the optional second check valve, the second pressure regulator, the second flow meter, and the second valve.

In an embodiment, the system further comprises a trailer comprising a pump and spool shelter comprising the fuel pump a spool, wherein an outlet of the fuel pump is fluidly connected to an inlet to the spool and an outlet to the spool is connected to the inlet of the main fuel line.

In an embodiment, a method for using a fuel control and distribution system comprises providing the fuel control and distribution system as discussed herein, determining a first fuel level using the first fuel level sensor, determining a first fuel pressure using the first pressure regulator, determining a first fuel rate using the first flow meter, and controlling a first fuel flow based the first fuel level, the first fuel pressure, the first fuel rate or any combination thereof by opening or closing the first valve.

In an embodiment, the method further comprises determining a second fuel level using a second fuel level sensor, determining a second fuel pressure using a second pressure regulator, determining a second fuel rate using a second flow meter, and controlling a second fuel flow based the second fuel level, the second fuel pressure, the second fuel rate or any combination thereof by opening or closing the second valve.

In an embodiment, a method for using a fuel control and distribution system comprises providing the fuel control and distribution system as discussed herein, determining a first fuel level outputted by the first fuel level sensor disposed inside a first equipment tank, determining a first fuel pressure outputted by the first pressure regulator, determining a first fuel rate outputted by the first flow meter, and controlling a first fuel flow based the first fuel level, the first fuel pressure, the first fuel rate or any combination thereof by opening or closing the first valve.

In an embodiment, the method further comprises determining a second fuel level outputted by a second fuel level sensor disposed inside a second equipment tank, determining a second fuel pressure outputted by a second pressure regulator, determining a second fuel rate outputted by a second flow meter, and controlling a second fuel flow based the second fuel level, the second fuel pressure, the second fuel rate or any combination thereof by opening or closing the second valve.

In another embodiment, a remote transport truck system comprising:

a first remote transport truck having a first inlet, a first outlet and a second outlet, wherein the first remote transport truck comprises a first remote transport truck fuel line having an inlet and an outlet, wherein the inlet of the first remote transport truck fuel line is fluidly connected to the first outlet of the first remote transport truck, a first tap line having an inlet and an outlet, wherein the first tap line comprises an optional first check valve, a first pressure regulator a first flow meter, and a first valve, and wherein the second outlet of the first remote transport truck is fluidly connected to the inlet of the first tap line, and a first fuel cap having an inlet and an outlet, wherein the first fuel cap comprises a first fuel level sensor, wherein the outlet of the first tap line is fluidly connected to the inlet of the first fuel cap, and wherein the first fuel cap is adapted to be removably attached to a first equipment fuel tank.

In an embodiment, the first tap line is about a ⅜-inch diameter tap line, about a ½-inch diameter tap line, about a ¾-inch diameter tap line, or any combination thereof.

In an embodiment, the first flow meter is a differential pressure meter, a mass flow meter, an open-channel flow meter, a positive displacement flow meter, a velocity flow meter, or any combination thereof.

In an embodiment, the first fuel level sensor is a capacitance fuel level sensor, a float fuel level sensor, an optical fuel level sensor, an ultrasonic fuel level sensor, or any combination thereof.

In an embodiment, the first valve is a shut-off valve, a zero-drip connector, or any combination thereof.

In an embodiment, the remote transport truck system further comprises a first flow control box comprising the first inlet of the first remote transport truck, the first outlet of the first remote transport truck, the second outlet of the first remote transport truck, the optional first check valve, the first pressure regulator, the first flow meter, and the first valve.

In an embodiment, the remote transport truck system further comprises a first cart having a plurality of wheels, wherein the plurality of wheels are attached to the bottom of the first cart, the first cart comprising a first flow control box comprising the first inlet of the first remote transport truck, the first outlet of the first remote transport truck, the second outlet of the first remote transport truck, the optional first check valve, the first pressure regulator, the first flow meter, and the first valve.

In an embodiment, the first cart further comprises a first spill tray disposed below the first flow control box, wherein the first spill tray is attached to the first cart.

In an embodiment, the first cart further comprises a first lower tray disposed below the first spill tray, wherein the first spill tray is attached to the first cart.

In an embodiment, the first cart further comprises a first upper tray disposed above the first flow control box, wherein the first upper tray is attached to the first cart.

In an embodiment, the first upper tray comprises a first fuel line spool, wherein the first fuel line spool is attached to the first upper tray.

In an embodiment, the first cart further comprises a first tap line spool, wherein the first tap line spool is attached to the first cart, the first lower tray and/or first upper tray.

In an embodiment, the first cart further comprises a first communication and/or power line spool, wherein the first communication and/or power line spool is attached to the first cart, the first lower tray and/or the first upper tray.

In an embodiment, first cart further comprises a first fuel cap storage tube, wherein the first fuel cap storage tube is attached to the first cart, the first lower tray and/or the first upper tray.

In an embodiment, the first cart further comprises a first local control box, wherein the first local control box comprises a first local control system and a first communication and/or power connector, wherein the first local control box is attached to the first cart, the first lower tray and/or the first upper tray.

In an embodiment, the first cart further comprises a first handle, wherein the first handle is attached to the first cart, the first lower tray and/or the first upper tray.

In yet another embodiment, a fuel cap system comprises a first fuel cap body having a fuel inlet, a fuel outlet, wherein the first fuel cap body is adapted to mate with and seal to a first equipment tank, and wherein the fuel inlet is adapted to be connected to a first tap line and the fuel outlet is adapted to be disposed inside the first equipment tank, a fuel level sensor, wherein the fuel level sensor is adapted to be disposed inside the first equipment tank, a retention means, wherein the retention means is removably attached the fuel cap body to the first equipment tank.

In an embodiment, the fuel level body is a conical shape, a cylinder shape, a hemispherical shape, a truncated cone shape, or any combination thereof.

In an embodiment, the fuel cap body is made of a metal, a plastic, or any combination thereof. In an embodiment, the fuel cap body is made of alloy steel, aluminum, brass, copper, or any combination thereof. In an embodiment, the fuel cap body is made of copolymers, polymers, or any combination thereof.

In an embodiment, the fuel cap body further comprises a gasket. In an embodiment, the gasket is made of an elastomer. In an embodiment, the gasket is made of a fluoroelastomer, a nitrile elastomer, a rubber, or any combination thereof.

In an embodiment, the fuel cap system further comprises a fuel cap connector, wherein the fuel level sensor is electrically connected to the fuel cap connector.

In an embodiment, the fuel cap system further comprises a sensor conduit, wherein the fuel level sensor is electrically connected to the fuel cap connector through the sensor conduit.

In an embodiment, the fuel cap system further comprises a flex means capable of allowing the fuel level sensor to assume a vertical position when the fuel level sensor is disposed inside the first equipment tank, wherein the flex means is attached to the fuel cap body.

In an embodiment, the flex means includes a flex, a hinge, a worm drive, or any combination thereof.

In an embodiment, the fuel level sensor is a capacitance fuel level sensor, a float fuel level sensor, an optical fuel level sensor, an ultrasonic fuel level sensor, or any combination thereof.

In an embodiment, the fuel level sensor is a float fuel level sensor.

In an embodiment, the fuel cap retention means includes a first clip and a first bungee cord, the first clip and a first strap, a first hook and a the first bungee cord, the first hook and the first strap, or any combination thereof.

In an embodiment, the fuel cap retention means is the first clip and the first strap.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE FIGURES

The patent or application file contains at least one drawing executed in color. Copies of this patent or patent application publication with color drawing(s) will be provided by the U.S. Patent and Trademark Office upon request and payment of a required fee.

For a further understanding of the nature and objects of the present invention, reference should be made to the following detailed disclosure, taken in conjunction with the accompanying drawings, in which like parts are given like reference numerals, and wherein.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Fuel Control and Distribution System

Figure 1A:
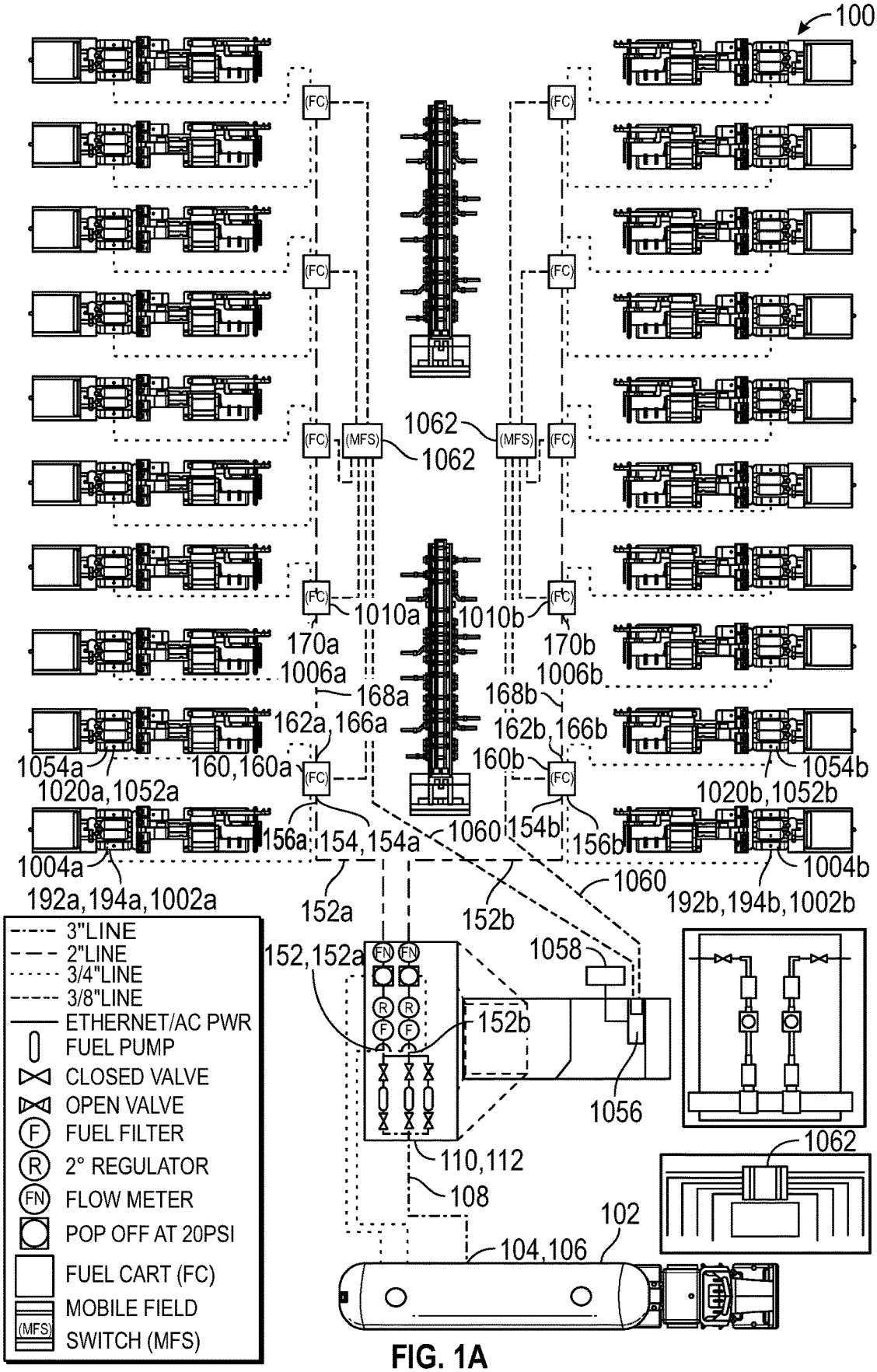
FIG. 1A illustrates a schematic of a fuel control and distribution system.
Figure 1B:
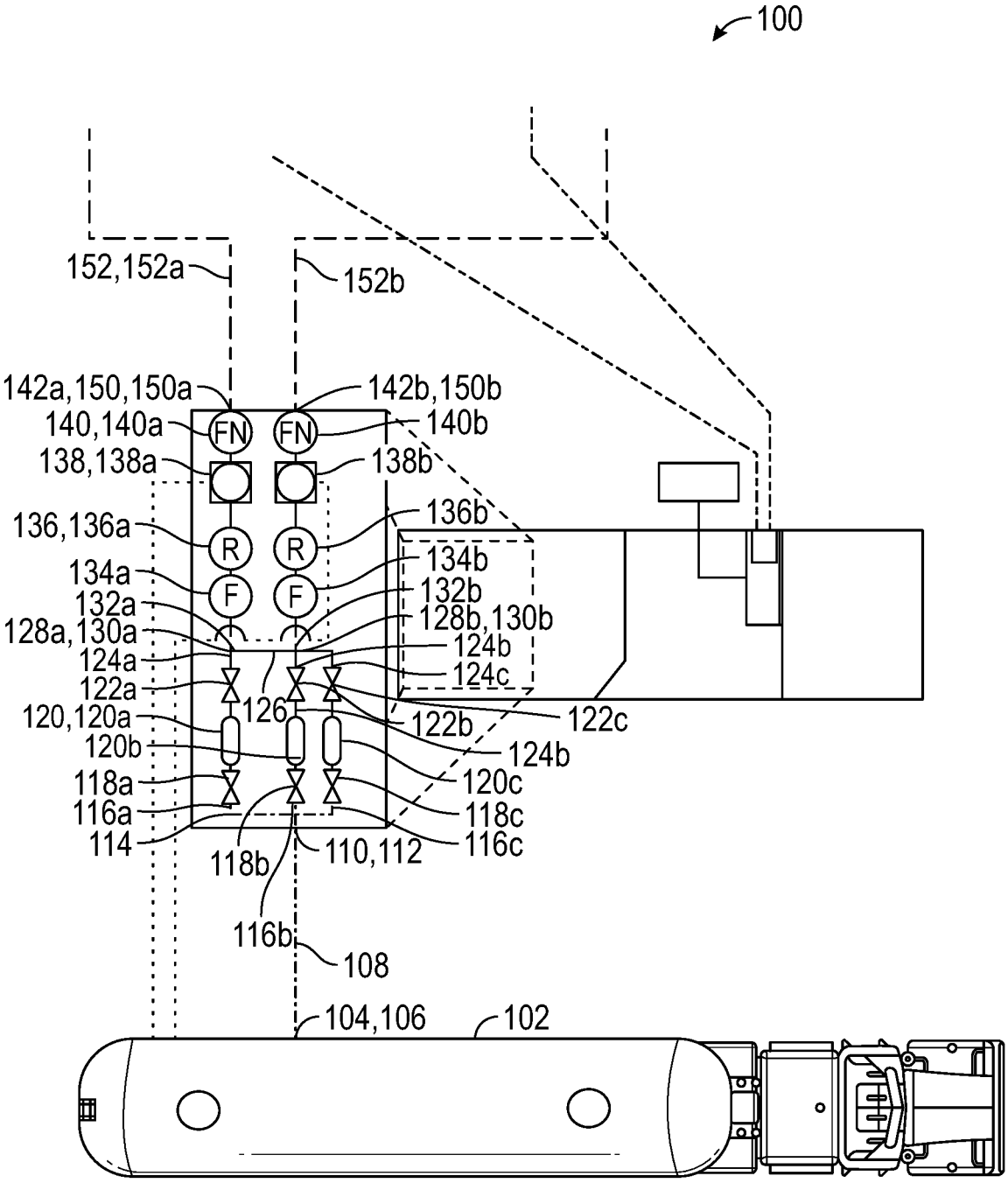
FIG. 1B illustrates a detailed schematic of an upstream portion of the system in FIG. 1A.
Figure 1C:
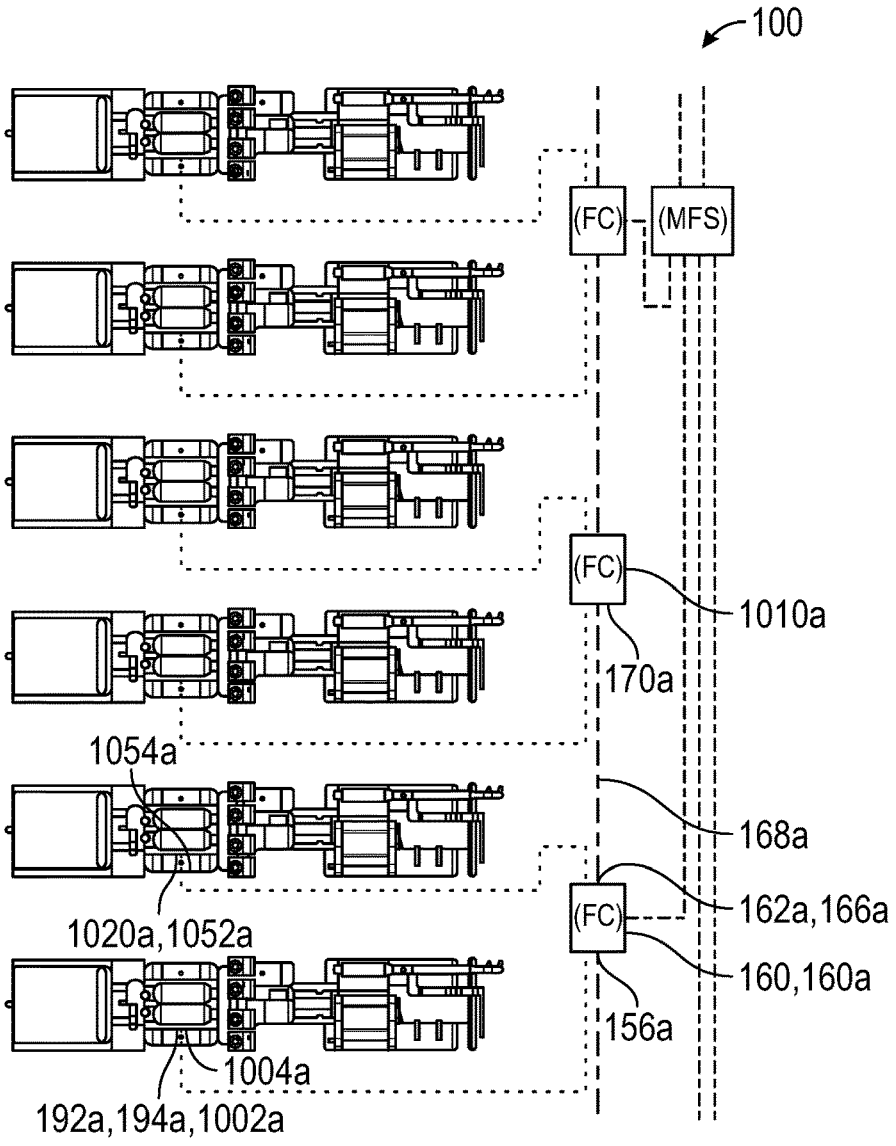
FIG. 1C illustrates a detailed schematic of a downstream portion of the system in FIGS. 1A-1B.

FIG. 1A illustrates a schematic of a fuel control and distribution system 100; FIG. 1B illustrates a detailed schematic of an upstream portion of the system 100 in FIG. 1A; and FIG. 1C illustrates a detailed schematic of a downstream portion of the system 100 in FIGS. 1A-1B.

Figure 11A:
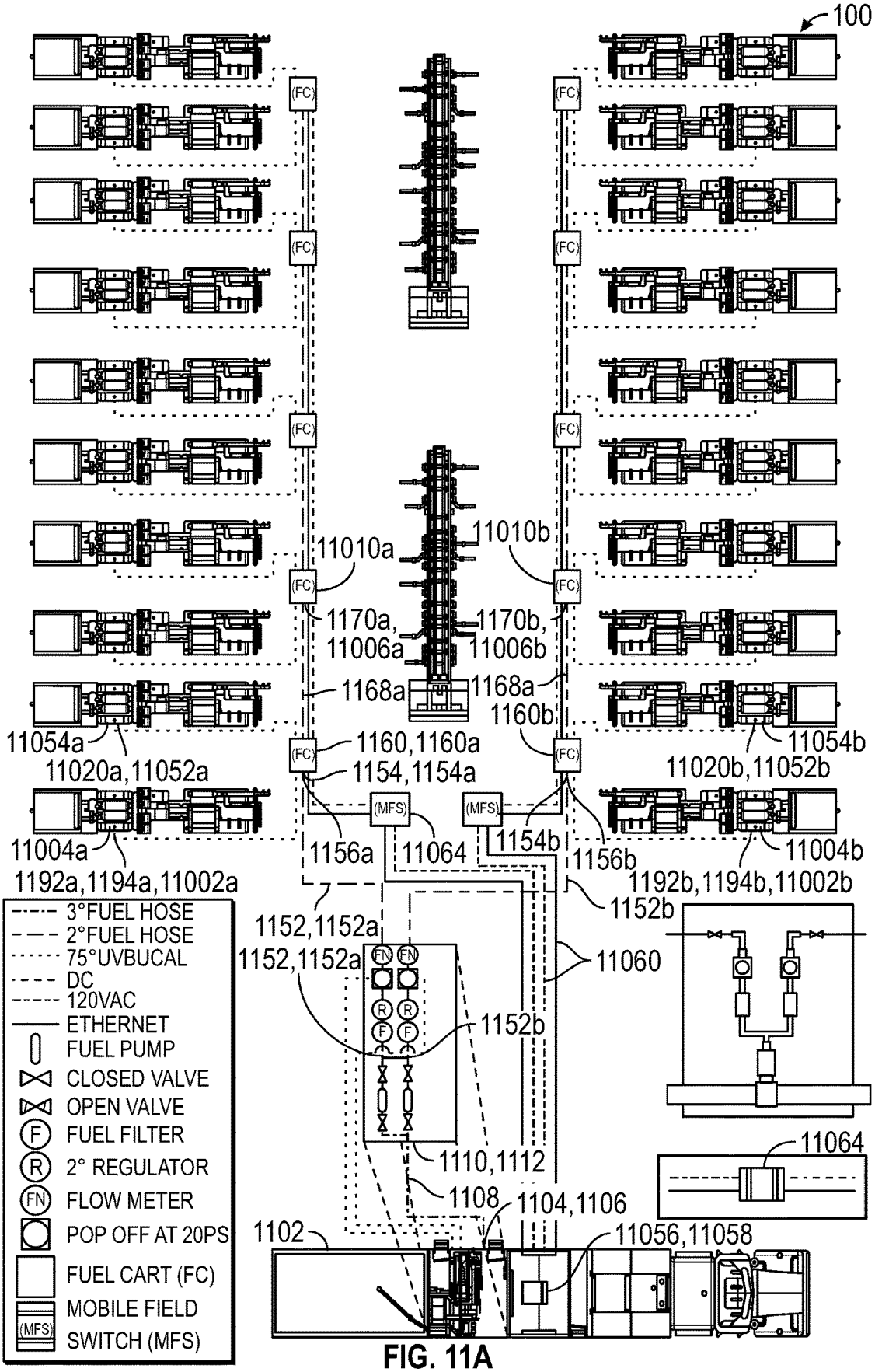
FIG. 11A illustrates a schematic of an alternative fuel control and distribution system.
Figure 11B:
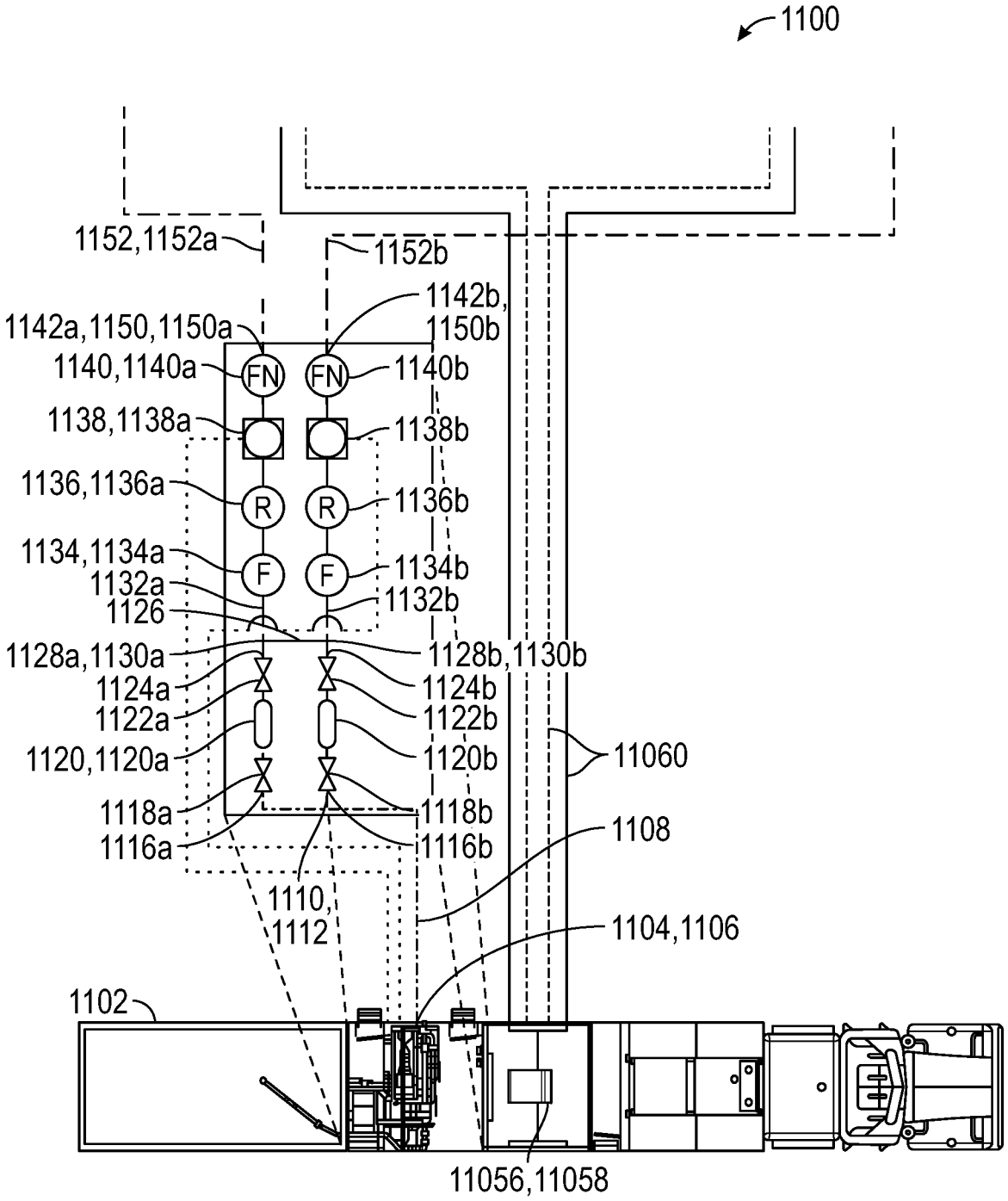
FIG. 11B illustrates a detailed schematic of an upstream portion of the system in FIG. 11A.
Figure 11C:
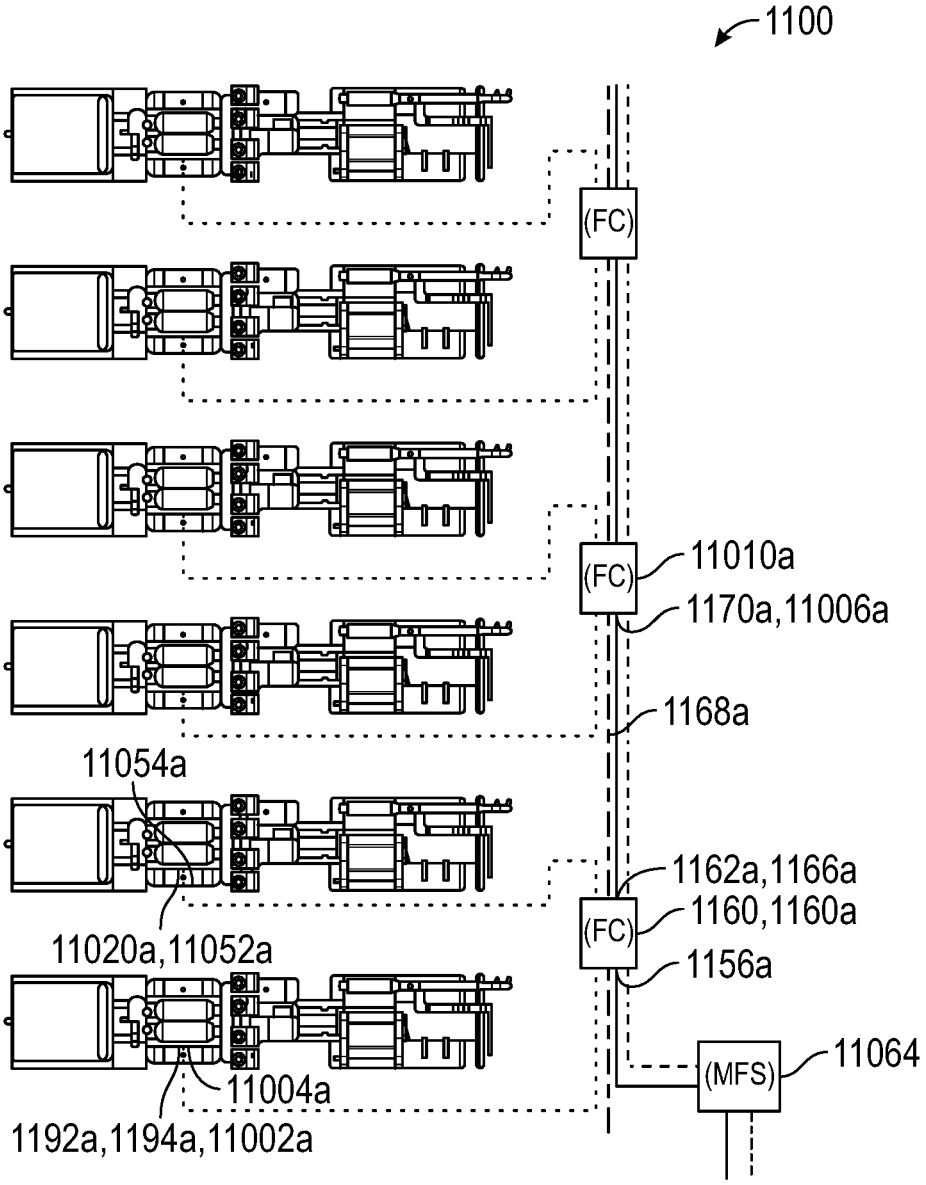
FIG. 11C illustrates a detailed schematic of a downstream portion of the system in FIGS. 11A-11B.

FIG. 11A illustrates a schematic of an alternative fuel control and distribution system 1100; FIG. 11B illustrates a detailed schematic of an upstream portion of the system 1100 in FIG. 11A; and FIG. 11C illustrates a detailed schematic of a downstream portion of the system 1100 in FIGS. 11A-11B.

As shown in FIGS. 1A-1C and 11A-11C, the fuel control and distribution system 100, 1100 comprises a fuel source 102, 1102, a fuel line 108, 1108, a fuel pump 120, 1120, a main fuel line 152, 1152, a complete all-terrain remote transport truck (CARTT) 160, 1160, a CARTT tap line 190, 1190, and a fuel cap 700 with a fuel level sensor 724. See e.g., FIG. 7A-7C.

In an embodiment, a fuel control and distribution system 100, 1100 comprises a fuel source 102, 1102 having an outlet 104, 1104, a fuel line 108, 1108 having an inlet 106, 1106 and an outlet 110, 1110, wherein the outlet 104, 1104 of the fuel source 102, 1102 is fluidly connected to the inlet 106, 1106 to the fuel line 108, 1108, a fuel pump 120*a*, 1120*a* having an inlet and an outlet, wherein the outlet 110, 1110 of the fuel line 108, 1108 is fluidly connected to the inlet of the fuel pump 120*a*, 1120*a*, a main fuel line 152*a*, 1152*a* having an inlet 150, 1150 and an outlet 154, 1154, wherein the main fuel line 152*a*, 1152*a* comprises an optional fuel filter 134*a*, 1134*a*, a pressure regulator 136*a*, 1136*a*, an optional pop-off pump gauge 138*a*, 1138*a* and a flow meter 140*a*, 1140*a* and wherein the outlet of the fuel pump 120*a*, 1120*a* is fluidly connected to the inlet 150, 1150 to the main fuel line 152*a*, 1152*a*, a first remote transport truck 160*a*, 1160*a* having an inlet 156*a*, 1155*a*, a first outlet 162*a*, 1162*a* and a second outlet, wherein the first remote transport truck 160*a*, 1160*a* comprises a first remote transport truck fuel line 168*a*, 1168*a* having an inlet 166*a*, 1166*a* and an outlet 170*a*, 1170*a*, wherein the outlet 154, 1154 of the main fuel line 152*a*, 1152*a* is fluidly connected to the inlet 156*a*, 1156*a* of the first remote transport truck 160*a*, 1160*a* and wherein the inlet 166*a*, 1166*a* of the first remote transport truck fuel line 168*a*, 1168*a* is fluidly connected to the first outlet 162*a*, 1162*a* of the first remote transport truck 160*a*, 1160*a*, a first tap line 190*a*, 1190*a* having an inlet 188*a*, 1188*a* and an outlet 192*a*, 1192*a*, wherein the first tap line 190*a*, 1190*a* comprises an optional first check valve 172*a*, 1172*a*, a first pressure regulator 174*a*, 1174*a*, a first flow meter 176*a*, 1176*a*, and a first valve 178*a*, 1178*a*, wherein the second outlet of the first remote transport truck 160*a*, 1160*a* is fluidly connected to the inlet 188*a*, 1188*a* of the first tap line 190*a*, 1190*a*, and a first fuel cap 700 having an inlet 714 and an outlet 706, wherein the first fuel cap 700 comprises a first fuel level sensor 724, 824, wherein the outlet 192*a*, 1192*a* of the first tap line 190*a*, 1190*a* is fluidly connected to the inlet 714 of the first fuel cap 700 and wherein the first fuel cap 700, 800 is adapted to be removably attached to a first equipment fuel tank 1004*a*, 11004*a*. See e.g., FIGS. 7A-8.

In an embodiment, the fuel control and distribution system 100, 1100 further comprises a control system 1056, 11056 comprising one or more processors and computer-readable instructions that when executed by the one or more processors, cause the one or more processors to determine a first fuel level outputted by the first fuel level sensor 724, 824, determine a first fuel pressure outputted by the first pressure regulator 174*a*, 1174*a*, determine a first fuel rate outputted by the first flow meter 176*a*, 1176*a* and control a first fuel flow based the first fuel level outputted by the first fuel level sensor 724, 824, the first fuel pressure outputted by the first pressure regulator 174*a*, 1174*a*, the first fuel rate outputted by the first flow meter 176*a*, 1176*a*, or any combination thereof by opening or closing the first valve 178*a*, 1178*a*. See e.g., FIGS. 7A-8.

The fuel source 102, 1102 may be any suitable fuel source. For example, a suitable fuel source 102, 1102 includes, but is not limited to, a fuel pipeline, fuel tank, a fuel tanker, or any combination thereof. A suitable fuel source 102, 1102 is available from Sun Coast Resources, Inc. In an embodiment, the fuel source 102 may be a Sun Coast fuel tanker. In an embodiment, the fuel source 1102 may be an ISO fuel tank.

The fuel line 108, 1108 may be any suitable fuel line capable of providing demand for fuel. For example, a suitable fuel line 108, 1108 includes, but is not limited to, a 3-inch diameter fuel line, a 4-inch diameter fuel line, or any combination thereof. A suitable fuel line 108, 1108 is available from) XPower Industrial. In an embodiment, the fuel line 108, 1108 may be an XPower Petroleum Tank Truck 150 psi WP (10 bar) 3-inch (76.2 mm) inner diameter (ID) fuel line from XPower Industrial.

In an embodiment, the fuel line 108, 1108 may be a 3-inch diameter fuel line. In an embodiment, the fuel line 108, 1108 may be a 4-inch diameter fuel line.

In an embodiment, the fuel line outlet 110, 1110 of the fuel line 108, 1108 may be fluidly connected to a fuel inlet 112, 1112 to a pump inlet manifold 114, 1114.

In an embodiment, a first fuel outlet 116*a*, 1116*a* of the pump inlet manifold 114, 1114 may be fluidly connected to an inlet of a first inlet shut-off valve 118*a*, 1118*a*.

In an embodiment, a second fuel outlet 116*b*, 1116*b* of the pump inlet manifold 114, 1114 may be fluidly connected to an inlet of a second pump inlet shut-off valve 118*b*, 1118*b*.

In an embodiment, an optional third fuel outlet 116*c* of the pump inlet manifold 114, 1114 may be fluidly connected to an inlet of an optional third pump inlet shut-off valve 118*c*.

The first, second and optional third pump inlet shut-off valves 118*a*, 118*b*, 118*c*, 1118*a*, 1118*b* may be any suitable shut-off valve.

In an embodiment, an outlet to the first pump inlet shut-off valve 118*a*, 1118*a* may be fluidly connected to an inlet to a first fuel pump 120*a*, 1120*a*.

In an embodiment, an outlet to the second pump inlet shut-off valve 118*b*, 1118*b* may be fluidly connected to an inlet to a second fuel pump 120*b*, 1120*b*.

In an embodiment, an outlet to the optional third pump inlet shut-off valve 118*c* may be fluidly connected to an inlet to an optional third fuel pump 120*c*.

In an embodiment, the optional third fuel pump 120*c* may be used as a spare.

The first, second and optional third fuel pump 120*a*, 120*b*, 120*c*, 1120*a*, 1120*b* maybe any suitable fuel pump capable of providing demand for fuel. For example, a suitable first, second and optional third fuel pump 120*a*, 120*b*, 120*c*, 1120*a*, 1120*b* includes, but is not limited to, centrifugal, dynamic, positive displacement, reciprocating, rotary, or any combination thereof.

In an embodiment, an outlet to the first fuel pump 120*a*, 1120*a* may be fluidly connected to an inlet of a first pump outlet shut-off valve 122*a*, 1122*a*.

In an embodiment, an outlet to the second fuel pump 120*b*, 1120*b* may be fluidly connected to an inlet of a second pump outlet shut-off valve 122*b*, 1122*b*.

In an embodiment, an outlet to the optional third fuel pump 120*c* may be fluidly connected to an inlet of an optional third pump outlet shut-off valve 122*c*.

The first, second and optional third pump outlet shut-off valves 122*a*, 122*b*, 122*c*, 1122*a*, 1122*b* may be any suitable shut-off valve.

In an embodiment, an outlet of the first pump outlet shut-off valve 122*a*, 1122*a* may be fluidly connected to a first inlet 124*a*, 1124*a* to a pump outlet manifold 126, 1126.

In an embodiment, an outlet of the second pump outlet shut-off valve 122*b*, 1122*b* may be fluidly connected to a second inlet 124*b*, 1124*b* to the pump outlet manifold 126, 1126.

In an embodiment, an outlet of the optional third pump outlet shut-off valve 122*c* may be fluidly connected to an optional third inlet 124*c* to the pump outlet manifold 126, 1126.

In an embodiment, a first outlet 128*a*, 1128*a* to the pump outlet manifold 126, 1126 may be fluidly connected to a first fuel line inlet 130*a*, 1130*a* to a first fuel line 132*a*, 1132*a*.

In an embodiment, a second outlet 128*b*, 1128*b* to the pump outlet manifold 126, 1126 may be fluidly connected to a second fuel line inlet 130*b*, 1130*b* to a second fuel line 132*b*, 1132*b*.

The first and second fuel line 132*a*, 132*b*, 1132*a*, 1132*b* may be any suitable fuel line capable of providing demand for fuel. For example, a suitable first and second fuel line 132*a*, 132*b*, 1132*a*, 1132*b* includes, but is not limited to, a 2-inch diameter fuel line, a 3-inch diameter fuel line, or any combination thereof. A suitable first and/or second fuel line 132*a*, 132*b*, 1132*a*, 1132*b* is available from XPower Industrial. In an embodiment, the first and second fuel line 132*a*, 132*b*, 1132*a*, 1132*b* may be an XPower Petroleum Tank Truck 150 psi WP (10 bar) 2-inch (50.8 mm) ID fuel line from XPower Industrial. In an embodiment, the first and second fuel line 132*a*, 132*b*, 1132*a*, 1132*b* may be fluidly connected to a flange inside a pump and spool module 216, 1216, as discussed below.

In an embodiment, the first and second fuel line 132*a*, 132*b*, 1132*a*, 1132*b* may be a 2-inch diameter fuel line. In an embodiment, the first and second fuel line 132*a*, 132*b*, 1132*a*, 1132*b* may be a 3-inch diameter fuel line.

In an embodiment, the first fuel line 132*a*, 1132*a* may further comprise a first fuel filter 134*a*, 1134*a*, a first pressure regulator 136*a*, 1136*a*, a first pop off pump gauge 138*a*, 1138*a*, a first flow meter 140*a*, 1140*a*, or any combination thereof.

In an embodiment, the second fuel line 132*b*, 1132*b* may further comprise a second fuel filter 134*b*, 1134*b*, a second pressure regulator 136*b*, 1136*b*, a second pop off pump gauge 138*b*, 1138*b*, a second flow meter 140*b*, 1140*b*, or any combination thereof.

The first and second fuel filter 134*a*, 134*b*, 1134*a*, 1134*b* may be any suitable fuel filter capable of removing particulate and/or water. For example, a suitable first and second fuel filter 134*a*, 134*b*, 1134*a*, 1134*b* includes, but is not limited to, a bowl-type fuel filter, a cartridge-type fuel filter, a coalescence-type fuel filter, or any combination thereof.

The first and second pressure regulator 136*a*, 136*b*, 1136*a*, 1136*b* may be any suitable pressure regulator capable of reducing the fuel pressure to about 16-22 psi (and any range or value there between) or, alternatively, to about 18-20 psi (and any range or value there between).

In an embodiment, the first and/or second pressure regulator 136*a*, 136*b*, 1136*a*, 1136*b* reduce the fuel pressure to about 18-20 psi.

The first and second pop off pump gauge 138*a*, 138*b*, 1138*a*, 1138*b* may be any suitable pop off pump gauge capable of measuring fuel pressure to about 16-22 psi (and any range or value there between) or, alternatively, to about 18-20 psi. For example, a suitable first and second pop off pump gauge 138*a*, 138*b*, 1138*a*, 1138*b* includes, but is not limited to a pop off pump and gauge, or any combination thereof.

The first and second flow meter 140*a*, 140*b*, 1140*a*, 1140*b* may be any suitable flow meter capable of controlling and/or monitoring fuel flow rate. For example, a suitable first and second flow meter 140*a*, 140*b*, 1140*a*, 1140*b* includes, but is not limited to differential pressure flow meters, mass flow meters, open-channel flow meters, positive displacement flow meters, velocity flow meters, or any combination thereof.

In an embodiment, a first fuel line outlet 142*a*, 1142*a* of the first fuel line 132*a*, 1132*a* may be fluidly connected to a first spool inlet of a first spool 246*a*, 1246*a*. See e.g., FIGS. 2F & 12A-12D.

In an embodiment, a second fuel line outlet 142*b*, 1142*b* of the second fuel line 132*b*, 1132*b* may be fluidly connected to a second spool inlet of a second spool 246*b*, 1246*b*. See e.g., FIGS. 2F & 12A-12D.

In an embodiment, a first spool outlet of the first spool 246*a*, 1246*a* may be fluidly connected to a first main fuel line inlet 150*a*, 1150*b* to a first main fuel line 152*a*, 1152*a*. See e.g., FIGS. 2F & 12A-12D.

In an embodiment, a second spool outlet of the second spool 246*b*, 1246*b* may be fluidly connected to a second main fuel line inlet 150*b*, 1150*b* to a second main fuel line 152*b*, 1152*b*. See e.g., FIGS. 2F & 12A-12D.

The first and second spool 246*a*, 246*b*, 1246*a*, 1246*b* may be any suitable spool capable of spooling the first and second main fuel line 152*a*, 152*b*, 1152*a*, 1152*b*, respectively. For example, a suitable first and second spool 246*a*, 246*b*, 1246*a*, 1246*b* includes and automatic spool, an automatic spool capable of spooling a 100-foot long fuel line, a manual spool, a manual spool capable of spooling a 100-foot long fuel line, or any combination thereof.

In an embodiment, the first and/or second spool 246*a*, 246*b*, 1246*a* is an automatic spool capable of spooling a 100-foot fuel line.

The first and second main fuel line 152*a*, 152*b*, 1152*a*, 1152*b* may be any suitable fuel line capable of providing demand for fuel. For example, a suitable first and second main fuel line 152*a*, 152*b*, 1152*a*, 1152*b* includes, but is not limited to, a 2-inch diameter fuel line, a 3-inch diameter fuel line, or any combination thereof. In an embodiment, the first and second main fuel line 152*a*, 152*b*, 1152*a*, 1152*b* may be a 2-inch diameter fuel line. In an embodiment, the first and second main fuel line 152*a*, 152*b*, 1152*a*, 1152*b* may be a 3-inch diameter fuel line.

The first and second main fuel line 152*a*, 152*b*, 1152*a*, 1152*b* may be any suitable length. In an embodiment, the first and/or second main fuel line 152*a*, 152*b*, 1152*a*, 1152*b* may a 100-foot long fuel line.

Figure 1D:
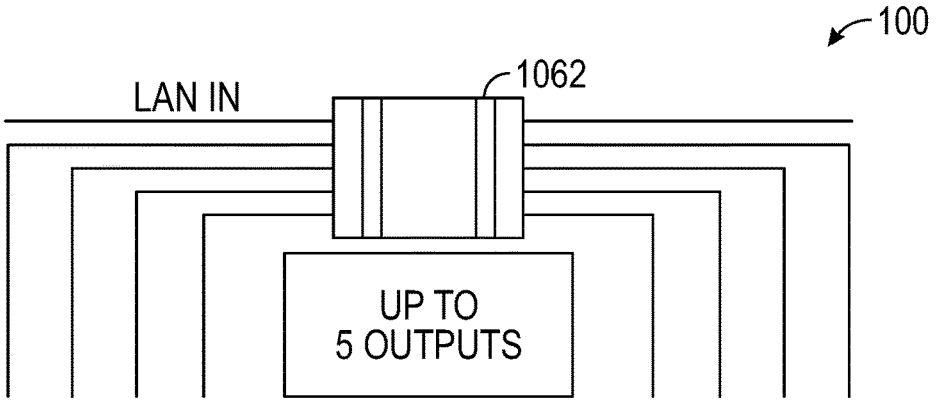
FIG. 1D illustrates a detailed schematic of a mobile field switch (MFS) portion of the system in FIGS. 1A-1C.
Figure 1E:
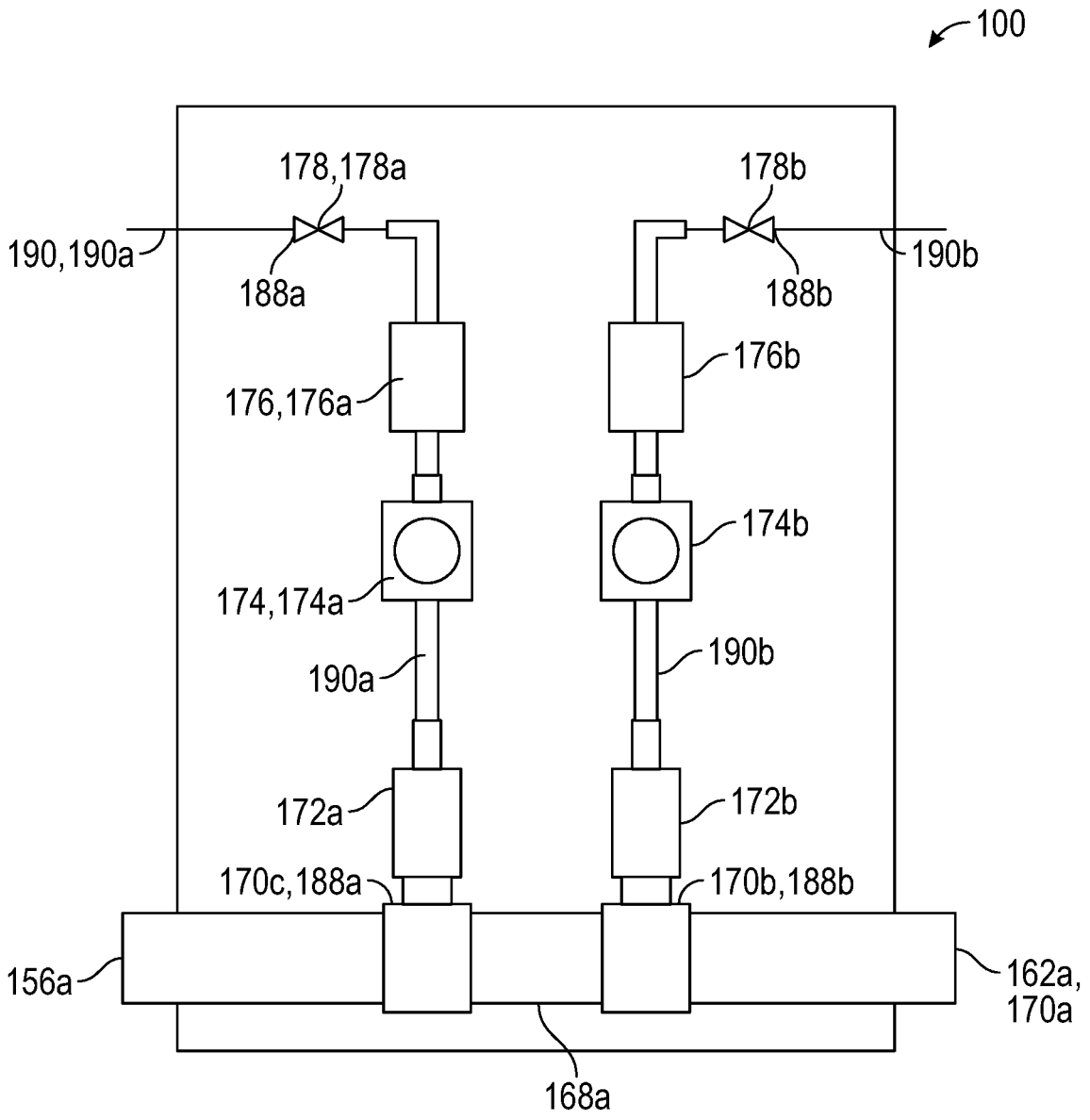
FIG. 1E illustrations a detailed schematic of a complete all-terrain remote transport truck (CARTT) subassembly portion of the system in FIGS. 1A-1D.

FIG. 1E illustrates a detailed schematic of a CARTT subassembly portion of the system 100 in FIGS. 1A-1D, as discussed below.

Figure 11D:
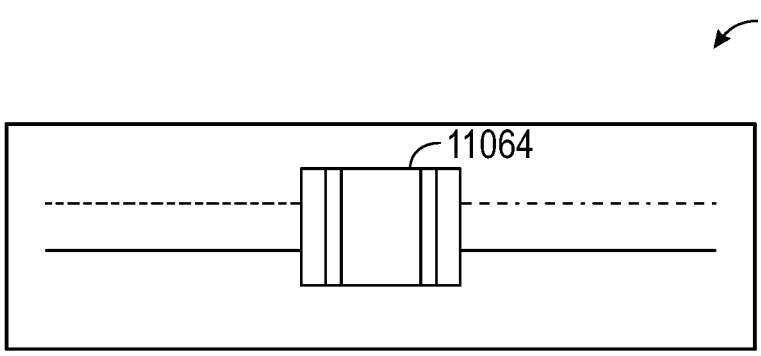
FIG. 11D illustrates a detailed schematic of a mobile field hub (MFH) portion of the system in FIGS. 11A-11C.
Figure 11E:
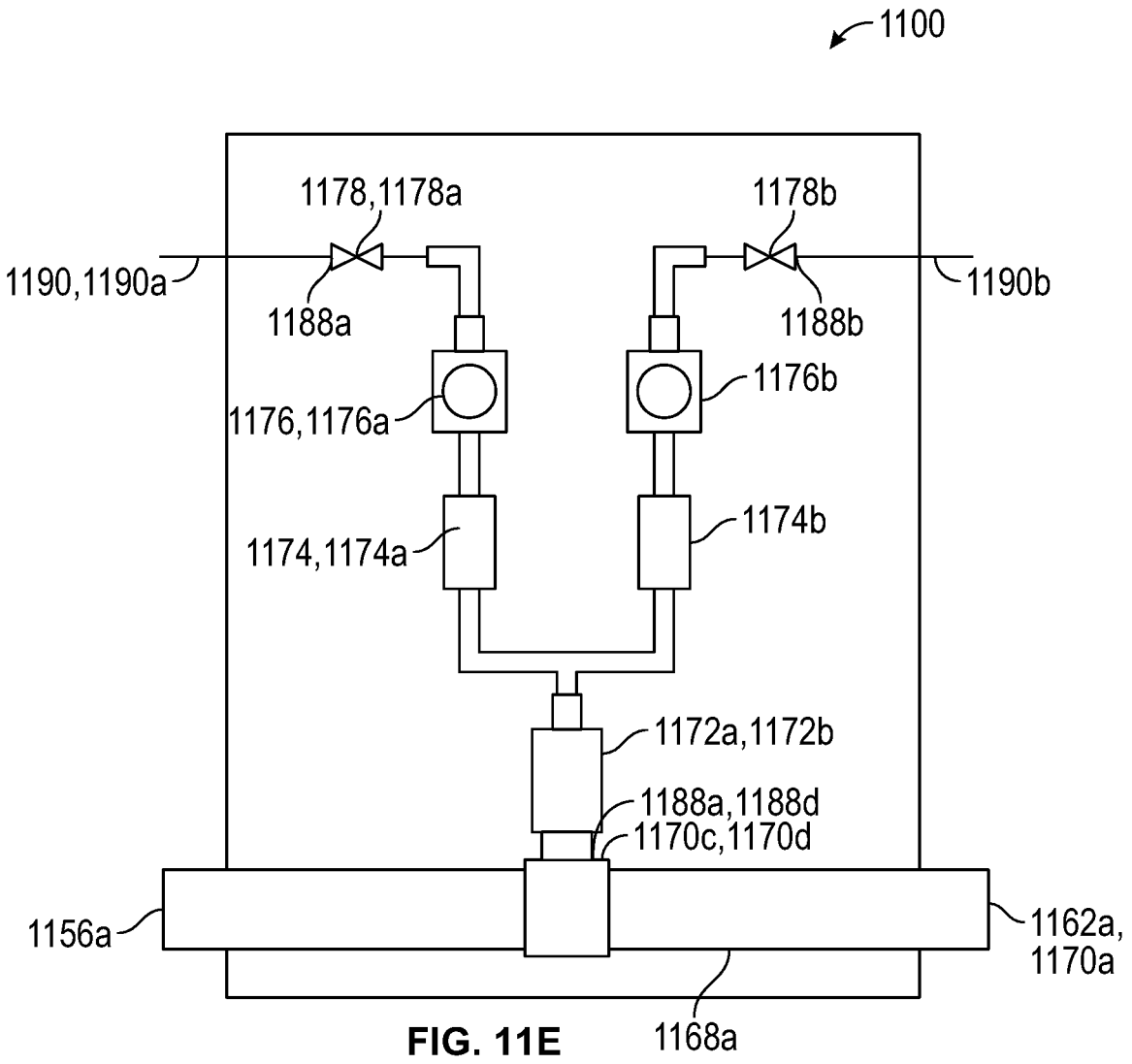
FIG. 11E illustrations a detailed schematic of an alternative complete all-terrain remote transport truck (CARTT) subassembly portion of the system in FIGS. 11A-11D.

FIG. 11E illustrations a detailed schematic of an alternative CARTT subassembly portion of the system 1100 in FIGS. 11A-11D.

In an embodiment, a first main fuel line outlet 154*a*, 1154*a* to the first main fuel line 152*a*, 1152*a* may be fluidly connected to a first CARTT fuel inlet 156*a*, 1156*a* of a first CARTT 160*a*, 1160*a*.

In an embodiment, a second main fuel line outlet 154*b*, 1154*b* to the second main fuel line 152*b*, 1152*b* may be fluidly connected to a second CARTT fuel inlet 156*b*, 1156*a* of a second CARTT 160*b*, 1160*b*.

In an embodiment, the fuel flow in the main fuel line 152*a*, 152*b*, 1152*a*, 1152*b* may be bidirectional. According, references herein to the positions of elements (e.g., "inlet," "outlet") are merely used to describe the orientation of various elements in the figures. It should be noted that the orientation of various elements may differ according to other exemplary embodiments, and that such variations are intended to be encompassed by the present disclosure.

The first and second CARTT 160*a*, 160*b*, 116*a*, 1160*b* may be any suitable cart, as discussed below. See e.g., FIGS. 1A, 1C, 1E, 3-6B, 11A, 11C, 11E & 13-14F.

The first and second CARTT fuel inlet 156*a*, 156*b*, 1156*a*, 1156*b* may be any suitable inlet. For example, a suitable first and second CARTT fuel inlet 156*a*, 156*b*, 1156*a*, 1156*b* includes, but is not limited to a 2-inch diameter connector, a 3-inch diameter connector, a 2-inch diameter shut-off valve, a 3-inch diameter shut-off valve, a 2-inch diameter zero-drip connector, a 3-inch diameter zero-drip connector, or any combination thereof. A suitable first and second CARTT fuel inlet 156*a*, 156*b*, 1156*a*, 1156*b* is available from Dixon. In an embodiment, the first and/or second CARTT fuel inlet 156*a*, 156*b*, 1156*a*, 1156*b* may be a BA32-200 2-inch ID stainless steel (SS) Bayonet Dry Disconnect Coupler from Dixon.

In an embodiment, the first and second CARTT fuel inlet 156*a*, 156*b*, 1156*a*, 1156*b* may be a 2-inch diameter connector. In an embodiment, the first and second CARTT fuel inlet 156*a*, 156*b*, 1156*a*, 1156*b* may be a 2-inch diameter shut-off valve. In an embodiment, the first and second CARTT fuel inlet 156*a*, 156*b*, 1156*a*, 1156*b* may be a 2-inch diameter zero-drip connector.

In an embodiment, a first CARTT fuel outlet 162*a*, 1162*b* of the first CARTT 160*a*, 1160*a* may be fluidly connected to a first CARTT fuel line inlet 166*a*, 1166*a* of a first CARTT fuel line 168*a*, 1168*a*.

In an embodiment, a second CARTT fuel outlet 162*b*, 1162*b* of the second CARTT 160*b*, 1160*b* may be fluidly connected to a second CARTT fuel line inlet 166*b*, 1166*b* of a second CARTT fuel line 168*b*, 1168*b*.

The first and second CARTT fuel outlet 162*a*, 162*b*, 1162*a*, 1162*b* may be any suitable outlet. For example, a suitable first and second CARTT fuel outlet 162*a*, 162*b*, 1162*a*, 1162*b* includes, but is not limited to a 2-inch diameter connector, a 3-inch diameter connector, a 2-inch diameter shut-off valve, a 3-inch diameter shut-off valve, a 2-inch diameter zero-drip connector, a 3-inch zero-drip connector, or any combination thereof. A suitable first and second CARTT fuel outlet 162*a*, 162*b*, 1162*a*, 1162*b* is available from Dixon. In an embodiment, the first and/or second CARTT fuel outlet 162*a*, 162*b*, 1162*a*, 1162*b* may be a BA32-200 2-inch ID SS Bayonet Dry Disconnect Coupler from Dixon.

In an embodiment, the first and second CARTT fuel outlet 162*a*, 162*b*, 1162*a*, 1162*b* may be a 2-inch connector. In an embodiment, the first and second CARTT fuel inlet 162*a*, 162*b*, 1162*a*, 1162*b* may be a 2-inch diameter shut-off valve. In an embodiment, the first and second CARTT fuel inlet 162*a*, 162*b*, 1162*a*, 1162*b* may be a 2-inch diameter zero-drip connector.

The first and second CARTT fuel lines 168*a*, 168*b*, 1168*a*, 1168*b* may be any suitable tap line capable of providing demand for fuel. For example, a suitable first and second fuel line 168*a*, 168*b*, 1168*a*, 1168*b* includes, but is not limited to, a 2-inch diameter fuel line, 3-inch diameter fuel line, or any combination thereof. A suitable first and second CARTT fuel line 168*a*, 168*b*, 1168*a*, 1168*b* is available from Plexagon. In an embodiment, the first and/or second CARTT fuel line 168*a*, 168*b*, 1168*a*, 1168*b* may be a Plexagon Medusa 2-inch ID, 150 psi fuel hose from Plexagon.

In an embodiment, a first CARTT fuel line outlet 170*a*, 1170*a* of the first CARTT fuel line 168*a*, 1168*a* may be fluidly connected to a third CARTT fuel inlet 1006*a*, 11006*a* of a third CARTT 1010*a*, 11010*a*.

In an embodiment, a second CARTT fuel line outlet 170*b*, 1170*b* of the second CARTT fuel line 168*b*, 1168*b* may be fluidly connected to a fourth CARTT fuel inlet 1006*b*, 11006*b* of a fourth CARTT 1010*b*, 11010*b*.

The first and second CARTT 160*a*, 160*b*, 1160*a*, 1160*b* may be any suitable cart, as discussed below. See e.g., FIGS. 1A, 1C, 1E, 3-6B, 11A, 11C, 11E & 13-14F.

The third and fourth CARTT fuel inlet 1006*a*, 1006*b* may be any suitable inlet. For example, a suitable third and fourth CARTT fuel inlet 1006*a*, 1006*b* includes, but is not limited to a 2-inch diameter connector, a 3-inch diameter connector, a 2-inch diameter shut-off valve, a 3-inch diameter shut-off valve, a 2-inch diameter zero-drip connector, a 3-inch diameter zero-drip connector, or any combination thereof. A suitable third and fourth CARTT fuel inlet 1006*a*, 1006*b* is available from Dixon. In an embodiment, the third and/or fourth CARTT fuel inlet 1006*a*, 1006*b* may be a BC62-200 2-inch ID aluminum (ALUM) Bayonet Dry Disconnect Coupler from Dixon.

In an embodiment, the third and fourth CARTT fuel inlet 1006*a*, 1006*b*, 11006*a*, 11006*b* may be a 2-inch diameter connector. In an embodiment, the third and fourth CARTT fuel inlet 1006*a*, 1006*b*, 11006*a*, 11006*b* may be a 2-inch diameter shut-off valve. In an embodiment, the third and fourth CARTT fuel inlet 1006*a*, 1006*b*, 11006*a*, 11006*b* may be a 2-inch diameter zero-drip connector.

In an embodiment, a third CARTT fuel line outlet 170*c*, 1170*c* of the first CARTT fuel line 168*a*, 1168*a* may be fluidly connected to a first CARTT tap line inlet 188*a*, 1188*a* of a first CARTT tap line 190*a*, 1190*a*.

In an embodiment, a fourth CARTT fuel line outlet 170*d*, 1170*d* of the second CARTT fuel line 168*b*, 1168*b* may be fluidly connected to a second CARTT tap line inlet 188*b*, 1188*b* of a first CARTT tap line 190*b*, 1190*b*.

The first and second CARTT tap lines 190*a*, 190*b*, 1190*a*, 1190*b* may be any suitable tap line capable of providing demand for fuel. For example, a suitable first and second tap line 190*a*, 190*b*, 1190*a*, 1190*b* includes, but is not limited to, a ⅜-inch diameter tap line, ½-inch diameter tap line, a ¾-inch diameter tap line, a 1-inch diameter tap line, or any combination thereof. A suitable first and second CARTT tap line 190*a*, 190*b*, 1190*a*, 1190*b* is available from Texcel. In an embodiment, the first and/or second CARTT tap line 190*a*, 190*b*, 1190*a*, 1190*b* may be a Texcel ¾-inch ID, 200 psi fuel hose from Texcel.

In an embodiment, the first and second CARTT tap line 190*a*, 190*b*, 1190*a*, 1190*b* may be a ⅜-inch tap line. In an embodiment, the first and second CARTT tap line 190*a*, 190*b*, 1190*a*, 1190*b* may be a ¾-inch diameter tap line.

In an embodiment, the first CARTT tap line 190*a*, 1190*a* may further comprise a first CARTT check valve 172*a*, 1172*a*, a first CARTT pressure regulator 174*a*, 1174*a*, a first CARTT flow meter 176*a*, 1176*a*, a first CARTT valve 178*a*, 1178*a*, a first CARTT connector (not shown), or any combination thereof.

In an embodiment, the second CARTT tap line 190*b*, 1190*b* may further comprise a second CARTT check valve 172*b*, 1172*b*, a second CARTT pressure regulator 174*b*, 1174*b*, a second CARTT flow meter 176*b*, 1176*b*, a second CARTT valve 178*b*, 1178*b*, second CARTT connector (not shown), or any combination thereof.

The first and second CARTT check valve 172*a*, 172*b*, 1172*a*, 1172*b* may be any suitable check valve capable of preventing fuel back flow. For example, a suitable first and second CARTT check valve 172*a*, 172*b*, 1172*a*, 1172*b* includes, but is not limited to a ball check valve, a duo-check valve, a disk check valve, a non-slam check valve, a piston check valve, a swing check valve, a tilting disk check valve, a wafer check valve, or any combination thereof. A suitable first and second check valve 172*a*, 172*b*, 1172*a*, 1172*b* is available from Swagelok. In an embodiment, the first and/or second check valve 172*a*, 172*b* may be a ½ FNPT 4600 psi MWP, 1 psi cracking pressure, SHCV2-F-8N-1PSS check valve from Swagelok.

The first and second CARTT pressure regulator 174*a*, 174*b*, 1174*a*, 1174*b* may be any suitable pressure regulator capable of reducing the fuel pressure to about 2 psi. A suitable first and second CARTT pressure regulator 174*a*, 174*b*, 1174*a*, 1174*b* is available from Lime Instruments/JEGS Performance Products. In an embodiment, the first and/or second CARTT pressure regulator 174*a*, 174*b*, 1174*a*, 1174*b* may be a JEGS 159117 pressure regulator from Lime Instruments/JEGS Performance Products.

The first and second CARTT flow meter 176*a*, 176*b*, 1176*a*, 1176*b* may be any suitable flow meter capable of controlling and/or monitoring fuel flow rate. For example, a suitable first and second CARTT flow meter 176*a*, 176*b*, 1176*a*, 1176*b* includes, but is not limited to differential pressure flow meters, mass flow meters, open-channel flow meters, positive displacement flow meters, velocity flow meters, or any combination thereof. A suitable first and second CARTT flow meter 176*a*, 176*b*, 1176*a*, 1176*b* is available from Lime Instruments/Flomec. In an embodiment, the first and/or second CARTT flow meters 176*a*, 176*b*, 1176*a*, 1176*b* may be an OM008-s-5-1-1-3-2-2-2-SS flow meter from Lime Instruments/Flomec.

The first and second CARTT valve 178*a*, 178*b*, 1178*a*, 1178*b* any be any suitable valve. For example, a suitable first and second CARTT valve 178*a*, 178*b*, 1178*a*, 1178*b* includes, but is not limited to a ⅜-inch diameter shut-off valve, a ¾-inch diameter shut-off valve, a ⅜-inch diameter zero-drip connector, a ¾-inch diameter zero-drip connector, or any combination thereof. A suitable first and second CARTT fuel inlet 178*a*, 178*b*, 1178*a*, 1178*b* is available from ASCO. In an embodiment, the first and/or second CARTT valve 178*a*, 178*b*, 1178*a*, 1178*b* may be an ASCO 8210G095V valve from ASCO.

In an embodiment, the first and second CARTT connector (not shown) may be any suitable connector. For example, a suitable first and second CARTT connector (not shown) includes, but is not limited to a 2-inch diameter connector, a 3-inch diameter connector, a 2-inch diameter zero-drip connector, a 3-inch diameter zero-drip connector, or any combination thereof. A suitable first and second CARTT connector (not shown) is available from Dixon. In an embodiment, the first and/or second CARTT connector may be a Dixon ENABL-P Red Engine Nozzle Ball Lock from Dixon.

In an embodiment, a first CARTT tap line outlet 192*a*, 1192*a* of the first CARTT tap line 190*a*, 1190*a* may be fluidly connected to a first fuel cap inlet 714 for a first fuel cap 700 comprising a first fuel level sensor 724, 824. See e.g., FIGS. 7A-8.

In an embodiment, a second CARTT tap line outlet 192*b*, 1192*b* of the second CARTT tap line 190*b*, 1190*b* may be fluidly connected to a second fuel cap inlet 714 for a second fuel cap 700 comprising a second fuel level sensor 724, 824. See e.g., FIGS. 7A-8.

The first and second fuel level sensor 700, 800 may be any suitable fuel level sensor. See e.g., FIGS. 7A-8. For example, a suitable first and second fuel level sensor 700, 800 includes, but is not limited to, a capacitance fuel level sensor, a float fuel level sensor, an optical fuel level sensor, an ultrasonic fuel level sensor, or any combination thereof. A suitable first and second fuel level sensor 700, 800 is available from Advanced Oilfield Innovations. In an embodiment, the first and/or second fuel level sensor 700, 800 may be an AO-13410 (16-inch length) fuel level sensor from Advanced Oilfield Innovations.

In an embodiment, the first and/or second fuel level sensor 700, 800 may be a capacitance fuel level sensor. In an embodiment, the first and/or second fuel level sensor 700, 800 may be a float fuel level sensor. In an embodiment, the first and/or second fuel level sensor 700, 800 may be an optical fuel level sensor. In an embodiment, the first and/or second fuel level sensor 700, 800 may be an ultrasonic fuel level sensor.

In an embodiment, the first fuel cap 196*a*, 1196*a* may be fluidly connected to a first equipment tank inlet 1002*a*, 11002*a* of a first equipment tank 1004*a*, 11004*a*.

In an embodiment, the second fuel cap 196*b*, 1196*b* may be fluidly connected to a second equipment tank inlet 1002*b* of a second equipment tank 1004*b*.

In an embodiment, a first fuel cap outlet 706 of the first fuel cap 700 may be disposed inside the first equipment tank 1004*a*, 11004*a*. See e.g., FIGS. 7A-7C.

In an embodiment, a second fuel cap outlet 706 of the second fuel cap 700 may be disposed inside the second equipment tank 1004*b*, 11004*b*. See e.g., FIGS. 7A-7C.

In an embodiment, a first fuel level sensor 724, 824 of the first fuel cap 700, 800 may be disposed inside the first equipment tank 1004*a*, 11004*a*.

In an embodiment, a second fuel level sensor 724, 824 of the second fuel cap 700, 800 may be disposed inside the second equipment tank 1004*b*, 11004*b*.

FIG. 1D illustrates a detailed schematic of a mobile field switch (MFS) portion of the system 100 in FIGS. 1A-1C.

FIG. 11D illustrates a detailed schematic of a mobile field hub (MFH) portion of the system 1100 in FIGS. 11A-11C;

As shown in FIGS. 1A, 1D, 11*a* and 11D, the system 100, 1100 may further comprise a control system 1056, 11056 comprising a presentation component (e.g., display) 1058, 11058, a communication and power line 1060, 11060.

In an embodiment, the control system 1056, 11056 may be electrically connected to, for example, a pressure regulator 136, 1136, a pop off pump gauge 138, 1138, a flow meter 140, 1140, a CARTT pressure regulator 174, 1174, a CARTT flow meter 176, 1176, a CARTT valve 178, 1178 via the communication and power line 1060, 11060.

In an embodiment, the communication and power line 1060 may further comprise a mobile field switch 1062.

In an embodiment, the communication and power line 11060 may further comprises a mobile filed hub 11064.

The mobile field switch 1062 may be any suitable mobile field switch. A suitable mobile field switch 1062 is available from Lime Instruments. In an embodiment, the mobile field switch 1062 may be a Green Box Switch from Lime Instruments.

The mobile field hub 11064 may be any suitable mobile field hub. A suitable mobile field hub 11064 is available from Lime Instruments. In an embodiment, the mobile field hub 1062 may be a Green Box Hub from Lime Instruments.

Trailer Subassembly

Figure 2A:
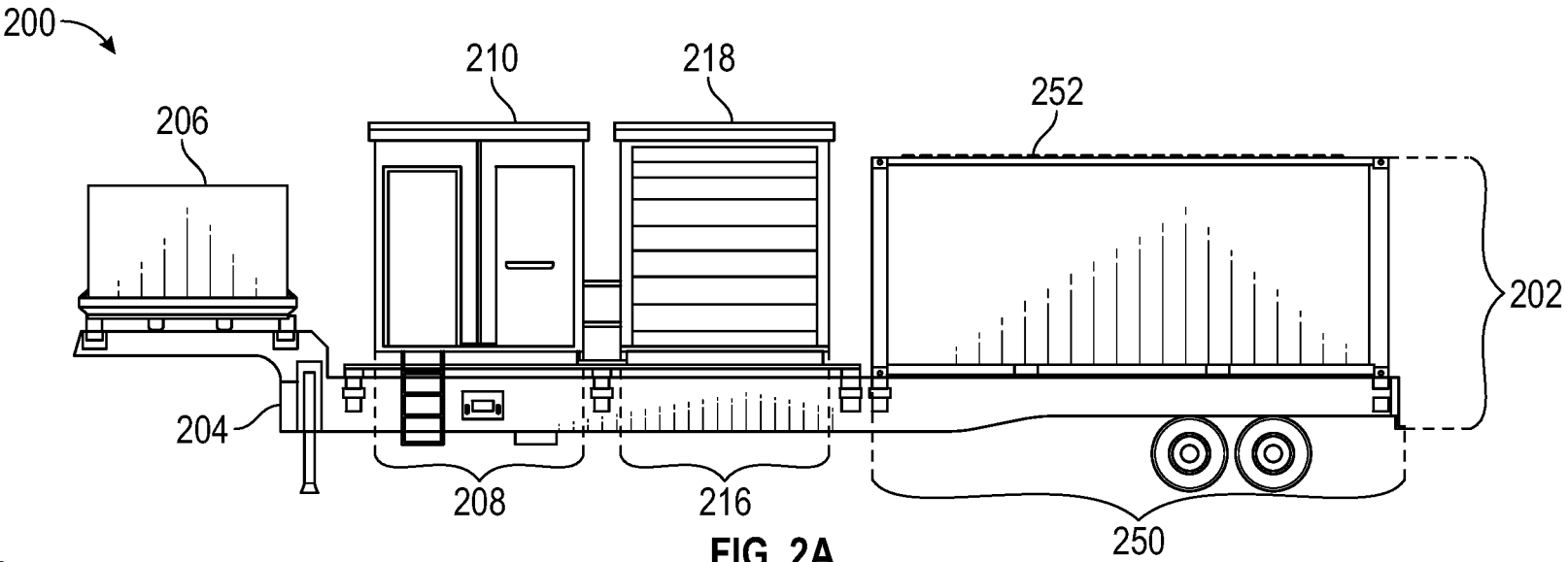
FIG. 2A illustrates a side view of a trailer subassembly for a fuel control and distribution system.
Figure 2B:
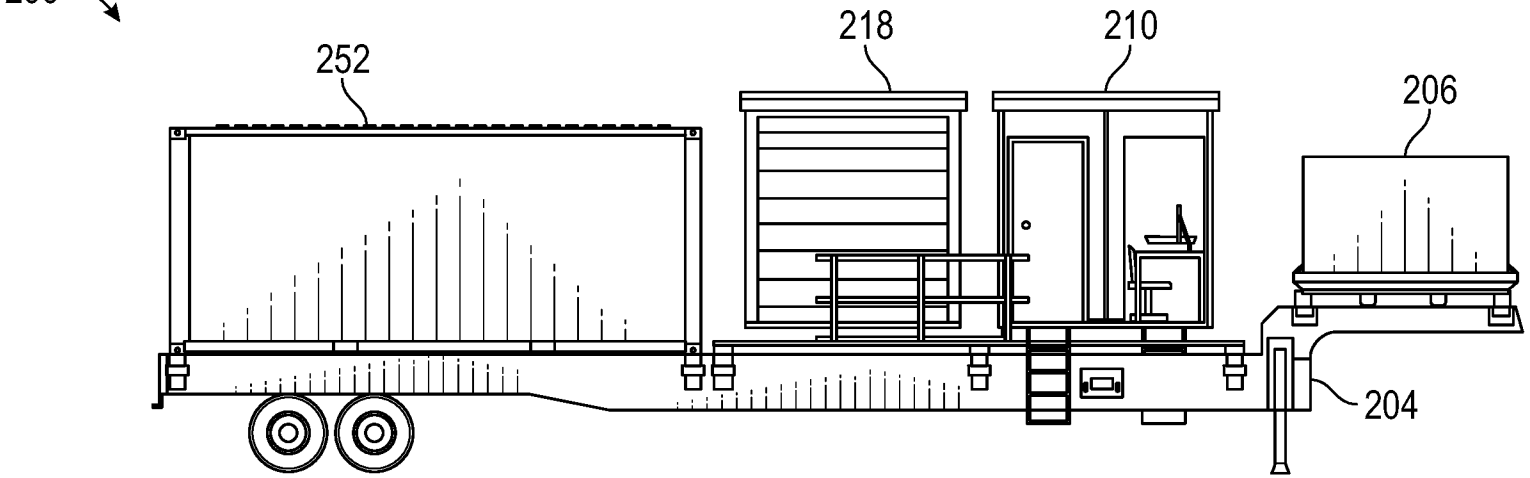
FIG. 2B illustrates a side view of the trailer subassembly in FIG. 2A.
Figure 2C:
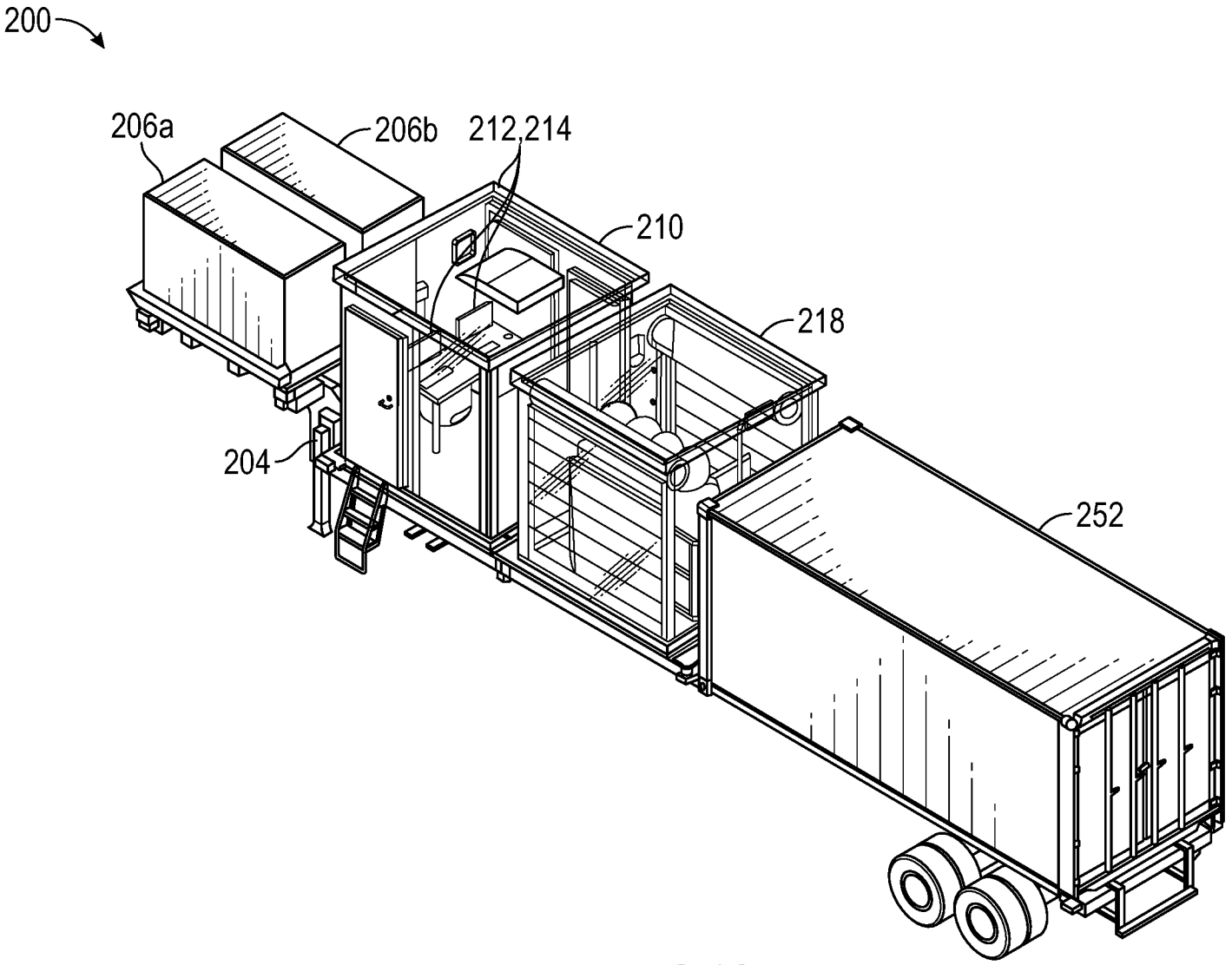
FIG. 2C illustrates a left rear, upper perspective view of the trailer subassembly in FIGS. 2A-2B.
Figure 2D:
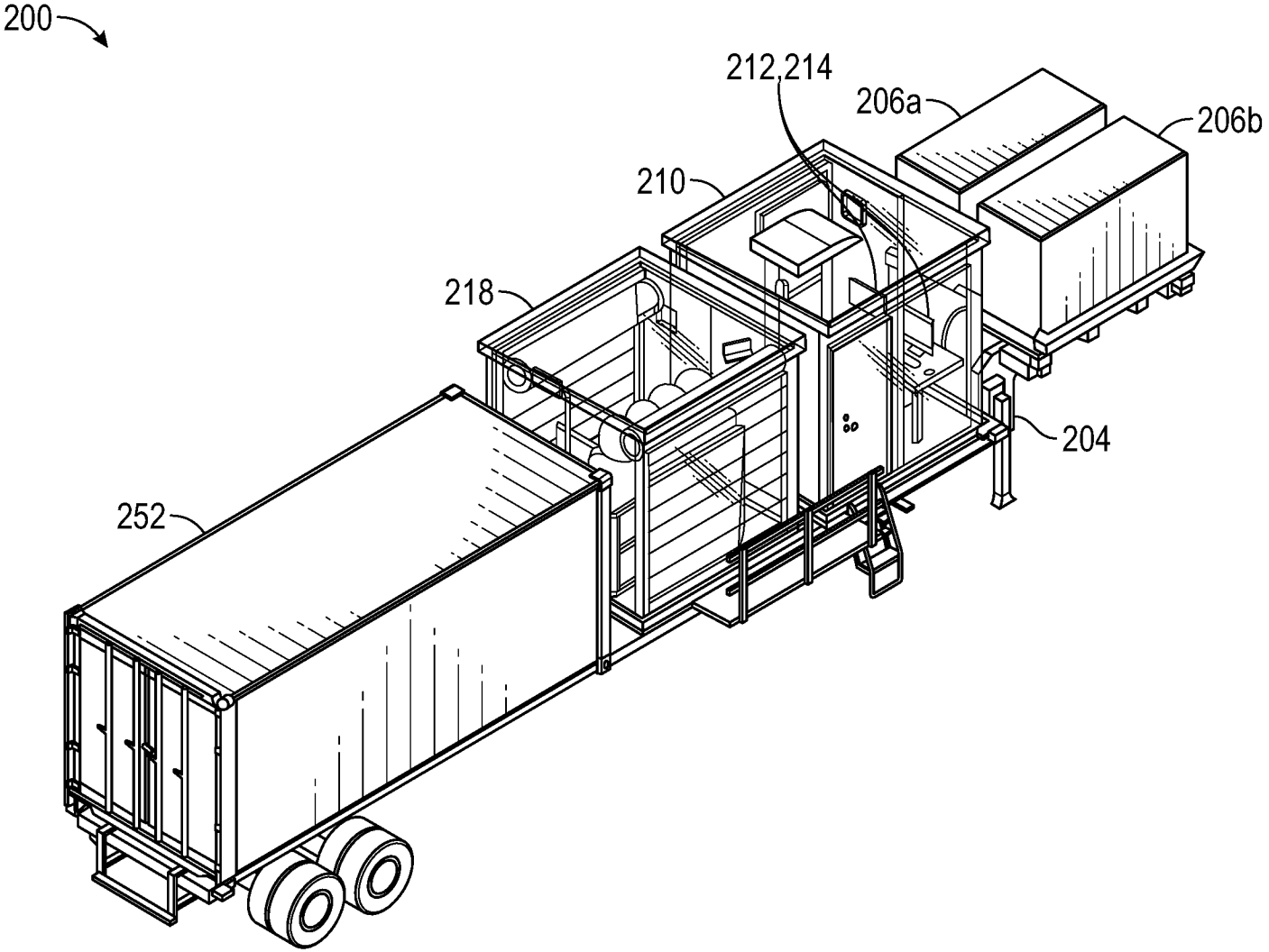
FIG. 2D illustrates a right rear, upper perspective view of the trailer subassembly in FIGS. 2A-2C.

FIG. 2A illustrates a side view of a trailer subassembly 202 for a fuel control and distribution system 200; FIG. 2B illustrates a side view of the trailer subassembly 202 in FIG. 2A; FIG. 2C illustrates a left rear, upper perspective view of the trailer subassembly 202 in FIGS. 2A-2B; and FIG. 2D illustrates a right rear, upper perspective view of the trailer subassembly 202 in FIGS. 2A-2C.

Figure 2E:
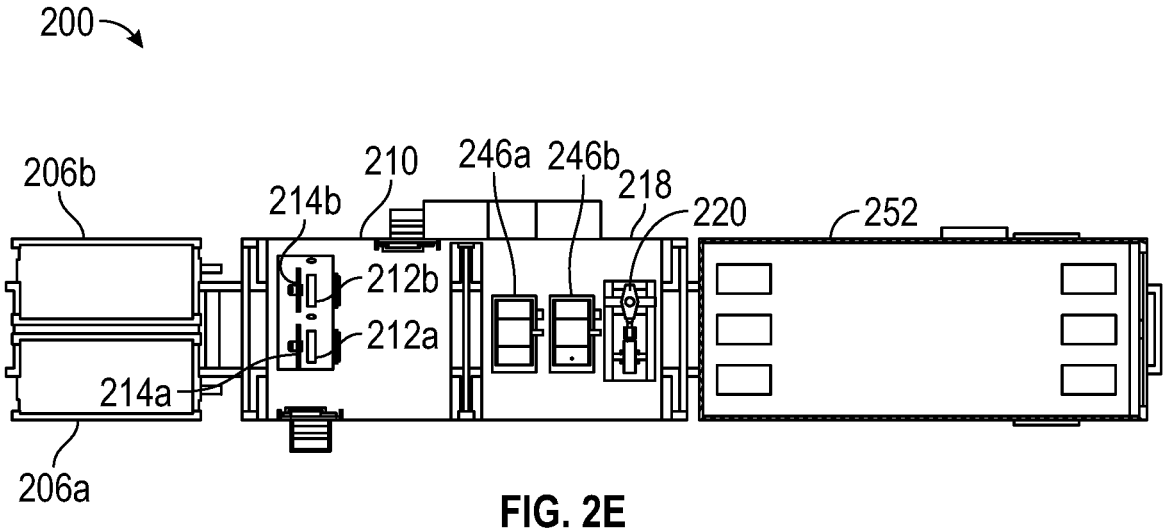
FIG. 2E illustrates a cut-away upper view of the trailer subassembly in FIGS. 2A-2D.
Figure 12A:
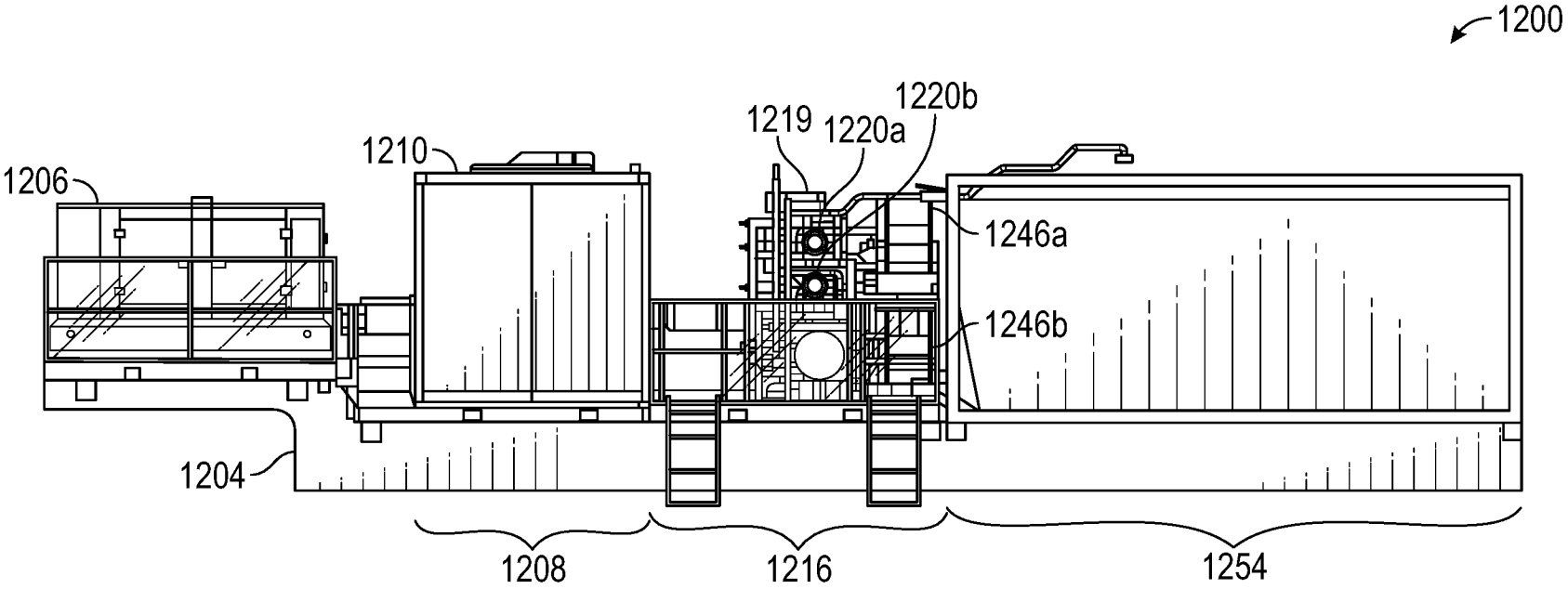
FIG. 12A illustrates a side view of a trailer subassembly for an alternative fuel control and distribution system.
Figure 12B:
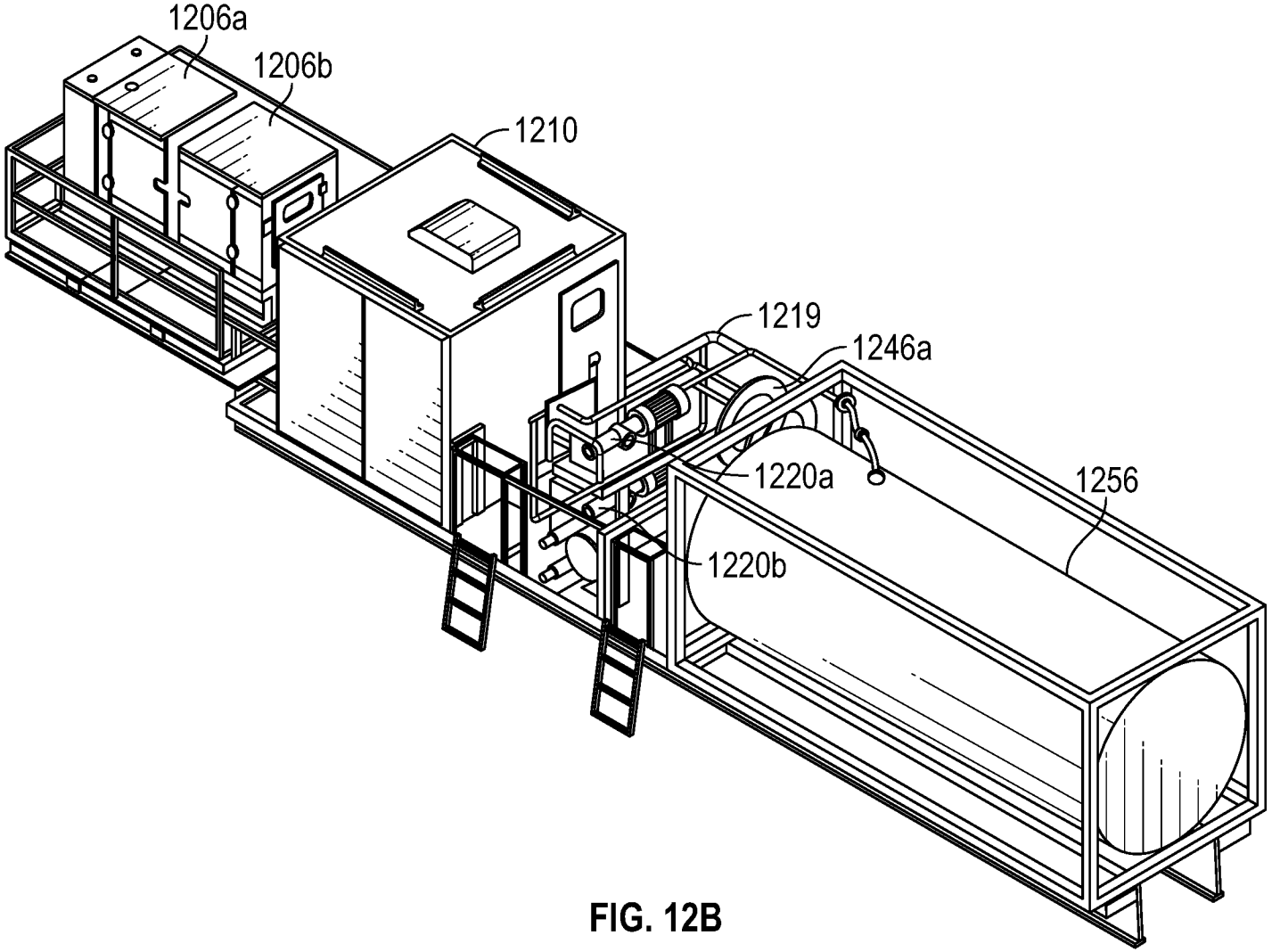
FIG. 12B illustrates a left rear, upper perspective view of the trailer subassembly in FIG. 12A.
Figure 12C:
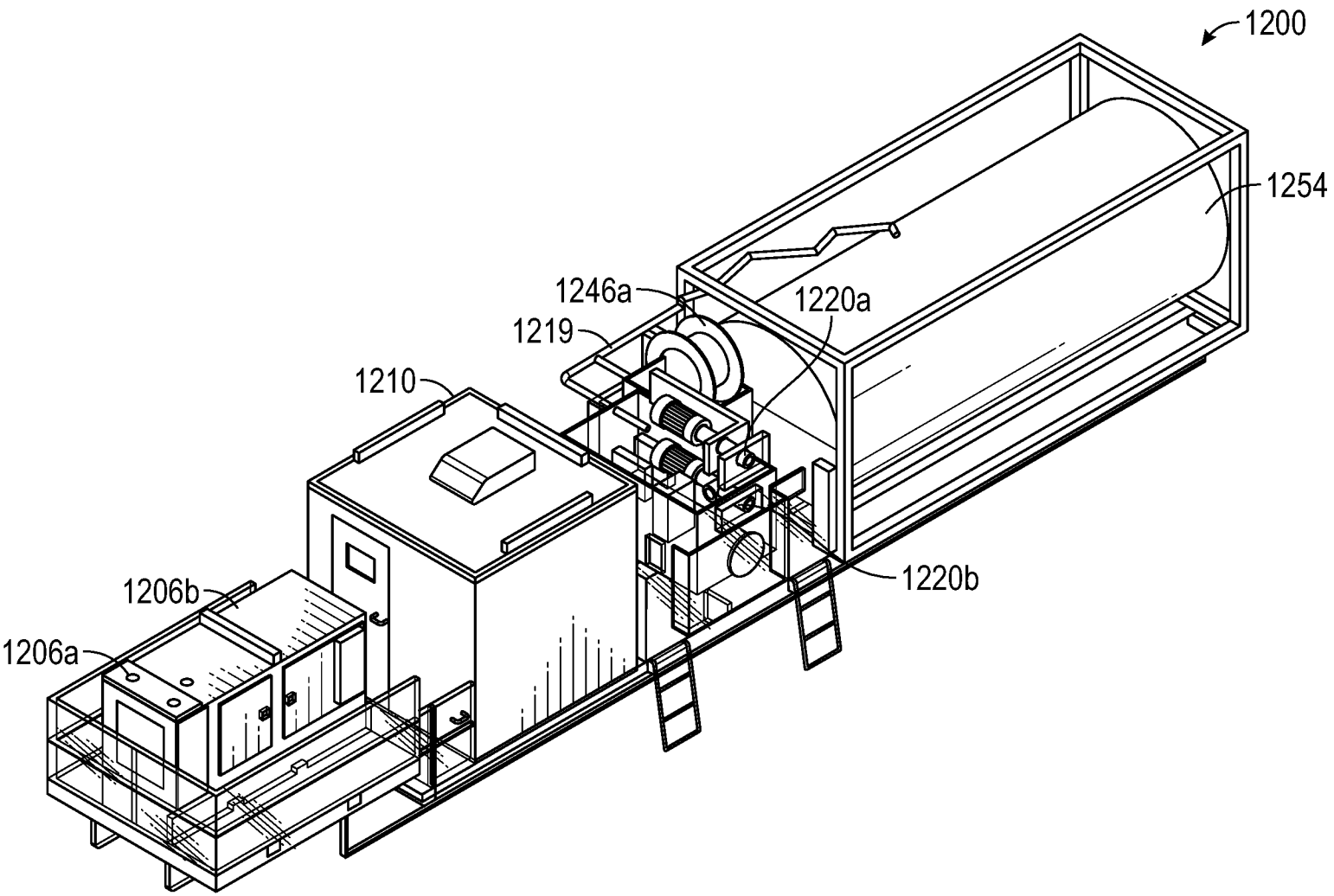
FIG. 12C illustrates a left front, upper perspective view of the trailer subassembly in FIGS. 12A-2B.
Figure 12D:
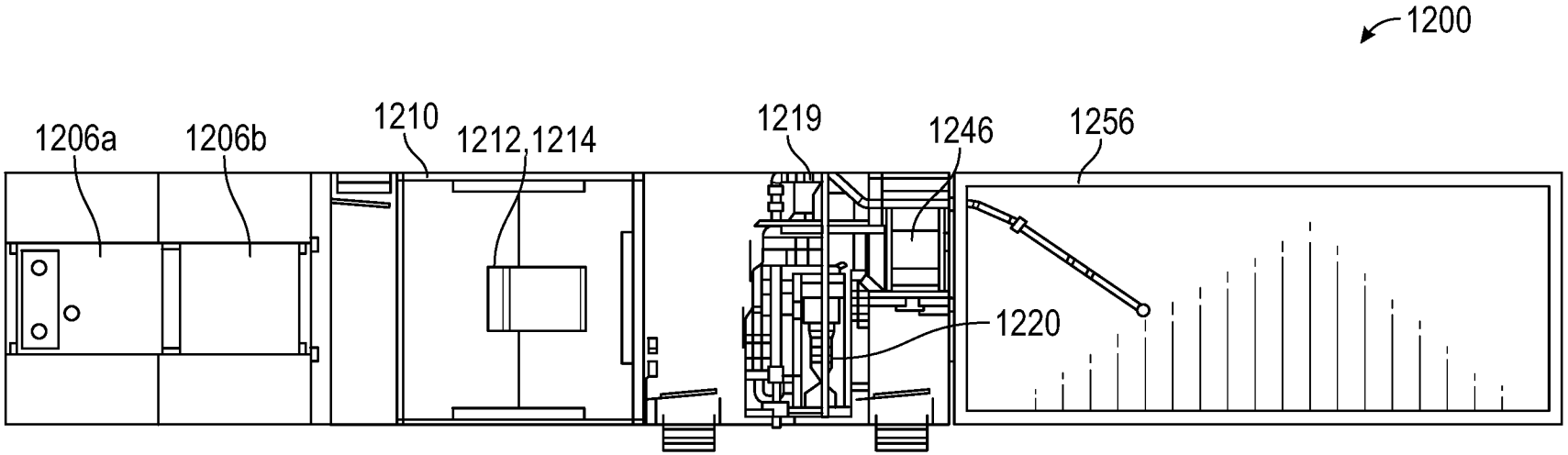
FIG. 12D illustrates an upper, cut-away upper view of the trailer subassembly in FIGS. 12A-2C.
Figure 12E:
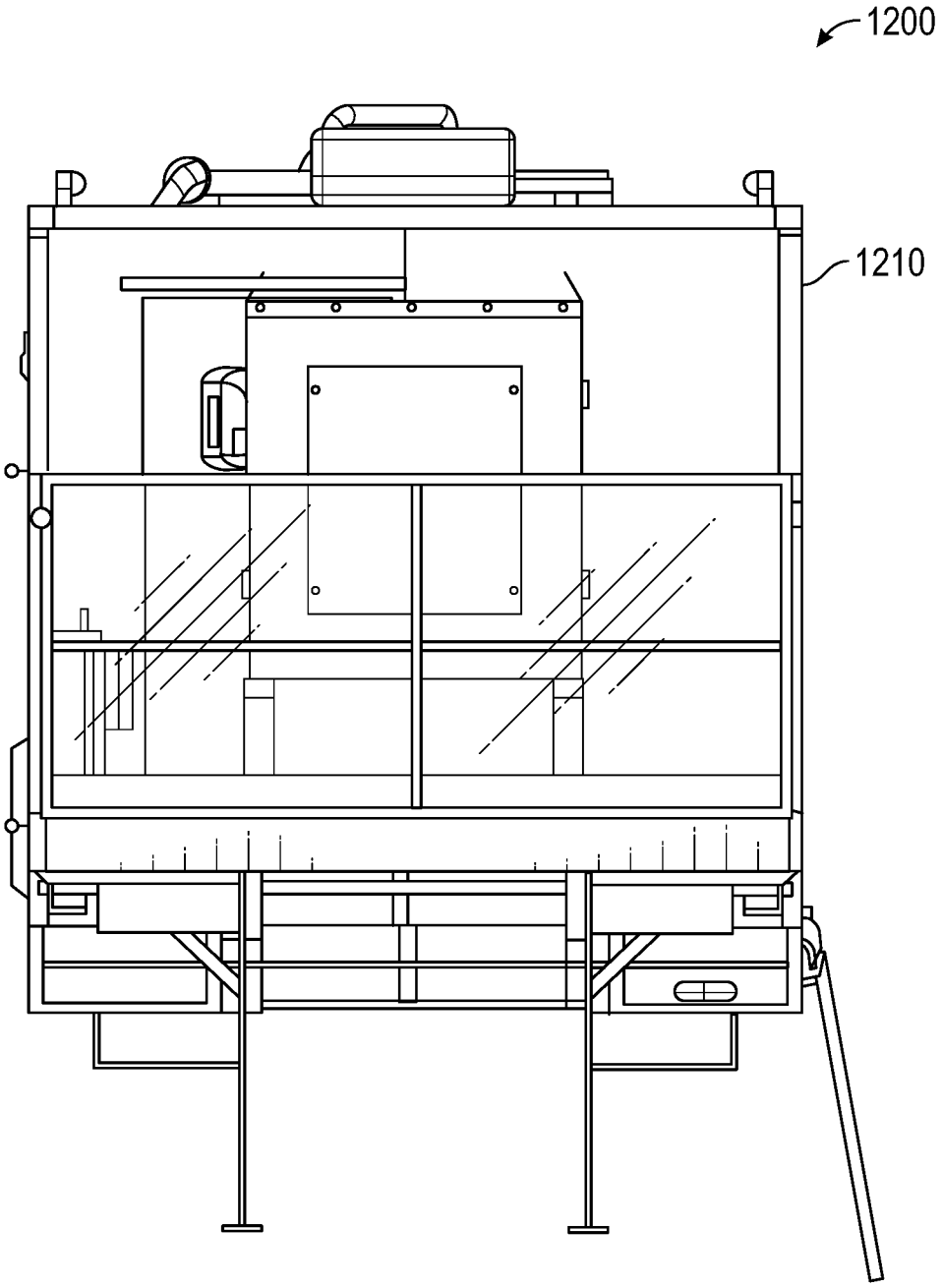
FIG. 12E illustrates a front view of a control shelter of the trailer subassembly in FIGS. 12A-12D.
Figure 12F:
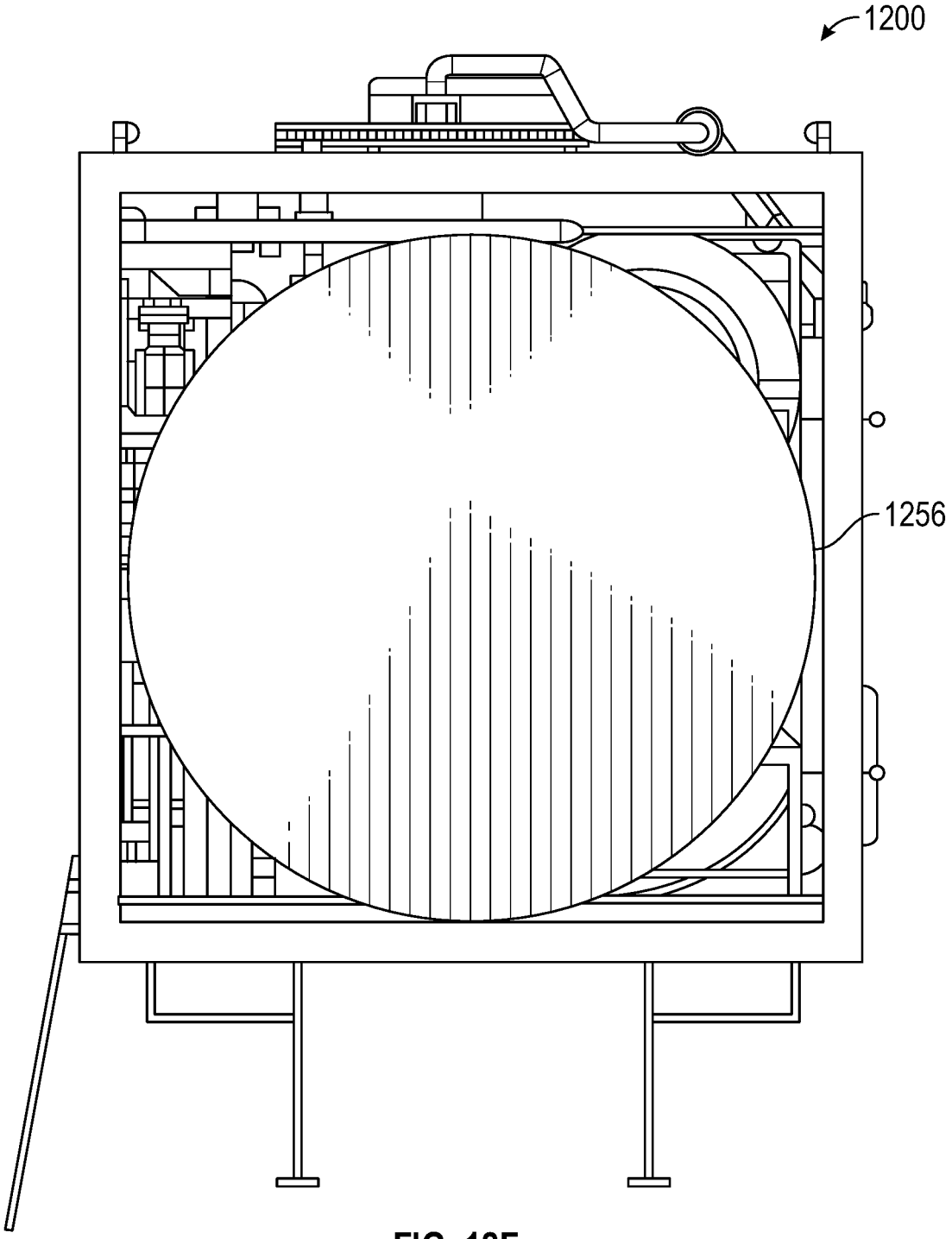
FIG. 12F illustrates a rear view of a fuel tank module of the trailer subassembly in FIGS. 12A-12E.

FIG. 12A illustrates a side view of a trailer subassembly 1202 for an alternative fuel control and distribution system 1200; FIG. 12B illustrates a left rear, upper perspective view of the trailer subassembly 1202 in FIG. 12A; FIG. 2C illustrates a left front, upper perspective view of the trailer subassembly 1202 in FIGS. 12A-2B; FIG. 2D illustrates an upper, cut-away upper view of the trailer subassembly 1202 in FIGS. 12A-2C; FIG. 2E illustrates a front view of a control shelter 1210 of the trailer subassembly 1202 in FIGS. 12A-12D; and FIG. 2E illustrates a rear view of a fuel tank module 1254 of the trailer subassembly 1202 in FIGS. 12A-12D.

As shown in FIGS. 2A-2C, the trailer subassembly 202 comprises a trailer 204, a power generator 206, a control module 208, a pump and spool module 216 and a storage module 250.

As shown in FIGS. 12A-12E, the trailer subassembly 1202 comprises a trailer 1204, a power generator 1206, a control module 1208, a pump and spool module 1216 and a fuel tank module 1254.

The trailer 204, 1204 may be any suitable trailer capable of hauling a fuel control and distribution system 100, 200, 1100, 1200. For example, a suitable trailer 204, 1204 includes a 40-foot long trailer chassis, a 45-foot long trailer chassis, a 48-foot long trailer chassis, a 50-foot long trailer chassis, a 53-foot long trailer chassis, or any combination thereof. In an embodiment, the trailer 204, 1204 may be a 50-foot long trailer chassis.

The power generator 206, 1206 may be any suitable power generator capable of providing power to the fuel control and distribution system 100, 1100. A suitable power generator 206, 1206 is available from Triton Power Inc. In an embodiment, the power generator 206, 1206 may be a 125 kW Triton Diesel Generator.

In an embodiment, the power generator 206, 1206 may be about a 125 kW power generator.

In an embodiment, the trailer subassembly 202, 1202 may comprise a first and second power generator 206*a*, 206*b*, 1206*a*, 1206*b*. The first and second power generator 206*a*, 206*b*, 1206*a*, 1206*b* may be any suitable power generator capable of providing power to the fuel control and distribution system 100, 1100. A suitable first and second power generator 206*a*, 206*b*, 1206*a*, 1206*b* is available from Triton Power Inc. In an embodiment, the first and/or second power generator 206*a*, 206*b*, 1206*a*, 1206*b* may be a 55 kW Triton Diesel Generator.

In an embodiment, the first and/or second power generator 206*a*, 206*b*, 1206*a*, 1206*b* may be about a 55 kW power generator.

In an embodiment, the control module 208, 1208 may further comprise a control shelter 210, 1210 and a control system 212, 1212.

The control shelter 210, 1210 may be any suitable shelter capable of housing the control system 212, 1212 and/or protecting the control system 212, 1212 from the elements. A suitable control shelter 210, 1210 is available from Intertech Instrumentation Inc. In an embodiment, the control shelter 210, 1210 may be an Intertech Artic Shelter. In an embodiment, the control shelter 210, 1210 may be an Intertech Artic Shelter with a swing-out door. See e.g., FIGS. 2A-2D.

In an embodiment, the control shelter 210, 1210 may be about 8-foot long, about 8-foot tall and about 8-foot wide.

In an embodiment, the control module 208, 1208 may further comprise a control shelter 210, 1210, and a control system 212, 1212 comprising a presentation component (e.g., display) 214, 1214.

The control system 212, 1212 may be any suitable computing device, as discussed below.

In an embodiment, the control module 206, 1206 may further comprise a control shelter 210, 1210, and a first and second control system 212*a*, 212*b*, 1212.

In an embodiment, the control module 206, 1206 may further comprise a control shelter 210, 1210, and a first and second control system 212*a*, 212*b*, 1212 comprising a first and second presentation component (e.g., display) 214*a*, 214*b*, 1214, respectively.

The first and second control system 212*a*, 212*b*, 1212 may be any suitable computing device, as discussed below.

In an embodiment, the control module 208, 1208 may further comprise a control shelter 210, 1210, a control system 212, 1212 and a pump motor controller (not shown).

The pump motor controller may any suitable motor controller capable of varying the frequency and voltage to the pump electric motor. For example, a suitable motor controller includes, but is not limited to, an adjustable speed drive (ASD), a variable frequency drive (VFD), or any combination thereof. In an embodiment, the pump motor controller may be an AFD. In an embodiment, the pump motor controller may be a VFD.

In an embodiment, the control module 208, 1208 may further comprise a control shelter 210, 1210, a control system 212, 1212 and a first, second and optional third pump motor controller (not shown).

In an embodiment, the first, second and/or optional third pump motor controller may be an AFD. In an embodiment, the first, second and/or optional third pump motor controller may be a VFD.

Figure 2F:
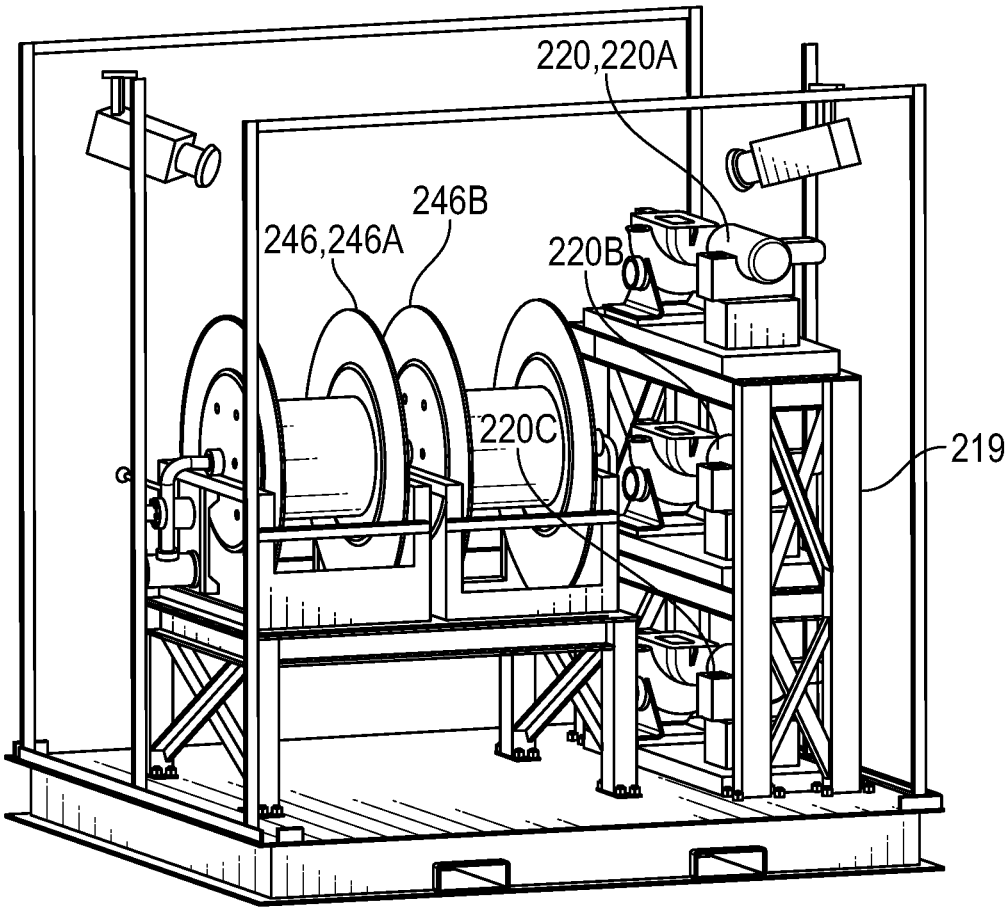
FIG. 2F illustrates a left, front view of a pump and spool subassembly of the trailer subassembly in FIG. 2E.

FIG. 2E illustrates a cut-away upper view of the trailer subassembly 202 in FIGS. 2A-2D; and FIG. 2F illustrates a left, front view of a pump and spool subassembly 219 of the trailer subassembly 202 in FIG. 2E.

In an embodiment, the pump and spool module 216, 1216 may further comprise a pump and spool shelter 218 and a fuel pump 120, 220, 1220 and a spool 146, 246, 1246.

The pump and spool shelter 218 may be any suitable shelter capable of housing the pump and spool subassembly 219, 1219 and/or protecting the pump and spool subassembly 219, 1219 from the elements. A suitable control shelter 218 is available from Intertech Instrumentation Inc. In an embodiment, the control shelter 218 may be an Intertech Artic Shelter. In an embodiment, the control shelter 218 may be an Intertech Artic Shelter with a roll-up door. See e.g., FIGS. 2A-2D.

In an embodiment, the pump and spool module 216, 1216 may further comprise a pump and spool shelter 218 and a first fuel pump 120*a*, 220*a*, 1220*a*, a second fuel pump 120*b*, 220*b*, 1220*b*, an optional third fuel pump 120*c*, 220*c*, a first spool 146*a*, 246*a*, 1246*a* and a second spool 146*b*, 246*b*, 1246*b*.

In an embodiment, the pump and spool module 216, 1216 may further comprise a pump and spool shelter 218 and a pump and spool subassembly 219, 1219.

In an embodiment, the spool subassembly 219, 1219 may comprise a fuel pump 120, 220, 1220 and a spool 146, 246, 1246.

The fuel pump 120, 220, 1220 maybe any suitable fuel pump capable of providing demand for fuel, as discussed above.

The spool 146, 246, 1246 may be any suitable spool capable of spooling the main fuel line 152, 1152, as discussed above.

In an embodiment, the pump and spool subassembly 219, 1219 may comprise a first fuel pump 120*a*, 220*a*, 1220*a*, a second fuel pump 120*b*, 220*b*, 1220*b*, an optional third fuel pump 120*c*, 220*c*, a first spool 146*a*, 246*a*, 1246*a* and a second spool 146*b*, 246*b*, 1246*b*. See e.g., FIGS. 2F & 12A-12D.

The first, second and optional third fuel pump 120*a*, 120*b*, 120*c*, 220*a*, 220*b*, 220*c*, 1220*a*, 1220*b* maybe any suitable fuel pump capable of providing demand for fuel, as discussed above.

The first and second spool 146*a*, 146*b*, 246*a*, 246*b*, 1246*a*, 1246*b* may be any suitable spool capable of spooling the first and second main fuel line 152*a*, 152*b*, 1152*a*, 1152*b*, respectively, as discussed above.

In an embodiment, the pump and spool assembly 219, 1219 may further comprise a first and/or second fuel filter 134*a*, 134*b*, 1134*a*, 1134*b*, a first and/or second pressure regulator 136*a*, 136*b*, 1136*a*, 1136*b*, a first and/or second pop off pump gauge 138*a*, 138*b*, 1138*a*, 1138*b* and/or a first and/or second flow meter 140*a*, 140*b*, 1140*a*, 1140*b*, as discussed above. See e.g., FIGS. 1A-B & 11A-11B.

In an embodiment, the storage module 250 further comprises a storage shelter 252. The storage shelter 252 may be any suitable storage shelter capable of housing a plurality of disconnected CARTT subassemblies for transport. For example, a suitable storage shelter 252 includes, but is not limited to, a 20-foot long shipping container, or any combination thereof. In an embodiment, the storage shelter 252 may be a 20-foot long shipping container.

In an embodiment, the fuel tank module 1254 further comprises a fuel tank 1256.

The fuel tank 1256 may be any suitable fuel tank. For example, a suitable fuel tank 1256 includes, but is not limited to, an ISO fuel tank, a fuel tanker, or any combination thereof.

Complete All-Terrain Remote Transport Truck (CARTT) Subassembly

FIG. 1E illustrates a detailed schematic of a complete all-terrain remote transport truck (CARTT) subassembly portion of the system 100 in FIGS. 1A-1D.

Figure 3:
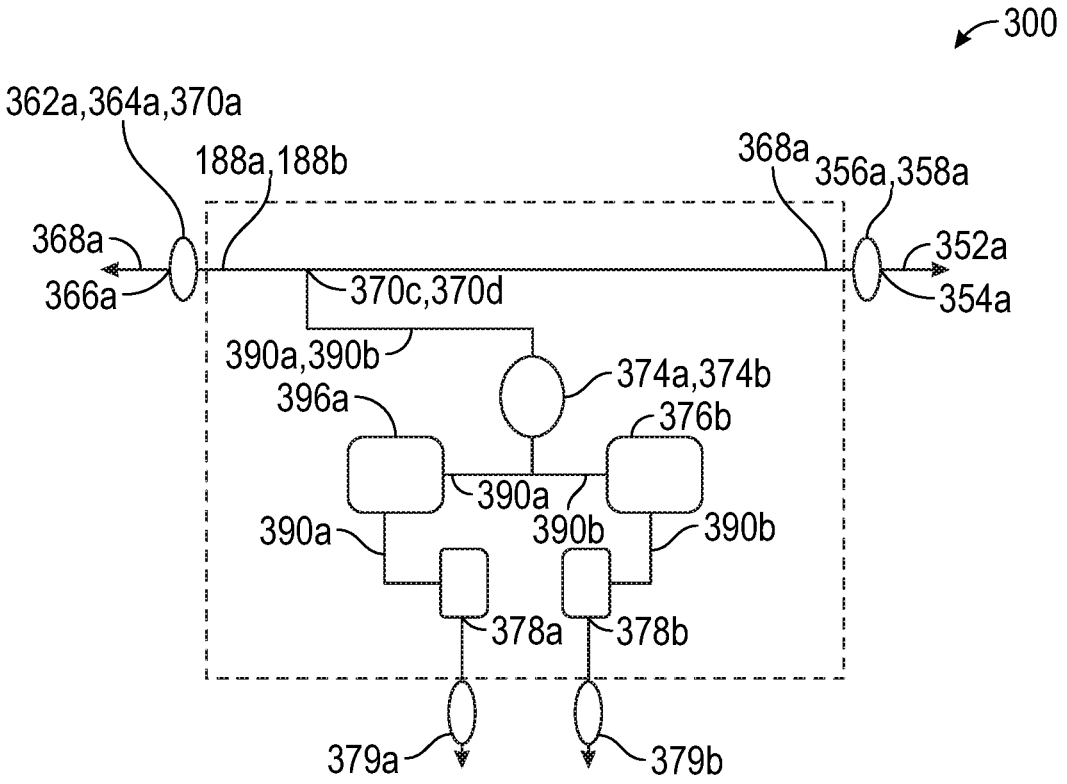
FIG. 3 illustrates a flow diagram of a CARTT subassembly for a fuel control and distribution system.
Figure 4:
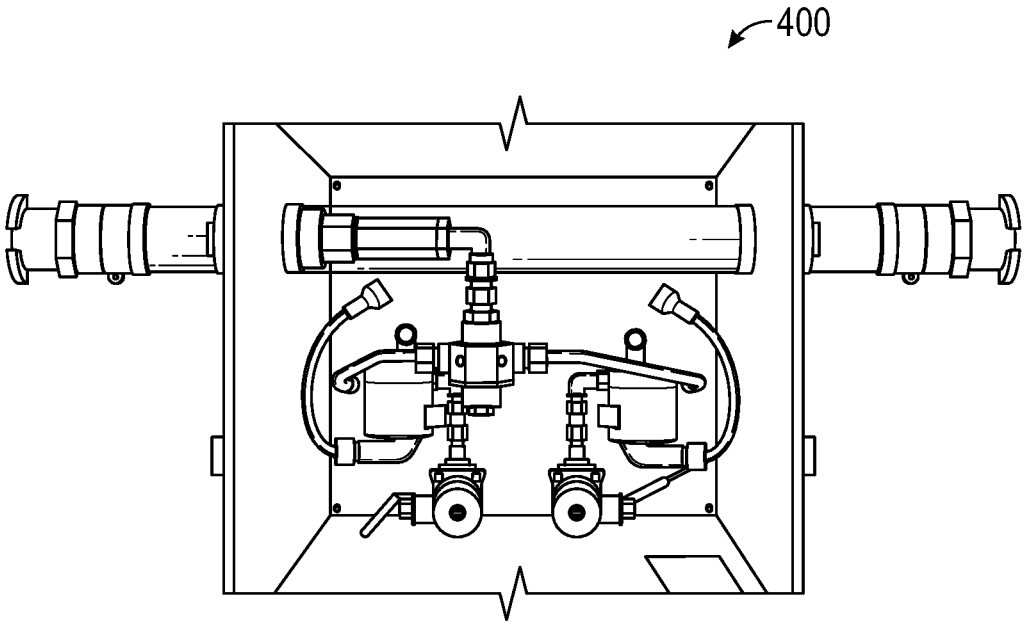
FIG. 4 illustrates a top view of a flow control box of the CARTT subassembly for a fuel control and distribution system.

FIG. 3 illustrates a flow diagram of a CARTT subassembly 300 for a fuel control and distribution system; and FIG. 4 illustrates a top view of a flow control box 400 of the CARTT subassembly for a fuel control and distribution system.

Figure 13:
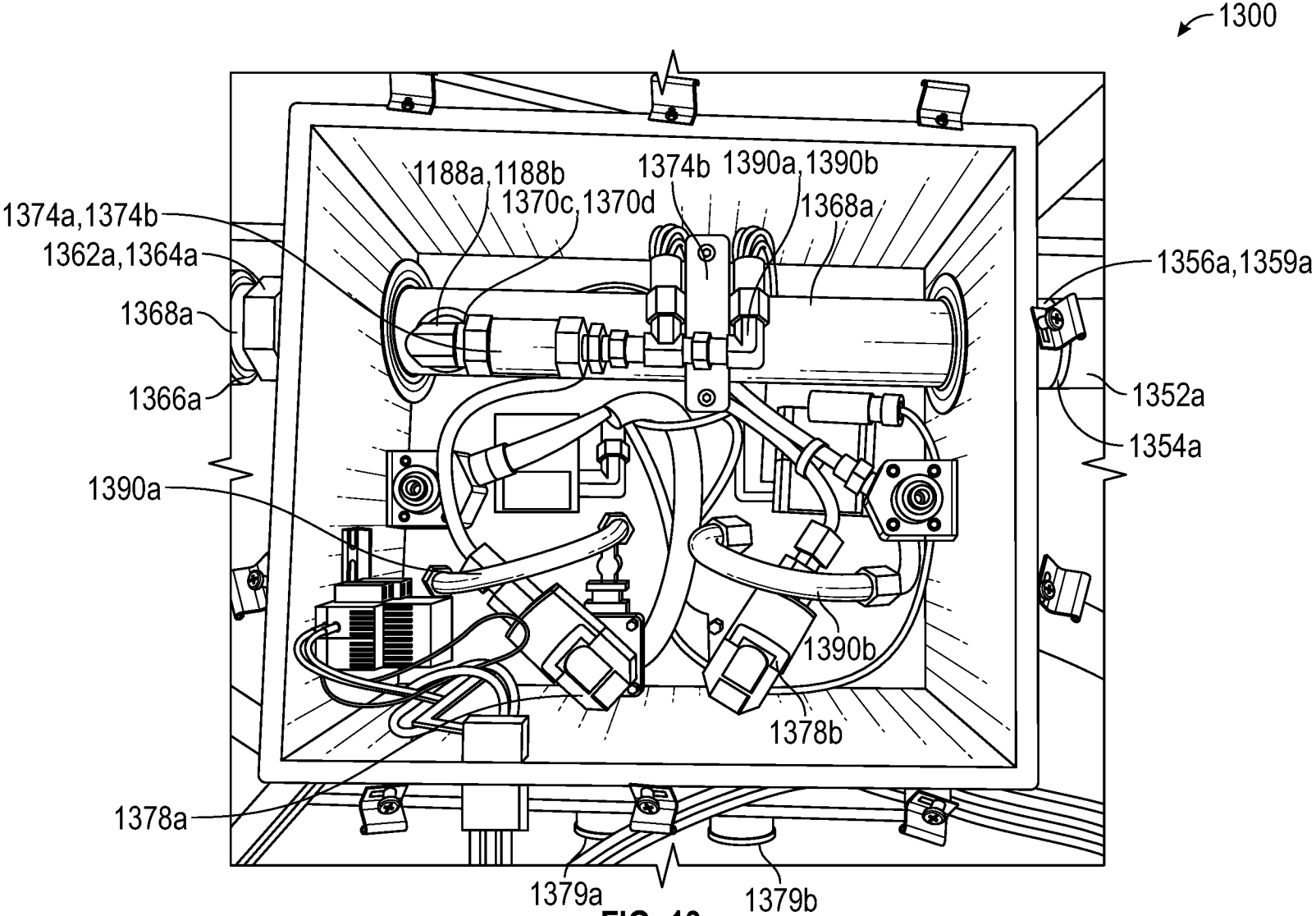
FIG. 13 illustrates a top view of an alternative flow control box of the alternative CARTT subassembly for a fuel control and distribution system.

FIG. 13 illustrates a top view of an alternative flow control box 1300 of the alternative CARTT subassembly for a fuel control and distribution system.

As shown in FIGS. 1E, 3, 11E and 13, a CARTT subassembly 300, 1300 comprises a first fuel CARTT fuel inlet 156*a*, 356*a*, 1156*a*, 356*a*, a first CARTT fuel outlet 162*a*, 362*a*, 1162*a*, 1362*a*, a first CART tap line 190*a*, 390*a*, 1190*a*, 1390*a* and a second CARTT tap line 190*b*, 390*b*, 1190*b*, 1390*b*.

In an embodiment, a first main fuel line outlet 154*a*, 354*a*, 1154*a*, 1354*a* to the first main fuel line 152*a*, 352*a*, 1152*a*, 1352*a* may be fluidly connected to a first CARTT fuel inlet 156*a*, 356*a*, 1156*a*, 1356*a* of a first CARTT 160*a*, 1160*a*.

In an embodiment, the fuel flow in the main fuel line 152, 152*a*, 152*b*, 352*a*, 1152, 1152*a*, 1152*b*, 1352*a* may be bidirectional. According, references herein to the positions of elements (e.g., "inlet," "outlet") are merely used to describe the orientation of various elements in the figures. It should be noted that the orientation of various elements may differ according to other exemplary embodiments, and that such variations are intended to be encompassed by the present disclosure.

The first CARTT 160*a*, 1160*a* may be any suitable cart, as discussed below. See e.g., FIGS. 1A, 1C, 1E, 3-6B, 11A, 11C, 11E & 13-14F.

The first CARTT fuel inlet 156*a*, 356*a*, 1156*a*, 1356*a* may be any suitable inlet. For example, a suitable first CARTT fuel inlet 156*a*, 356*a*, 1156*a*, 1356*a* includes, but is not limited to a 2-inch diameter connector, a 3-inch diameter connector, a 2-inch diameter shut-off valve, a 3-inch diameter shut-off valve, a 2-inch diameter zero-drip connector, a 3-inch diameter zero-drip connector, or any combination thereof. A suitable first CARTT fuel inlet 156*a*, 356*a*, 1156*a*, 1356*a* is available from Dixon. In an embodiment, the first CARTT fuel inlet 156*a*, 356*a*, 1156*a*, 1356*a* may be a BA32-200 2-inch ID SS Bayonet Dry Disconnect Coupler from Dixon.

In an embodiment, the first CARTT fuel inlet 156*a*, 356*a*, 1156*a*, 1356*a* may be a 2-inch diameter connector. In an embodiment, the first CARTT fuel inlet 156*a*, 356*a*, 1156*a*, 1356*a* may be a 2-inch diameter shut-off valve. In an embodiment, the first CARTT fuel inlet 156*a*, 356*a*, 1156*a*, 1356*a* may be a 2-inch diameter zero-drip connector 359*a*, 1359*a*.

In an embodiment, a first CARTT fuel outlet 162*a*, 362*a*, 1162*a*, 1362*a* of the First CARTT 160*a*, 1160*a* may be fluidly connected to a first CARTT fuel line inlet 166*a*, 366*a*, 1166*a*, 1366*a* of a first CARTT fuel line 168*a*, 368*a*, 1168*a*, 1368*a*.

The first CARTT fuel outlet 162*a*, 362*a*, 1162*a*, 1362*a* may be any suitable outlet. For example, a suitable first CARTT fuel outlet 162*a*, 362*a*, 1162*a*, 1362*a* includes, but is not limited to a 2-inch diameter connector, a 3-inch diameter connector, a 2-inch diameter shut-off valve, a 3-inch diameter shut-off valve, a 2-inch diameter zero-drip connector, a 3-inch diameter zero-drip connector, or any combinations thereof. A suitable first CARTT fuel outlet 162*a*, 362*a*, 1162*a*, 1362*a* is available from Dixon. In an embodiment, the first CARTT fuel outlet 162*a*, 362*a*, 1162*a*, 1362*a* may be a BA32-200 2-inch ID SS Bayonet Dry Disconnect Coupler from Dixon.

In an embodiment, the first CARTT fuel outlet 162*a*, 362*a*, 1162*a*, 1362*a* may be a 2-inch diameter connector. In an embodiment, the first CARTT fuel inlet 162*a*, 362*a*, 1162*a*, 1362*a* may be a 2-inch diameter shut-off valve. In an embodiment, the first CARTT fuel inlet 162*a*, 362*a*, 1162*a*, 1362*a* may be a 2-inch diameter zero-drip connector 364*a*, 1364*a*.

In an embodiment, a first CARTT fuel line outlet 170*a*, 370*a*, 1170*a*, 1370*a* of the first CART fuel line 168*a*, 368*a*, 1168*a*, 1368*a* may be fluidly connected to a third CARTT fuel inlet 1006*a*, 11006*a* of a third CARTT 1010*a*, 11010*a*.

In an embodiment, a second CARTT fuel line outlet 170*b*, 370*b*, 1170*b*, 11070*b* of the second CART fuel line 168*b*, 368*b*, 1168*b*, 1368*b* may be fluidly connected to a fourth CARTT fuel inlet 1006*b*, 11006*b* of a fourth CARTT 1010*b*, 11010*b*.

In an embodiment, a third CARTT fuel line outlet 170*c*, 370*c*, 1170*c*, 1370*c* of the first CARTT fuel line 168*a*, 368*a*, 1168*a*, 1368*a* may be fluidly connected to a first CARTT tap line inlet 188*a*, 388*a*, 1188*a*, 1388*a* of a first CARTT tap line 190*a*, 390*a*, 1190*a*, 1390*a*.

In an embodiment, a fourth CARTT fuel line outlet 170*d*, 370*d*, 1170*d*, 1370*d* of the second CARTT fuel line 168*b*, 368*b*, 1168*b*, 1368*b* may be fluidly connected to a second CARTT tap line inlet 188*b*, 388*b*, 1188*b*, 1388*b* of a second CARTT tap line 190*b*, 390*b*, 1190*b*, 1390*b*.

The first and second CARTT tap lines 190*a*, 190*b*, 390*a*, 390*b*, 1190*a*, 1190*b*, 1390*a*, 1390*b* may be any suitable tap line capable of providing demand for fuel. For example, a suitable first and second fuel line 190*a*, 190*b*, 390*a*, 390*b*, 1190*a*, 1190*b*, 1390*a*, 1390*b* includes, but is not limited to, a ⅜-inch diameter tap line, ½-inch diameter tap line, a ¾-inch diameter tap line, a 1-inch diameter tap line, or any combination thereof. A suitable first and second CARTT tap line 190*a*, 190*b*, 390*a*, 390*b*, 1190*a*, 1190*b*, 1390*a*, 1390*b* is available from Texcel. In an embodiment, the first and/or second CARTT tap line 190*a*, 190*b*, 390*a*, 390*b*, 1190*a*, 1190*b*, 1390*a*, 1390*b* may be a Texcel ¾-inch diameter, 200 psi fuel hose from Texcel.

In an embodiment, the first and second CARTT tap line 190*a*, 190*b*, 390*a*, 390*b*, 1190*a*, 1190*b*, 1390*a*, 1390*b* may be a ⅜-inch diameter tap line. In an embodiment, the first and second CARTT tap line 190*a*, 190*b*, 390*a*, 390*b*, 1190*a*, 1190*b*, 1390*a*, 1390*b* may be a ¾-inch diameter tap line.

In an embodiment, the first CARTT tap line 190*a*, 390*a*, 1190*a*, 1390*a* may further comprise an optional first CARTT check valve 172*a*, 372*a*, 1172*a*, 1372*a*, a first CARTT pressure regulator 174*a*, 374*a*, 1174*a*, 1374*a*, a first CARTT flow meter 176*a*, 376*a*, 1176*a*, 1376*a*, a first CARTT valve 178*a*, 378*a*, 1178*a*, 1378*a*, a first CARTT connector 379*a*, 1379*a*, or any combination thereof.

In an embodiment, the second CARTT tap line 190*b*, 390*b*, 1190*b*, 1390*b* may further comprise an optional second CARTT check valve 172*b*, 372*b*, 1172*b*, 1372*b* a second CARTT pressure regulator 174*b*, 374*b*, 1174*b*, 1374*b*, a second CARTT flow meter 176*b*, 376*b*, 1176*b*, 1376*b*, a second CARTT valve 178*b*, 378*b*, 1178*b*, 1378*b*, a second CARTT connector 379*b*, 1379*b*, or any combination thereof.

In an embodiment, the optional first and second CARTT check valve 172*a*, 172*b*, 372*a*, 372*b*, 1172*a*, 1172*b*, 1372*a*, 1372*b* may be combined as a single check valve.

In an embodiment, the first and second CARTT pressure regulator 174*a*, 174*b*, 374*a*, 374*b*, 1174*a*, 1174*b*, 1374*a*, 1374*b* may be combined as a single pressure regulator. See e.g., FIGS. 3 & 13.

The first and second CARTT check valve 172*a*, 172*b*, 372*a*, 372*b*, 1172*a*, 1172*b*, 1372*a*, 1372*b* may be any suitable check valve capable of preventing fuel back flow. For example, a suitable first and second CARTT check valve 172*a*, 172*b*, 372*a*, 372*b*, 1172*a*, 1172*b*, 1372*a*, 1372*b* includes, but is not limited to a ball check valve, a duo-check valve, a disk check valve, a non-slam check valve, a piston check valve, a swing check valve, a tilting disk check valve, a wafer check valve, or any combination thereof. A suitable first and second check valve 172*a*, 172*b*, 372*a*, 372*b*, 1172*a*, 1172*b*, 1372*a*, 1372*b* is available from Swagelok. In an embodiment, the first and/or second check valve 172*a*, 172*b*, 372*a*, 372*b*, 1172*a*, 1172*b*, 1372*a*, 1372*b* may be a ½ FNPT 4600 psi MWP, 1 psi cracking pressure, SHCV-2-F-8N-1P-SS from Swagelok.

The first and second CARTT pressure regulator 174*a*, 174*b*, 374*a*, 374*b*, 1174*a*, 1174*b*, 1374*a*, 1374*b* may be any suitable pressure regulator capable of reducing the fuel pressure to about 2 psi. A suitable first and second CARTT pressure regulator 174*a*, 174*b*, 374*a*, 374*b*, 1174*a*, 1174*b*, 1374*a*, 1374*b* is available from Lime Instruments/JEGS Performance Products. In an embodiment, the first and/or second CARTT pressure regulator 174*a*, 174*b*, 374*a*, 374*b*, 1174*a*, 1174*b*, 1374*a*, 1374*b* may be a JEGS 159117 pressure regulator from Lime Instruments/JEGS Performance Products.

The first and second CARTT flow meter 176*a*, 176*b*, 376*a*, 376*b*, 1176*a*, 1176*b*, 1376*a*, 1376*b* may be any suitable flow meter capable of controlling and/or monitoring fuel flow rate. For example, a suitable first and second CARTT flow meter 176*a*, 176*b*, 376*a*, 376*b*, 1176*a*, 1176*b*, 1376*a*, 1376*b* includes, but is not limited to differential pressure flow meters, mass flow meters, open-channel flow meters, positive displacement flow meters, velocity flow meters, or any combination thereof. A suitable first and second CARTT flow meter 176*a*, 176*b*, 376*a*, 376*b*, 1176*a*, 1176*b*, 1376*a*, 1376*b* is available from Lime Instruments/Flomec. In an embodiment, the first and/or second CARTT flow meters 176*a*, 176*b*, 376*a*, 376*b*, 1176*a*, 1176*b*, 1376*a*, 1376*b* may be an OM008-s-5-1-3-2-2-2-SS flow meter from Lime Instruments/Flomec.

The first and second CARTT valve 178*a*, 178*b*, 378*a*, 378*b*, 1178*a*, 1178*b*, 1378*a*, 1378*b* any be any suitable valve. For example, a suitable first and second CARTT valve 178*a*, 178*b*, 378*a*, 378*b*, 1178*a*, 1178*b*, 1378*a*, 1378*b* includes, but is not limited to a ⅜-inch diameter shut-off valve, a ¾-inch diameter shut-off valve, a ⅜-inch diameter zero-drip connector, a ¾-inch diameter zero-drip connector, or any combination thereof. A suitable first and second CARTT fuel inlet 178*a*, 178*b*, 378*a*, 378*b*, 1178*a*, 1178*b*, 1378*a*, 1378*b* is available from ASCO. In an embodiment, the first and/or second CARTT valve 178*a*, 178*b*, 378*a*, 378*b*, 1178*a*, 1178*b*, 1378*a*, 1378*b* may be an ASCO 8210G095V valve from ASCO.

In an embodiment, the first and second CARTT connector 379*a*, 379*b*, 1379*a*, 1379*b* may be any suitable connector. For example, a suitable first and second CARTT connector 379*a*, 379*b*, 1379*a*, 1379*b* includes, but is not limited to a 2-inch diameter connector, a 3-inch diameter connector, a 2-inch diameter zero-drip connector, a 3-inch diameter zero-drip connector, or any combination thereof. A suitable first and second CARTT connector 379*a*, 379*b*, 1379*a*, 1379*b* is available from Dixon. In an embodiment, the first and/or second CARTT connector 379*a*, 379*b*, 1379*a*, 1379*b* may be a Dixon ENABL-P Red Engine Nozzle Ball Lock from Dixon.

Figure 5A:
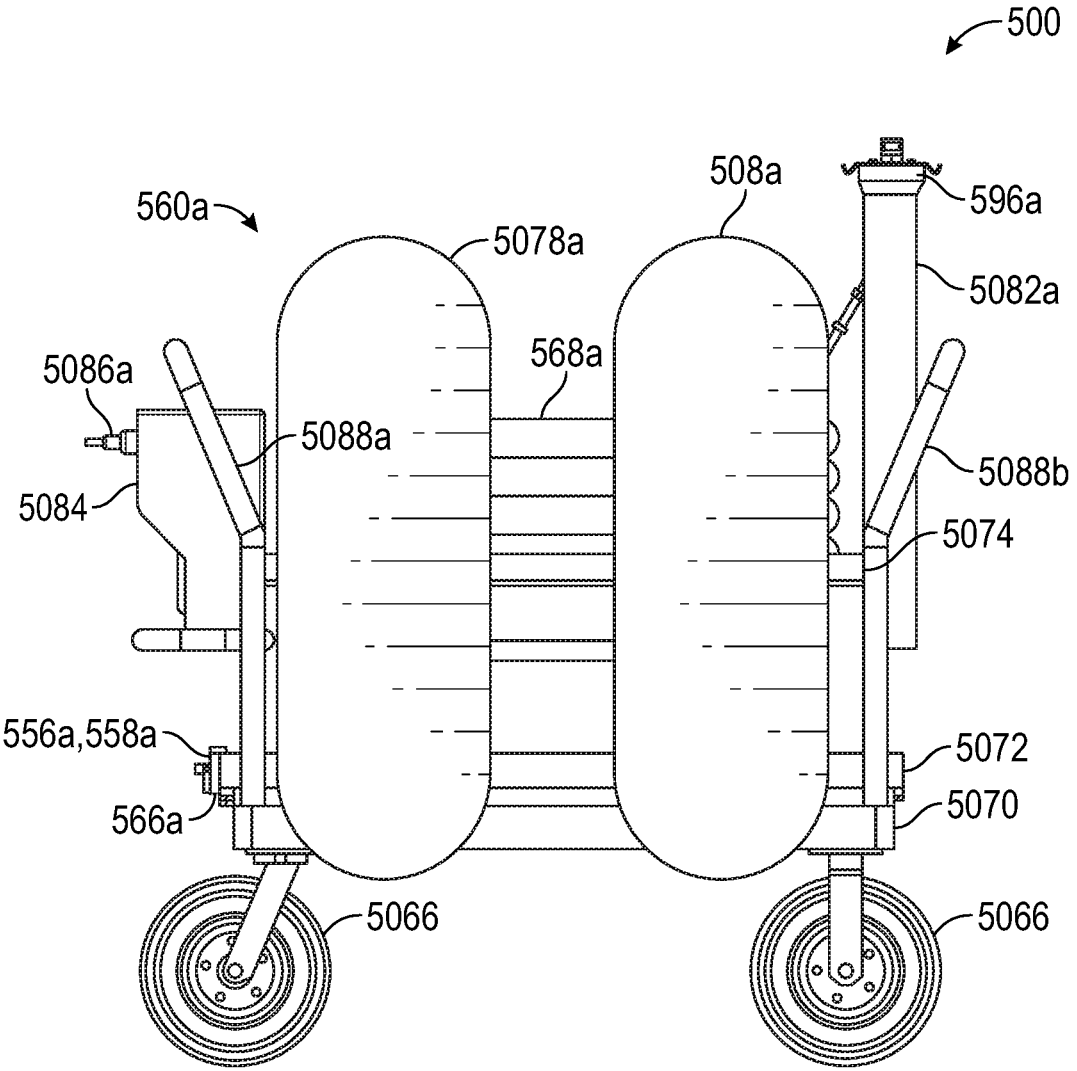
FIG. 5A illustrates a left side view of the CARTT subassembly for a fuel control and distribution system.
Figure 5B:
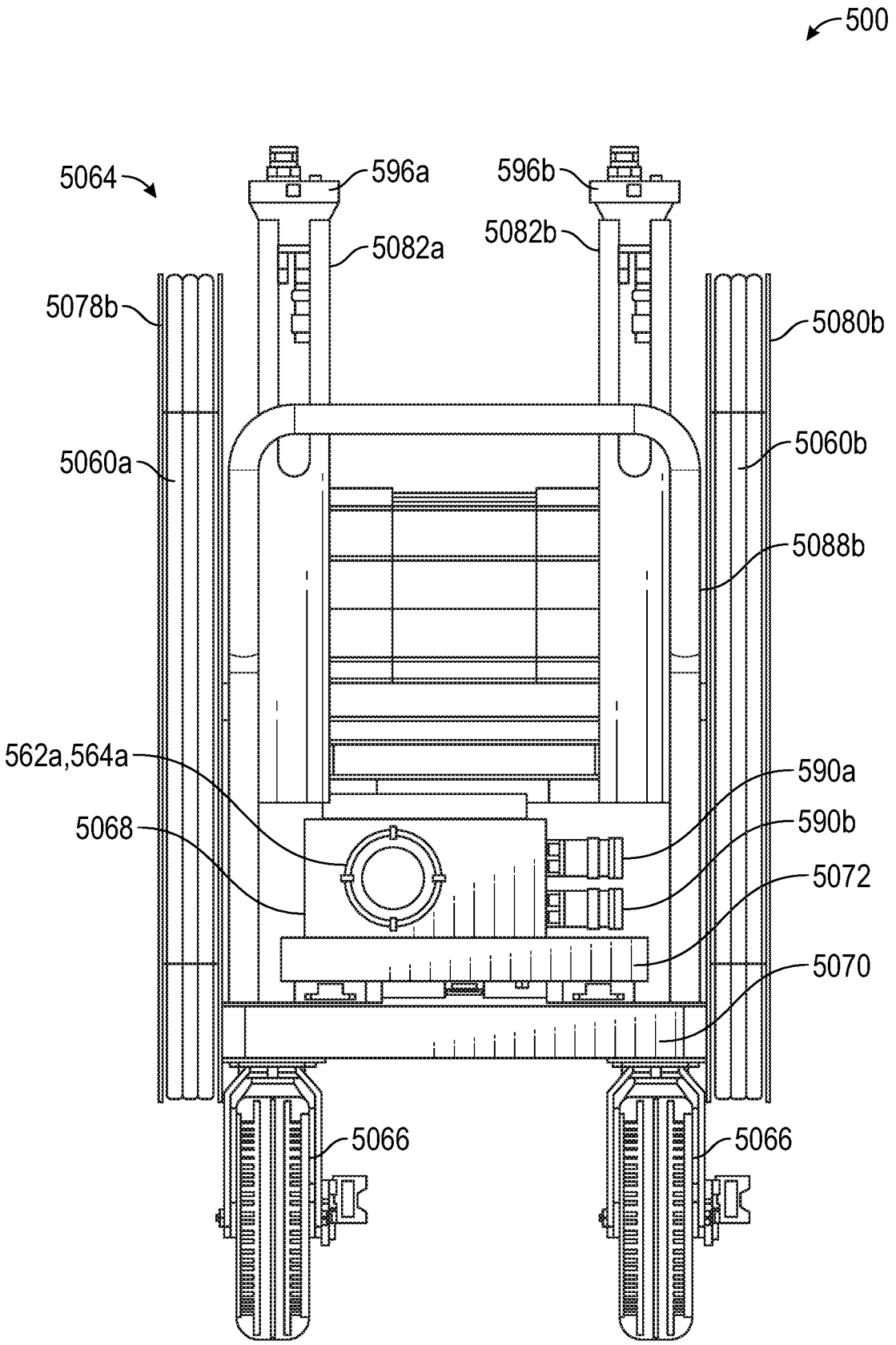
FIG. 5B illustrates a rear view of the CARTT subassembly of FIG. 5A.
Figure 5C:
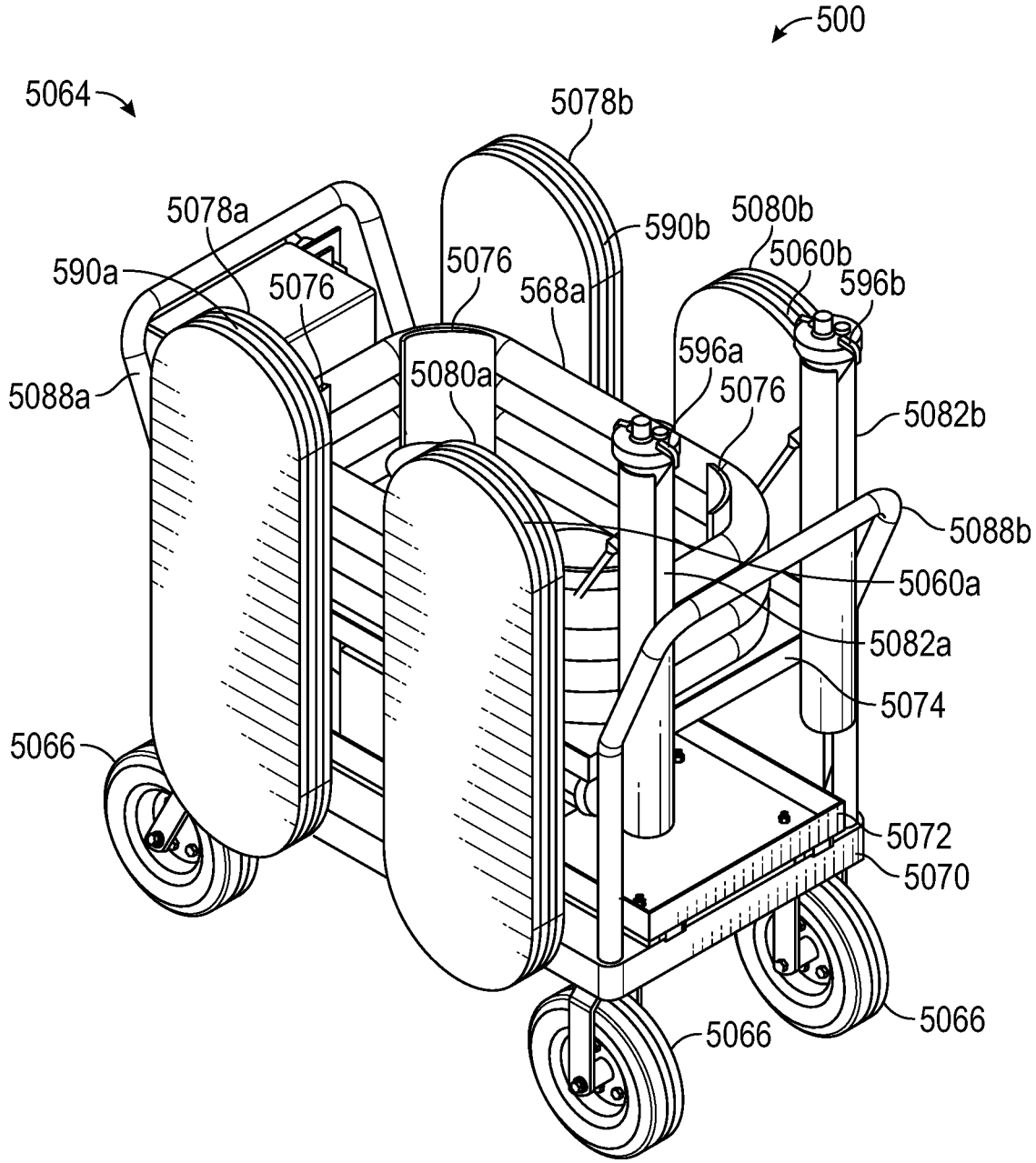
FIG. 5C illustrates a left, rear perspective view of the CARTT subassembly of FIGS. 5A-5B.
Figure 5D:
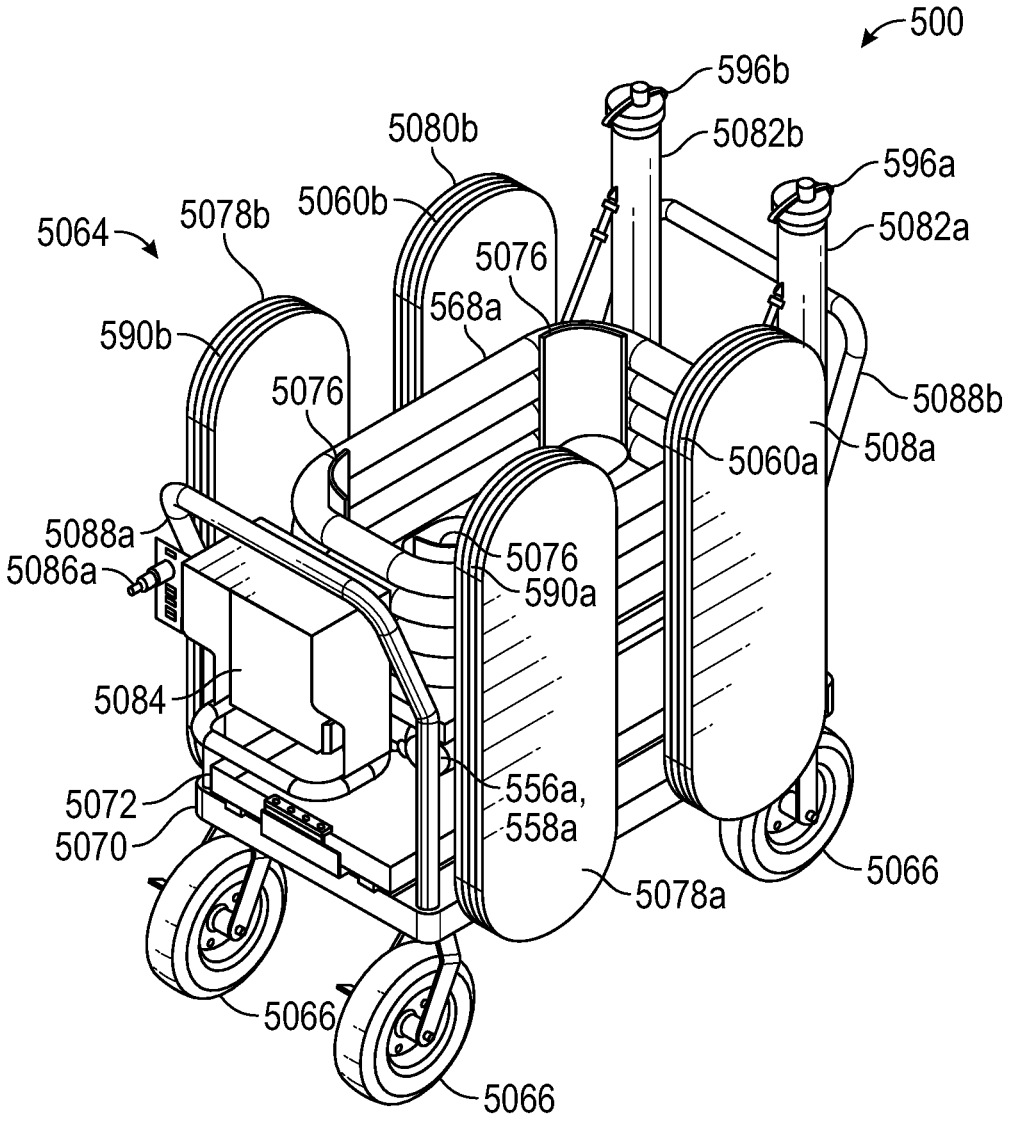
FIG. 5D illustrates a left, front perspective view of the CARTT subassembly of FIGS. 5A-5C.

FIG. 5A illustrates a left side view of the CARTT subassembly 500 for a fuel control and distribution system; FIG. 5B illustrates a rear view of the CARTT subassembly 500 of FIG. 5A; FIG. 5C illustrates a left, rear perspective view of the CARTT subassembly 500 of FIGS. 5A-5B; and FIG. 5D illustrates a left, front perspective view of the CARTT subassembly 500 of FIGS. 5A-5C.

Figure 6A:
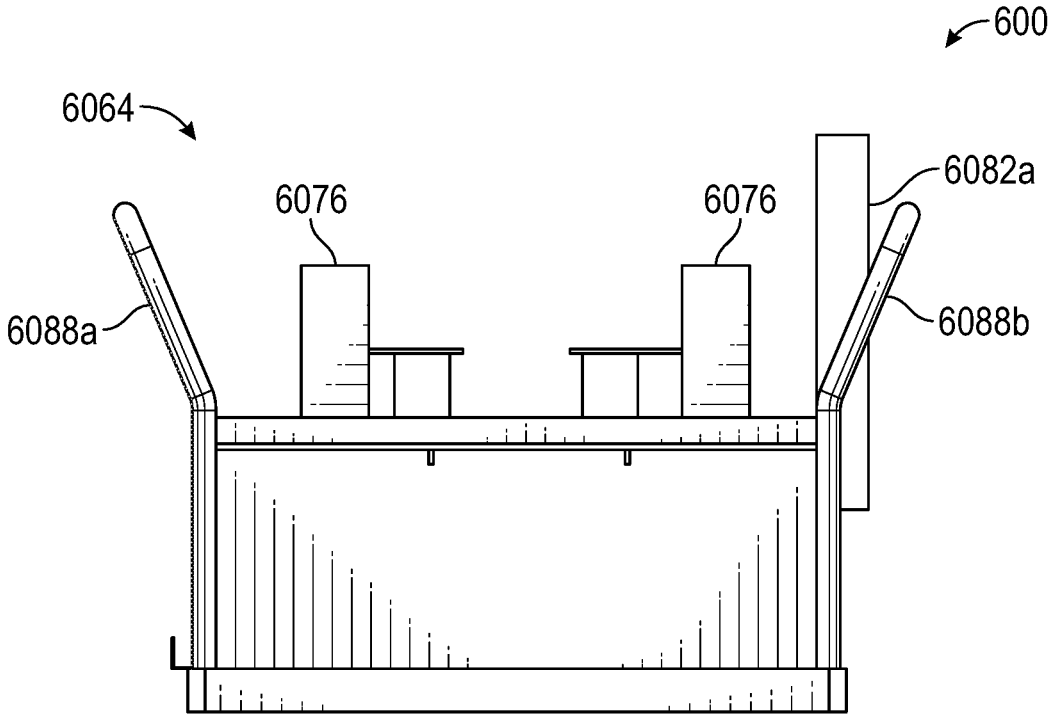
FIG. 6A illustrates a left side view of the CARTT subassembly for a fuel control and distribution system.
Figure 6B:
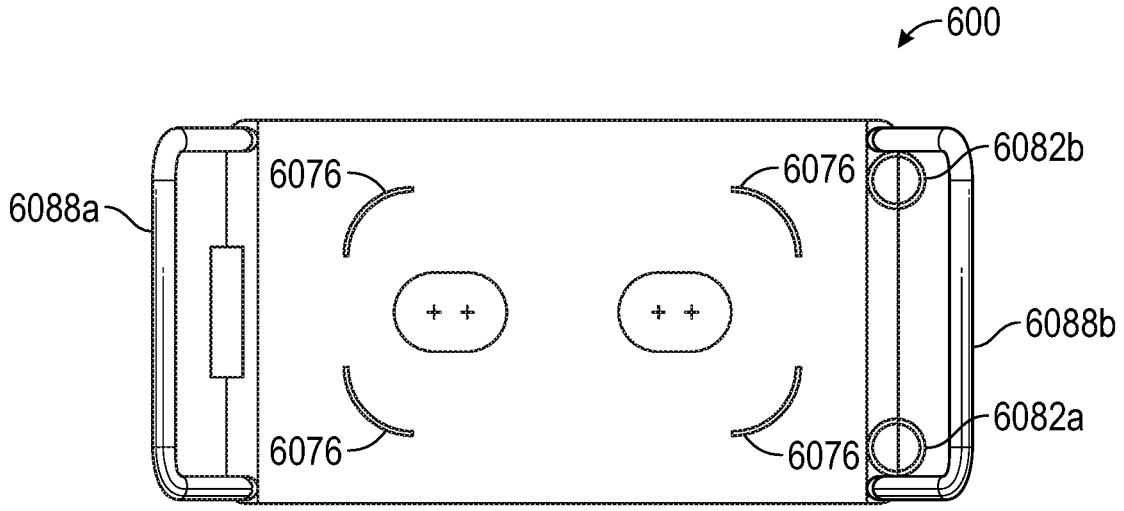
FIG. 6B illustrates a top view of the CARTT subassembly of FIG. 6A.

FIG. 6A illustrates a left side view of the CARTT subassembly 600 for a fuel control and distribution system; and FIG. 6B illustrates a top view of the CARTT subassembly 600 of FIG. 6A.

Figure 14A:
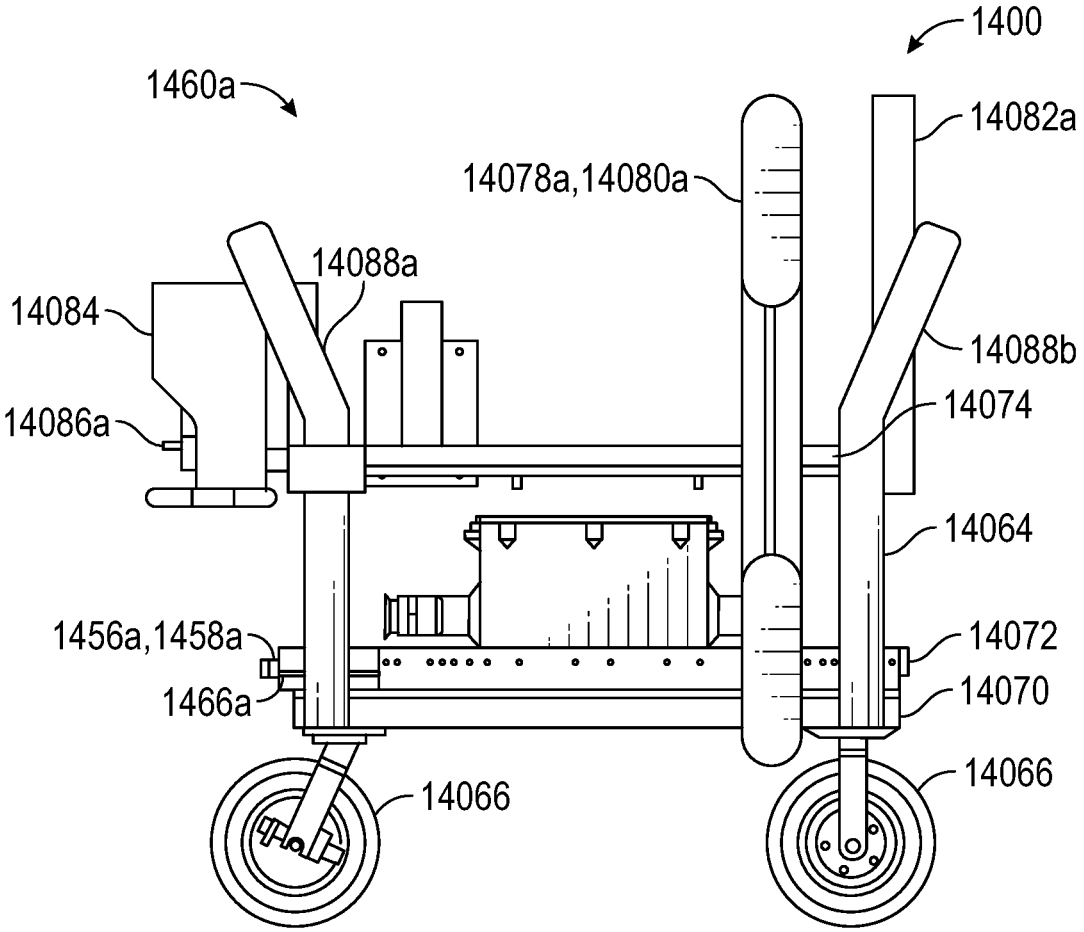
FIG. 14A illustrates a left side view of the alternative CARTT subassembly for a fuel control and distribution system.
Figure 14B:
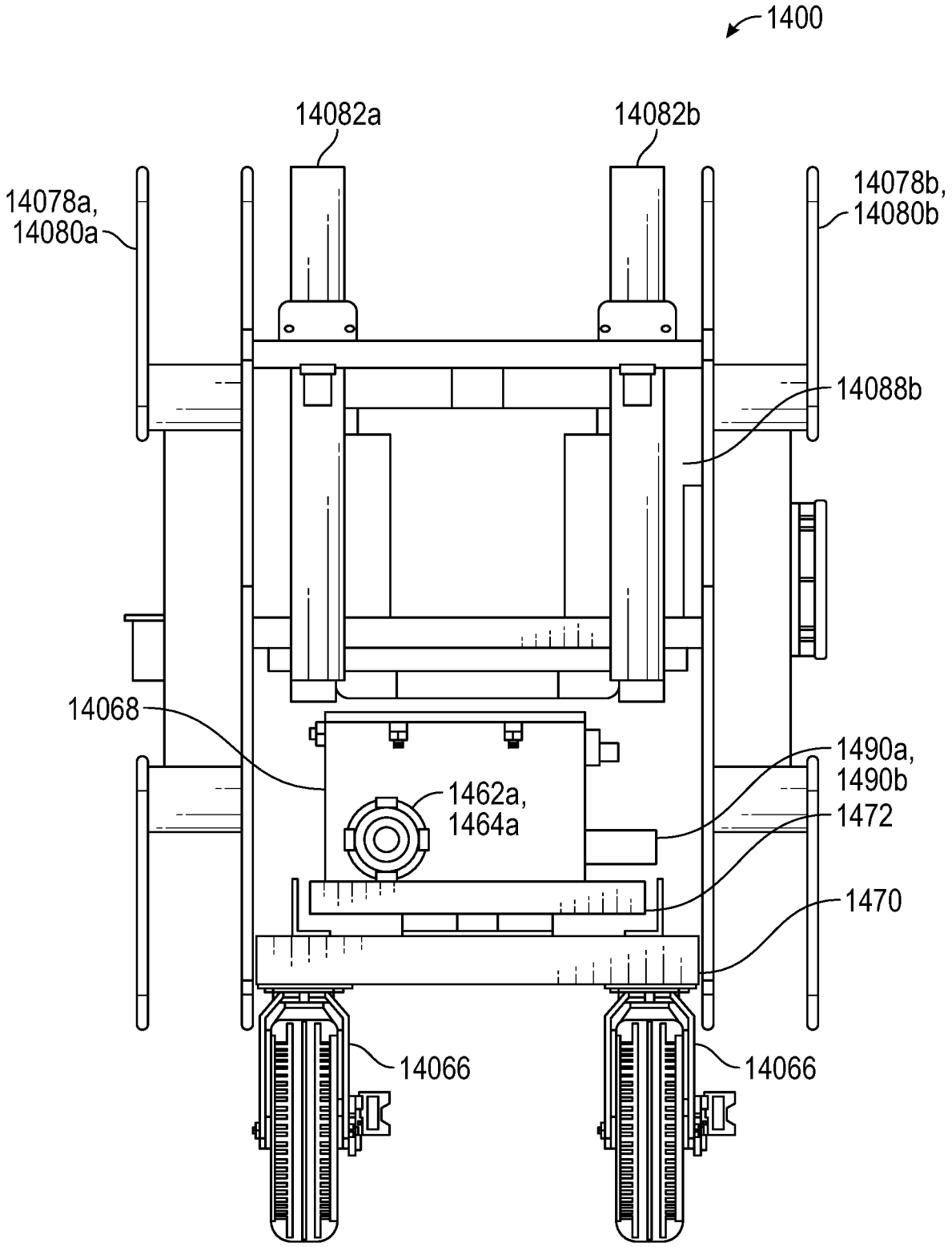
FIG. 14B illustrates a rear view of the alternative CARTT subassembly of FIG. 14A.
Figure 14C:
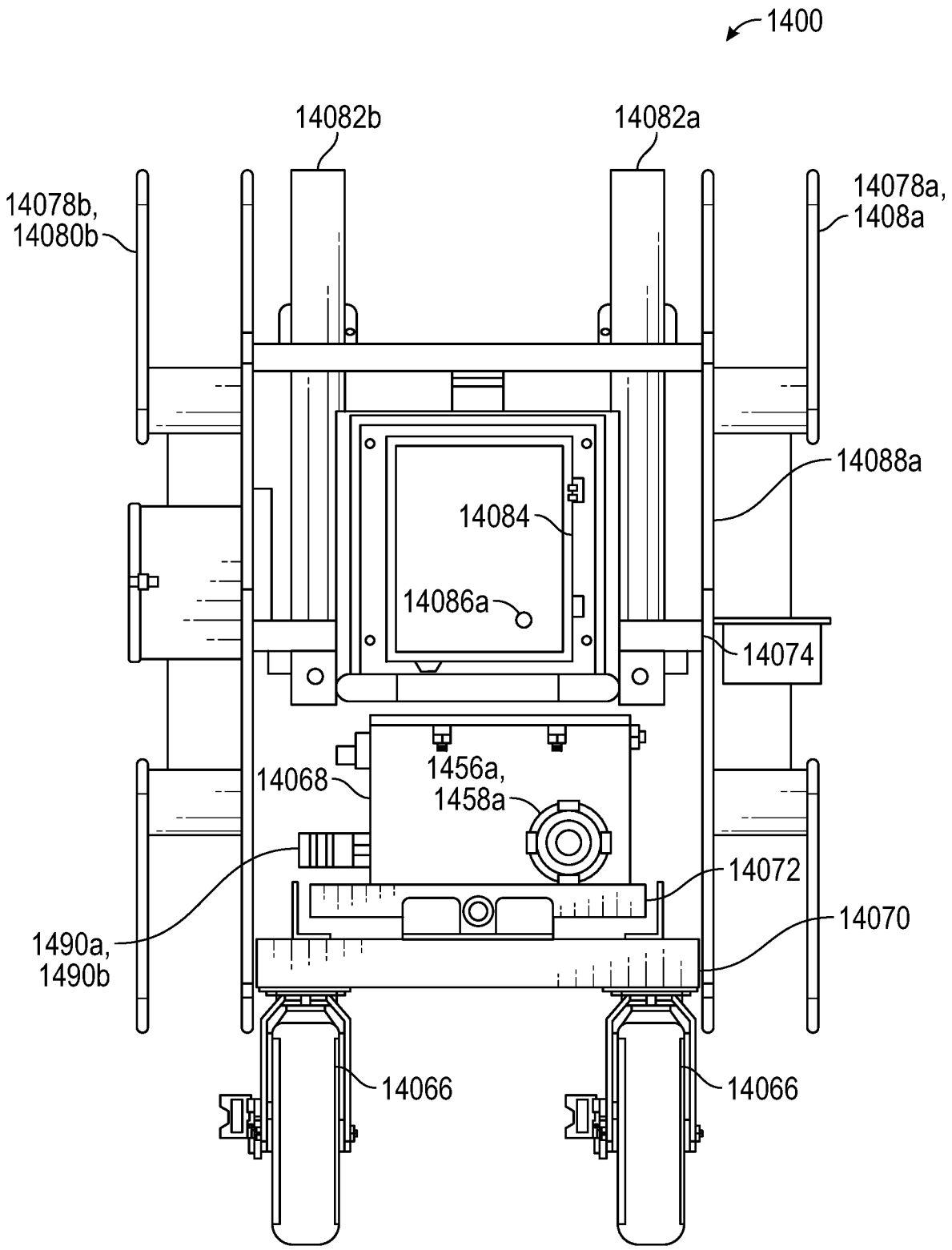
FIG. 14C illustrates a front view of the alternative CARTT subassembly of FIGS. 14A-14B.
Figure 14D:
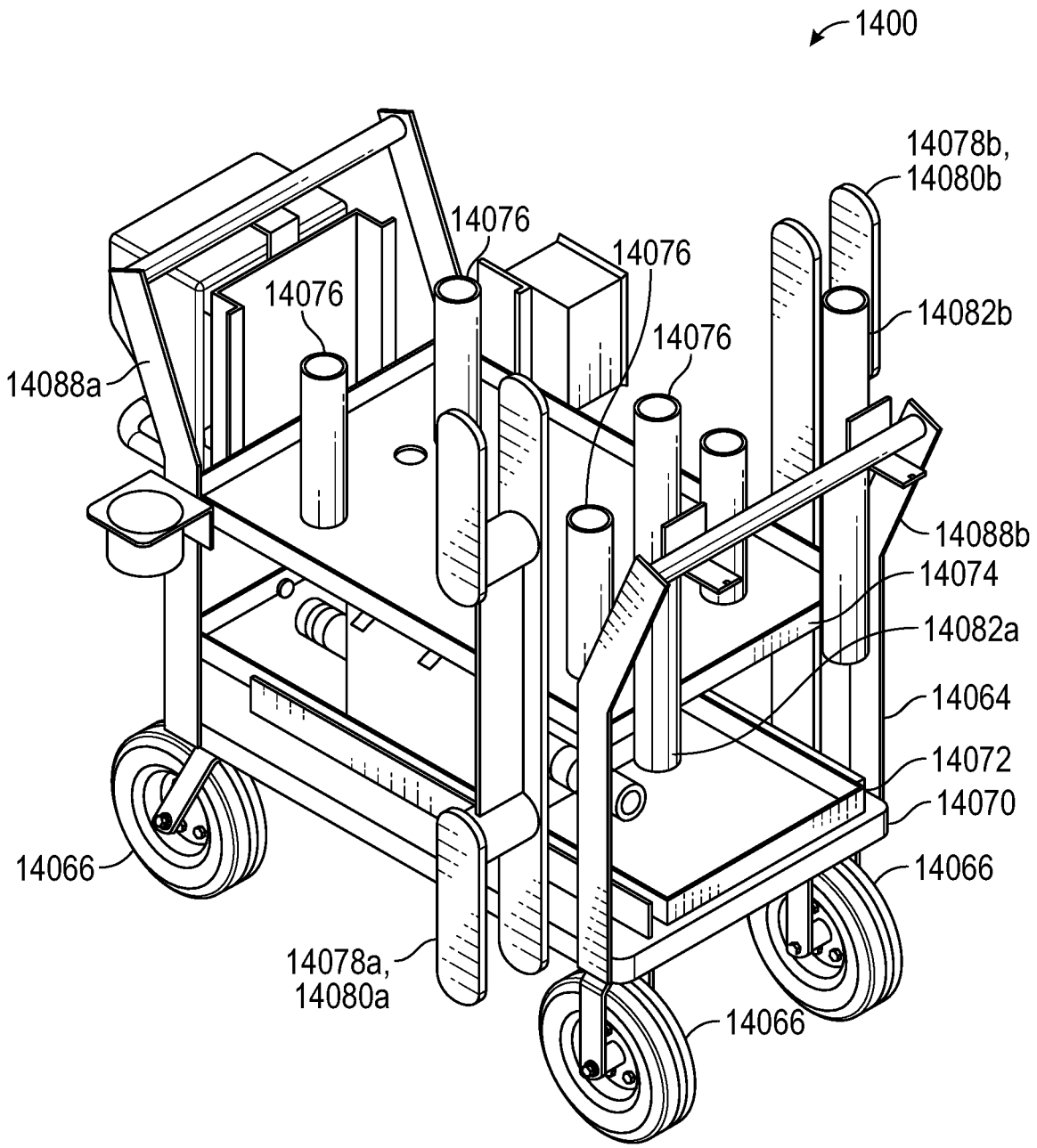
FIG. 14D illustrates a left, rear perspective view of the alternative CARTT subassembly of FIGS. 14A-14C.
Figure 14E:
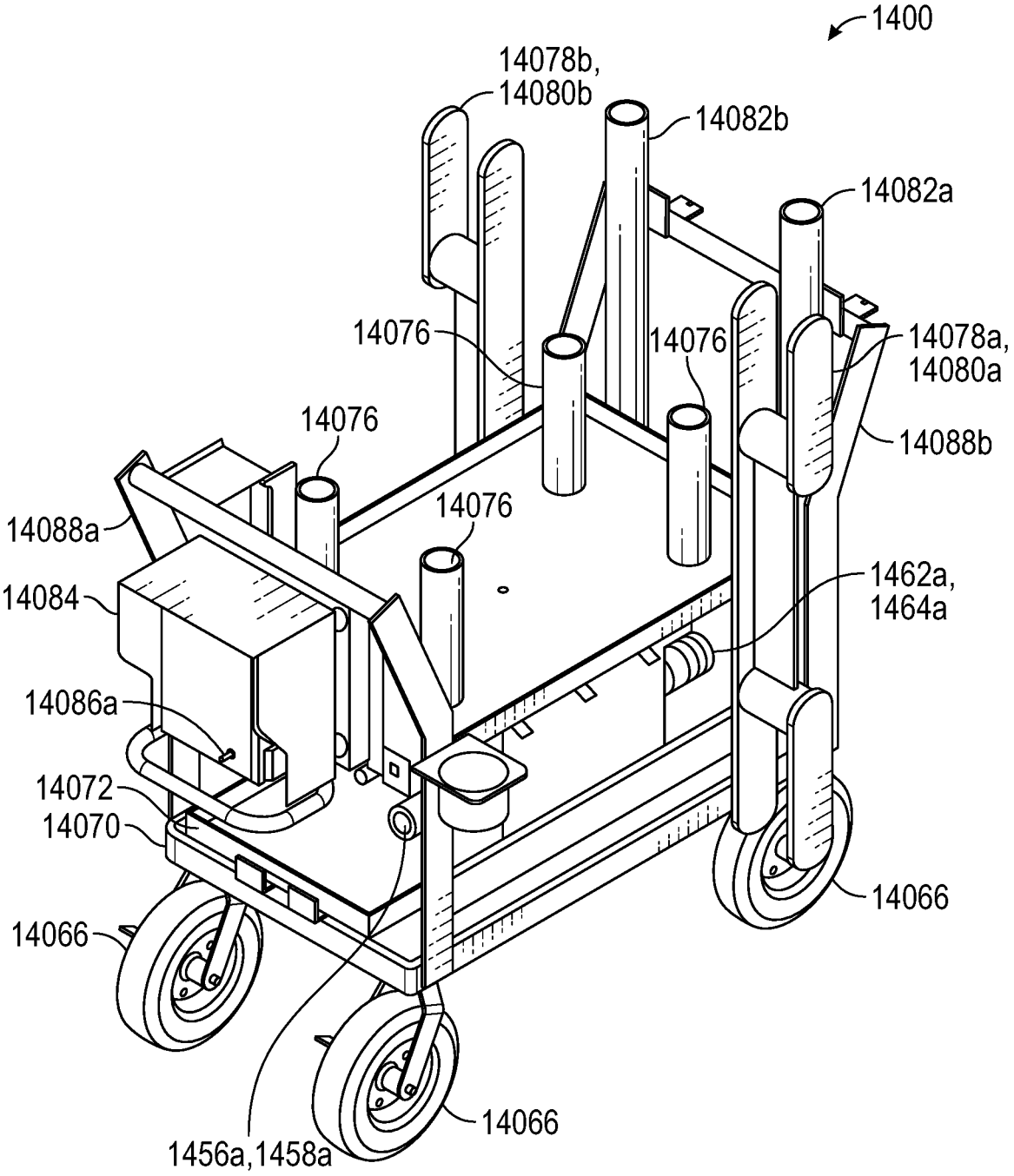
FIG. 14E illustrates a left, front perspective view of the alternative CARTT subassembly of FIGS. 14A-14D.
Figure 14F:
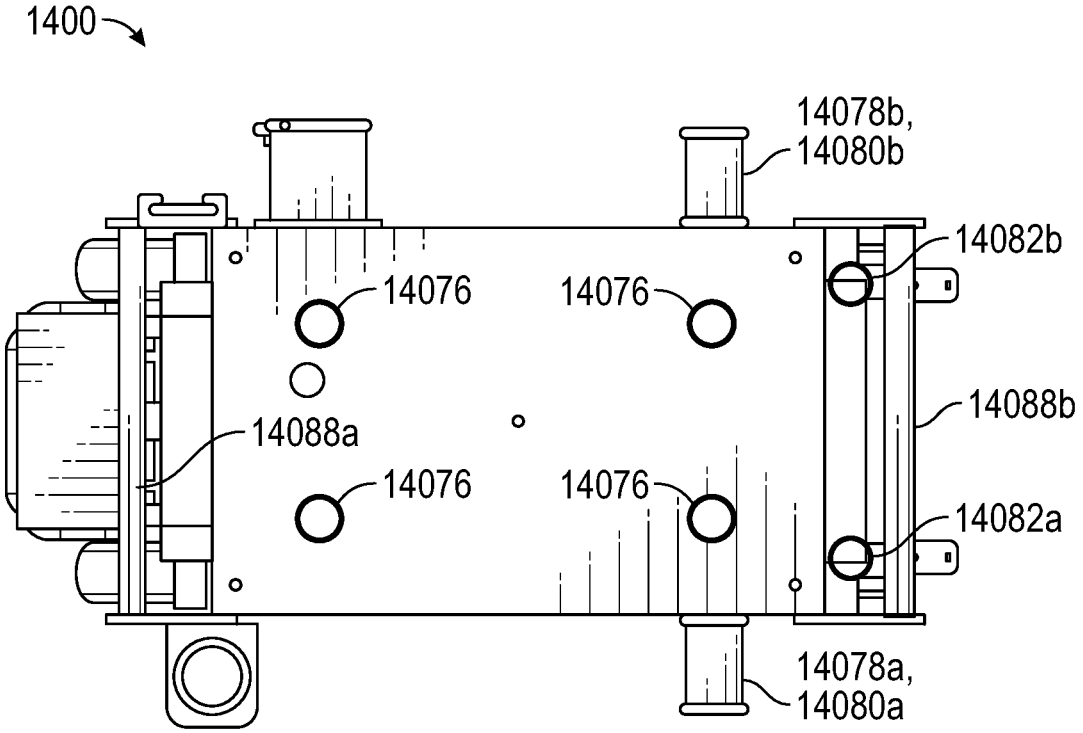
FIG. 14F is a top view of the alternative CARTT subassembly of FIGS. 14A-14E.

FIG. 14A illustrates a left side view of the alternative CARTT subassembly 1400 for a fuel control and distribution system; FIG. 14B illustrates a rear view of the alternative CARTT subassembly 1400 of FIG. 14A; FIG. 14C illustrates a front view of the alternative CARTT subassembly 1400 of FIGS. 14A-14B; FIG. 14D illustrates a left, rear perspective view of the alternative CARTT subassembly 1400 of FIGS. 14A-14C; FIG. 14E illustrates a left, front perspective view of the alternative CARTT subassembly 1400 of FIGS. 14A-14D; and FIG. 14F is a top view of the alternative CARTT subassembly 1400 of FIGS. 14A-14E.

As shown in FIGS. 5A-6B and FIGS. 14A-14F, the CARTT assembly 500, 600, 1400 may further comprise a cart subassembly 5064, 6064, 14064 having a plurality of wheels 5066, 14066 and a CARTT flow control box 5068, 14068.

The CARTT flow control box 5068, 14068 may be any suitable enclosure capable of containing an optional first and/or second CARTT check valve 172*a*, 172*b*, 372*a*, 372*b*, 1172*a*, 1172*b*, 1372*a*, 1372*b*, a first and/or second CARTT pressure regulator 174*a*, 174*b*, 374*a*, 374*b*, 1174*a*, 1174*b*, 1374*a*, 1374*b*, a first and/or second CARTT flow meter 176*a*, 176*b*, 376*a*, 376*b*, 1176*a*, 1176*b*, 1376*a*, 1376*b*, a first and/or second CARTT valve 178*a*, 178*b*, 378*a*, 378*b*, 1178*a*, 1178*b*, 1378*a*, 1378*b*, or any combination thereof. See e.g., FIGS. 1E, 3-4, 11E & 13.

In an embodiment, the flow control box 5068, 14068 comprises the first fuel CARTT fuel inlet 156*a*, 356*a*, 1156*a*, 1365*a*, the first CARTT fuel outlet 162*a*, 362*a*, 1162*a*, 1362*a*, the first CART tap line 190*a*, 390*a*, 1190*a*, 1390*a* and the second CARTT tap line 190*b*, 390*b*, 1190*b*, 1390*b*, as discussed above. See e.g., FIGS. 1E, 3-4, 11E & 13.

In an embodiment, the first CARTT tap line 190*a*, 390*a*, 1190*a*, 1390*a* may further comprise an optional first CARTT check valve 172*a*, 372*a*, 1172*a*, 1372*a*, a first CARTT pressure regulator 174*a*, 374*a*, 1174*a*, 1374*a*, a first CARTT flow meter 176*a*, 376*a*, 1176*a*, 1376*a*, a first CARTT valve 178*a*, 378*a*, 1178*a*, 1378*a*, or any combination thereof, as discussed above. See e.g., FIGS. 1E, 3-4, 11E & 13.

In an embodiment, the second CARTT tap line 190*b*, 390*b*, 1190*b*, 1390*b* may further comprise an optional second CARTT check valve 172*b*, 372*b*, 1190*b*, 1390*b*, a second CARTT pressure regulator 174*b*, 374*b*, 1174*b*, 1374*b*, a second CARTT flow meter 176*b*, 376*b*, 1176*b*, 1376*b*, a second CARTT valve 178*b*, 378*b*, 1178*b*, 1378*b*, or any combination thereof, as discussed above. See e.g., FIGS. 1E, 3-4, 11E & 13.

In an embodiment, the cart subassembly 5064, 6064, 14064 may further comprise a CARTT lower tray 5070, 6070, 14070, a CARTT spill tray 5072, 6072, 14072, a CARTT upper tray 5074, 6074, 14074, or any combination thereof.

The CARTT lower tray 5070, 6070, 14070 may be any suitable tray capable of catching any overflow from the CARTT spill tray 5072, 6072, 14072.

The CARTT spill tray 5072, 6072, 14072 may be any suitable tray capable of catching accidental fuel spills when connecting fuel lines to and/or disconnecting fuel lines from the cart subassembly 5064, 6064, 14064.

The CARTT upper tray 5074, 6074, 14074 may be any suitable tray capable of carrying the CARTT fuel line 168*a*, 368*a*, 568*a*, 1168*a*, 1368*a* when transporting the fuel control and distribution system 100, 200, 1100, 1200.

In an embodiment, the CARTT flow control box 5068, 14068 may be disposed in the CARTT lower tray 5070, 6070, 14070 and/or the CARTT spill tray 5072, 6072, 14072 to catch any accidental fuel spills when connecting and/or disconnecting fuel lines.

In an embodiment, the CARTT spill tray 5072, 6072, 14072 may be disposed above and/or in the CARTT lower tray 5070, 6070, 14072.

In an embodiment, the cart subassembly 5064, 6064, 14064 may further comprise a CARTT fuel line spool 5076, 6076, 14076.

The CARTT fuel line spool 5076, 6076, 14076 may be any suitable spool capable of carrying the CARTT fuel line 168*a*, 368*a*, 568*a*, 1168*a*, 1368*a* when transporting the fuel control and delivery system 100, 200, 1100, 1200.

In an embodiment, the CARTT fuel line spool 5076, 6076, 14076 may be attached to or part of the CARTT upper tray 5074, 6074, 14074. See e.g., FIGS. 5C-5D, 6B & 14D-14F.

In an embodiment, the CARTT fuel line 168*a*, 368*a*, 568*a*, 1168*a*, 1368*a* may be disposed around the CARTT fuel line spool 5076, 6076, 14076 during transport of the fuel control and distribution system 100, 200, 1100, 1200.

In an embodiment, the cart subassembly 5064, 6064, 14064 may further comprise a first CARTT tap line spool 5078*a*, 14078*a* and/or a second CARTT tap line spool 5078*b*, 14078*b*.

The first and second CARTT tap line spool 5078*a*, 5078*b*, 14078*a*, 14078*b* may be any suitable spool capable of carrying the first CARTT tap line 190*a*, 390*a*, 590*a*, 1190*a*, 1390*a* and/or second CARTT tap line 190*b*, 390*b*, 590*b*, 1190*b*, 1390*b*, respectively, during transport of the fuel control and distribution system 100, 200, 1100, 1200.

In an embodiment, the first CARTT tap line spool 5078*a*, 14078*a* and/or the second CARTT tap line spool 5078*b*, 14078*b* may be attached to or part of the CARTT lower tray 5070, 6070, 14070 and/or the CARTT upper tray 5074, 6074, 14074. See e.g., FIGS. 5C-5D, 6B & 14A-14F.

In an embodiment, the first CARTT tap line 190*a*, 390*a*, 590*a*, 1190*a*, 1390*a* may be disposed around the first CARTT tap line spool 5078*a*, 14078*a* during transport of the fuel control and distribution system 100, 200, 1100, 1200.

In an embodiment, the second CARTT tap line 190*b*, 390*b*, 590*b*, 1190*b*, 1390*b* may be disposed around the second CARTT tap line spool 5078*b*, 14078*b* during transport of the fuel control and distribution system 100, 200, 1100, 1200.

In an embodiment, the cart subassembly 5064, 6064, 14064 may further comprise a first CARTT communication and power cable spool 5080*a*, 14080*a* and/or a second CARTT communication and power cable spool 5080*b*, 14080*b*.

The first and second CARTT communication and power cable spool 5080*a*, 5080*b*, 14080*a*, 14080*b* may be any suitable spool capable of carrying the first CARTT communication and power cable 5060*a*, 14060*a* and/or the second CARTT communication and power cable 5060*b*, 14060*b* during transport of the fuel control and distribution system 100, 200, 1100, 1200.

In an embodiment, the first CARTT communication and power cable spool 5080*a*, 14080*a* and/or the second CARTT communication and power cable spool 5080*b*, 14080*b* may be attached to or part of the CARTT lower tray 5070, 6070, 14070 and/or the CARTT upper tray 5074, 6074, 14074. See e.g., FIGS. 5C-5D, 6B & 14A-14F.

In an embodiment, the first CARTT communication and power cable 5060*a*, 14060*a* a may be disposed around the first CARTT communication a power cable spool 5080*a*, 14080*a* during transport of the fuel control and distribution system 100, 200, 1100, 1200.

In an embodiment, the second CARTT communication and power cable 5060*b*, 14060*b* a may be disposed around the second CARTT communication a power cable spool 5080*b*, 14080*b* during transport of the fuel control and distribution system 100, 200, 1100, 1200.

In an embodiment, the cart subassembly 5064, 6064, 14064 may further comprise a first CARTT fuel cap storage tube 5082*a*, 6082*a*, 14082*a* and/or a second CARTT fuel cap storage tube 5082*b*, 6082*b*, 14082*b*.

The first and second fuel cap storage tube 5082*a*, 5082*b*, 6082*a*, 6082*b*, 14082*a*, 14082*b* may be any suitable storage tube capable of holding the first and/or second fuel cap 196*a*, 196*b*, 596*a*, 596*b*, 1196*a*, 1196*b* during transport of the fuel control and delivery system 100, 200, 1100, 1200.

In an embodiment, the first CARTT fuel cap storage tube 5082*a*, 6082*a*, 14082*a* and/or the second CARTT fuel cap storage tube 5082*b*, 6082*b*, 14082*b* may be attached to or part of the CARTT lower tray 5070, 6070, 14070 and/or the CARTT upper tray 5074, 6074, 14074. See e.g., FIGS. 5C-5D, 6B & 14A-14F.

In an embodiment, the first fuel cap 196*a*, 596*a*, 1196*a* a may be disposed in the first CARTT fuel cap storage tube 5082*a*, 6082*a*, 14082*a* during transport of the fuel control and distribution system 100, 200, 1100, 1200.

In an embodiment, the second fuel cap 196*b*, 596*b*, 1196*b* may be disposed in the second CARTT fuel cap storage tube 5082*b*, 6082*b*, 14082*b* during transport of the fuel control and distribution system 100, 200, 1100, 1200.

In an embodiment, the cart assembly 5064, 6064, 14064 may further comprise a local control box 5084, 14084 for the CARTT subassembly.

The local control box 5084, 14084 may be any suitable enclosure capable of containing a local control system (not shown).

The local control system may be any suitable computing device capable of controlling and/or monitoring a first CARTT pressure regulator 174*a*, 374*a*, 1174*a*, 1374*a*, a second CARTT pressure regulator 174*b*, 374*b*, 1174*b*, 1374*b*, a first CARTT flow meter 176*a*, 376*a*, 1176*a*, 1376*a*, a second CARTT flow meter 176*b*, 376*b*, 1176*b*, 1376*b*, a first CARTT valve 178*a*, 378*a*, 1178*a*, 1378*a* and a second CARTT valve 178*b*, 378*b*, 1178*b*, 1378*b*, as discussed below.

In an embodiment, the local control box 5084, 14084 comprises a first CARTT communication and/or power connector 5086*a*, 14086*a* and/or a second CARTT communication and/or power connector (not shown).

In an embodiment, the local control box 5084, 14084 may be attached to or part of the CARTT lower tray 5070, 6070, 14070 and/or the CARTT upper tray 5074, 6074, 14074. See e.g., FIGS. 5C-5D, 6B, 14A &14C-14F.

In an embodiment, the cart assembly 5064, 6064, 14064 may further comprise a first CARTT handle 5088*a*, 6088*a*, 140688*a* and/or second CARTT handle 5088*b*, 6088*b*, 14088*b*.

The first and second CARTT handle 5088*a*, 5088*b*, 6088*a*, 6088*b*, 14088*a*, 14088*b* may be any suitable handle capable of grasping and moving the CARTT by an operator.

Fuel Cap Subassembly

Figure 7A:
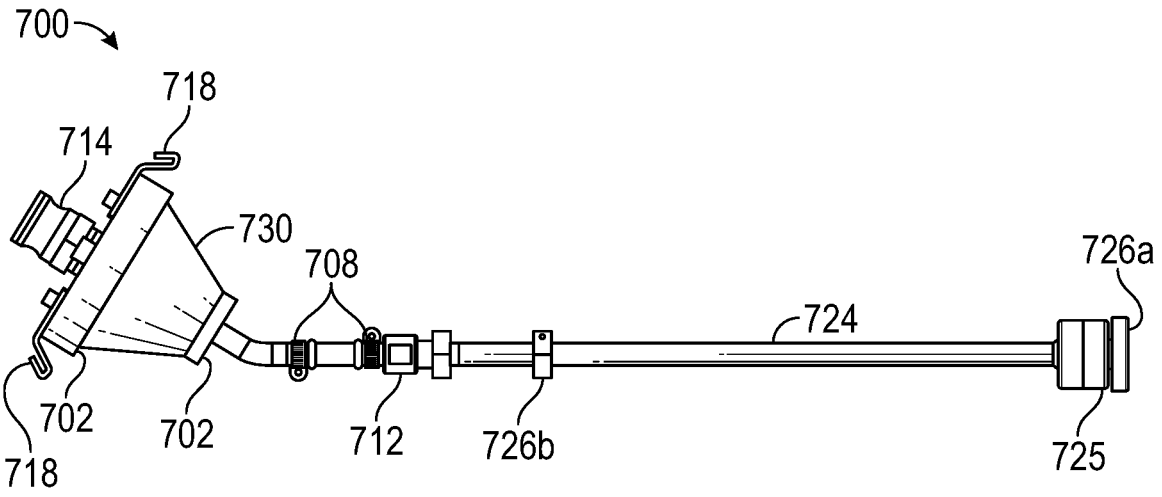
FIG. 7A illustrates a side view of a fuel cap subassembly for a fuel control and distribution system.
Figure 7B:
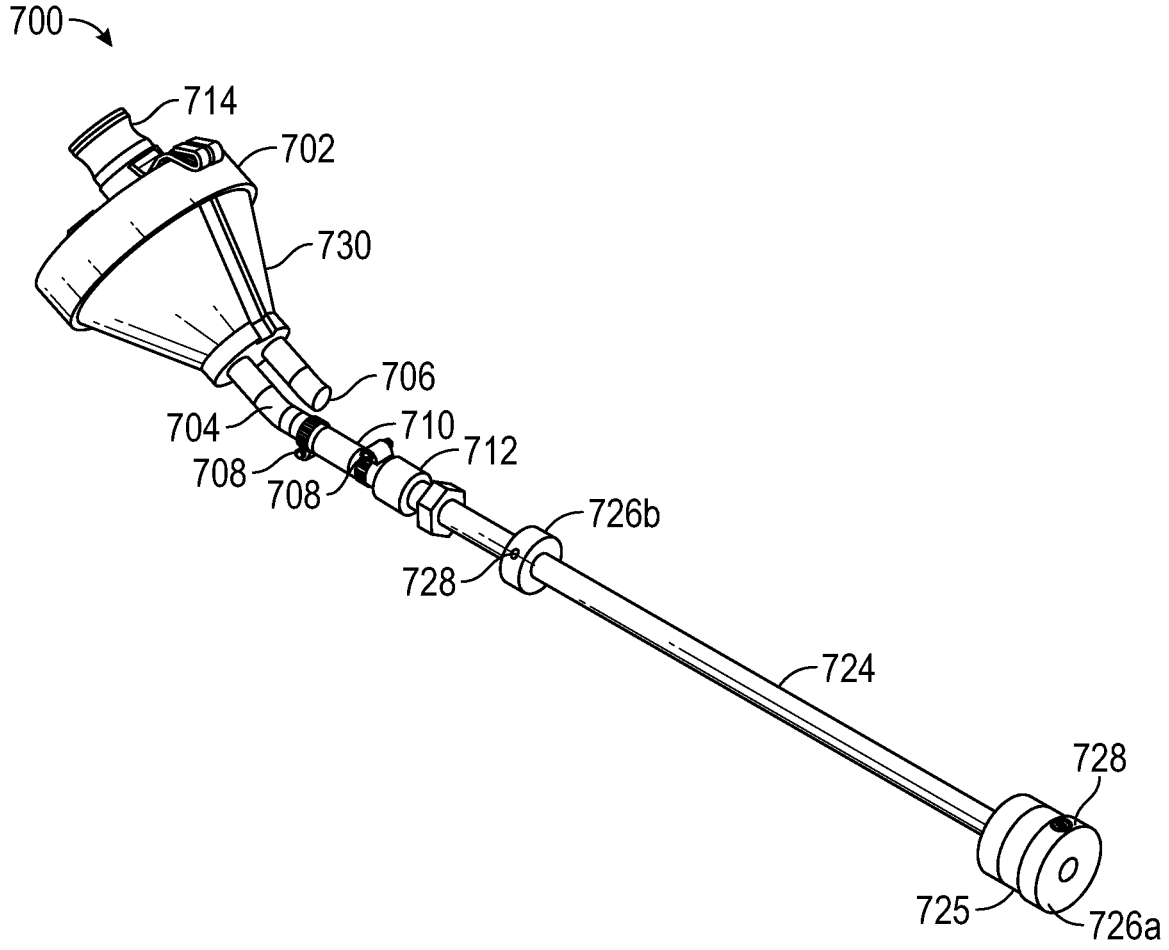
FIG. 7B illustrates a perspective view of the fuel cap subassembly in FIG. 7A.
Figure 7C:
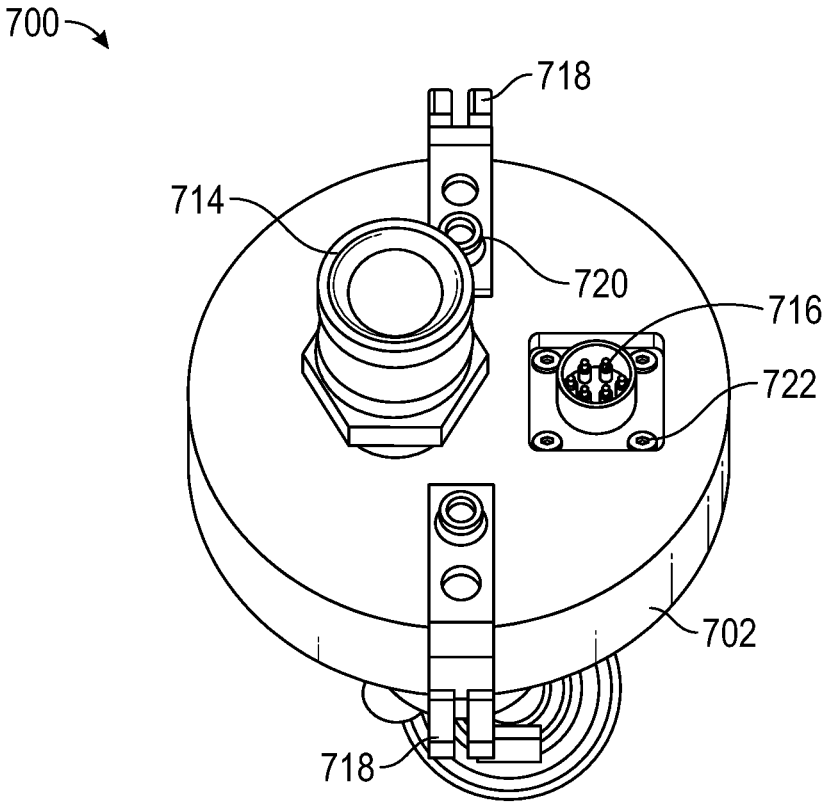
FIG. 7C illustrates a detailed view of the fuel cap subassembly in FIGS. 7A-7B.

FIG. 7A illustrates a side view of a fuel cap subassembly 700 for a fuel control and distribution system; FIG. 7B illustrates a perspective view of the fuel cap subassembly 700 in FIG. 7A; and FIG. 7C illustrates a detailed view of the fuel cap subassembly 700 in FIGS. 7A-7B.

Figure 8:
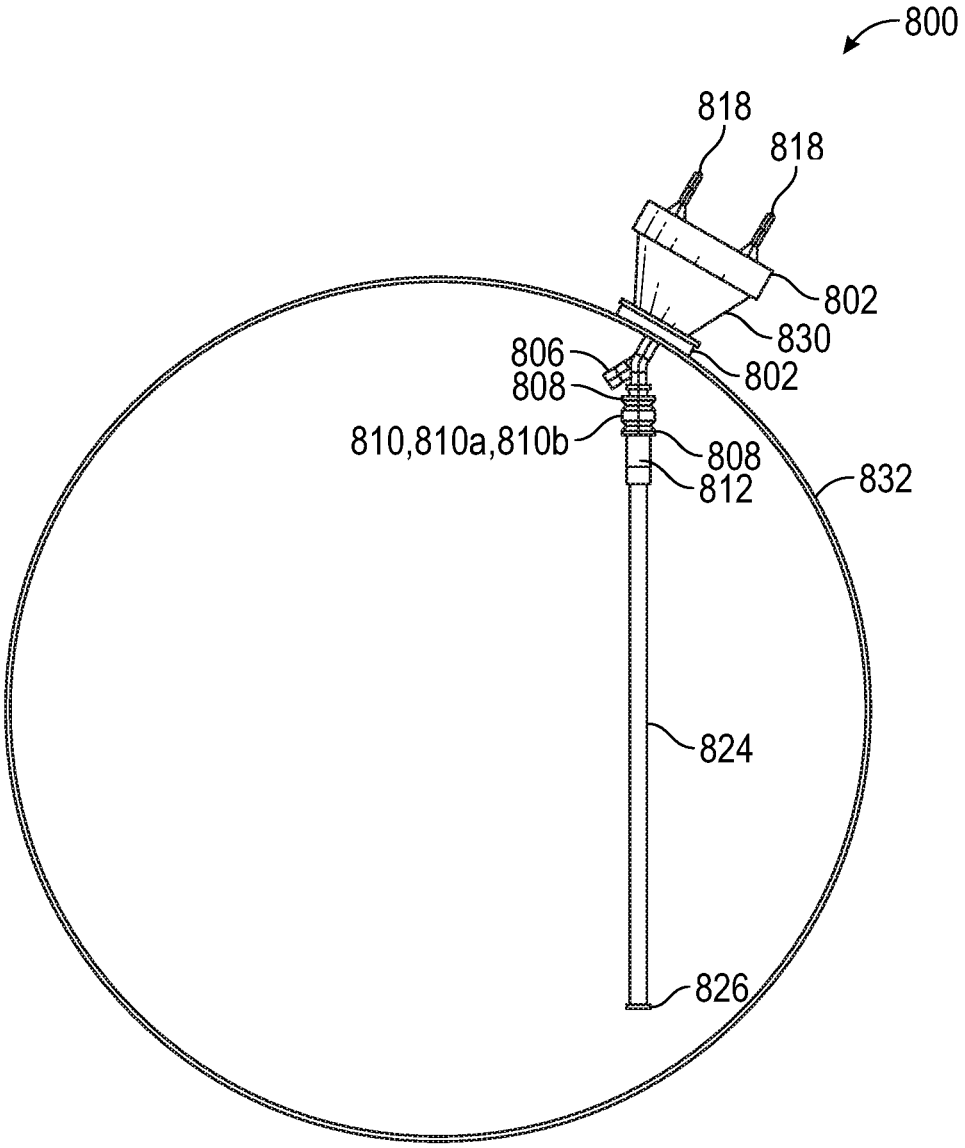
FIG. 8 illustrates a cut-away side view of a fuel cap subassembly for a fuel control and distribution system, showing the fuel cap subassembly installed in an equipment fuel tank.

FIG. 8 illustrates a cut-away side view of a fuel cap subassembly 800 for a fuel control and distribution system, showing the fuel cap subassembly 800 installed in an equipment fuel tank 830.

As shown in FIGS. 7A-7C and 8, the fuel cap subassembly 700, 800 comprises a fuel cap body 702, 802, a fuel cap outlet 706, 806, a fuel cap inlet 714, 814, a fuel cap connector 716, a fuel cap retention means 718, 818, and a fuel level sensor 724, 824 comprising a float 725, 825.

In an embodiment, the fuel cap subassembly 700, 800 comprises a fuel cap body 702, 802 having a fuel cap inlet 714, 814, a fuel cap outlet 706, 806, wherein the fuel cap body 702, 802 is adapted to mate with and seal to a first equipment tank, and wherein the fuel inlet is adapted to be connected to a first tap line and the fuel cap outlet 706, 806 is adapted to be disposed inside the first equipment tank, a fuel level sensor 724, 824, wherein the fuel level sensor 724, 824 is adapted to be disposed inside the first equipment tank, a fuel cap retention means 718, 818, wherein the fuel cap retention means 718, 818 is removably attaches the fuel cap body 702, 802 to the first equipment tank.

The fuel cap body 702, 802 may be any suitable fuel cap body capable of mating with and sealing to an equipment fuel tank inlet.

The fuel cap body 702, 802 may be any suitable shape. For example, a suitable shape includes, but is not limited to, a conical shape, a cylinder shape, a hemispherical shape, a truncated cone shape (i.e., cup shaped), or any combination thereof. In an embodiment, the fuel cap body 702, 802 may be a cone shape. In an embodiment, the fuel cap body 702, 802 may be a cylinder shape. In an embodiment, the fuel cap body 702, 802 may be a truncated cone shape (i.e., cup shape). In an embodiment, the fuel cap body 702, 802 may be a truncated cone shape (i.e., cup shape) with a cylinder shape on each end.

The fuel cap body 702, 802 may be made of any suitable material. For example, a suitable material includes, but is not limited to, an elastomer, a metal, a plastic, or any combination thereof. The elastomer may be any suitable elastomer. For example, a suitable elastomer includes, but is not limited to, a fluoroelastomer, a nitrile elastomer, a rubber, or any combination thereof. The metal may be any suitable metal. For example, a suitable metal includes, but is not limited to, alloy steel, aluminum, brass, copper, or any combination thereof. The plastic may be any suitable plastic. For example, a suitable plastic includes, but is not limited to, copolymers, polymers, or any combination thereof. In an embodiment, the fuel cap body 702, 803 may be made of a rubber. In an embodiment, the fuel cap body 702, 802 may be made of brass. In an embodiment, the fuel cap body 702, 802 may be made of Teflon.

The fuel cap body 702, 802 may further comprises a gasket.

The gasket may be any suitable shape to fit the fuel cap body. For example, a suitable shape includes, but is not limited to, an open conical shape, an open cylinder shape, an open hemispherical shape, an open truncated cone shape (i.e., cup shaped), or any combination thereof. In an embodiment, the gasket may be an open cone shape. In an embodiment, the gasket may be an open cylinder shape. In an embodiment, the gasket may be an open truncated cone shape (i.e., cup shape).

The gasket may be made of any suitable material. For example, a suitable material includes, but is not limited to, an elastomer, a plastic, or any combination thereof. The elastomer may be any suitable elastomer. For example, a suitable elastomer includes, but is not limited to, a fluoroelastomer, a nitrile elastomer, a rubber, or any combination thereof. The plastic may be any suitable plastic. For example, a suitable plastic includes, but is not limited to, copolymers, polymers, or any combination thereof. In an embodiment, the gasket may be made of a rubber.

The fuel cap outlet 706, 806 may be any suitable fuel outlet attached to or part of the fuel cap. For example, a suitable fuel cap outlet 706, 806, includes, but is not limited to a fuel port in the fuel cap, a fuel conduit connected to the fuel cap, an adapter connected to the fuel cap, or any combination thereof. In an embodiment, the fuel cap outlet 706, 806 may be a fuel port in the fuel cap. In an embodiment, the fuel cap outlet 706, 806 may be an adapter connected to the fuel cap. In an embodiment, the fuel cap outlet 706, 806 may be a fuel conduit connected to the fuel cap.

The fuel cap inlet 714, 814 may be any suitable fuel inlet attached to or part of the fuel cap. For example, a suitable fuel cap inlet 714, 814 includes, but is not limited to a fuel port in the fuel cap, an adapter connected to the fuel cap, a camlock adapter connected to the fuel cap, a fuel conduit connected to the fuel cap, or any combination thereof. In an embodiment, the fuel cap inlet 714, 814 may be a fuel port in the fuel cap. In an embodiment, the fuel cap inlet 714, 814 may be an adapter connected to the fuel cap. In an embodiment, the fuel cap inlet 714, 814 may be a camlock adapter connected to the fuel cap. In an embodiment, the fuel cap inlet 714, 814 may be a fuel conduit connected to the fuel cap.

In an embodiment, the fuel level sensor 724, 824 may be electrically connected to the fuel cap connector 716. The fuel cap connector 716 may be any suitable connector. For example, a suitable fuel cap connector 716 includes, but is not limited to, a 6-pin connector, a 9-pin connector, a box-mount 6-pin connector, a box-mount 9-pin connector, or any combination thereof. In an embodiment, the fuel cap connector 716 may be a box-mount 6-pin connector. In an embodiment, the fuel cap connector 716 may be a box-mount 9-pin connector.

The fuel cap retention means 718, 818 may be any suitable retention means capable of securing the fuel cap to the equipment fuel tank. For example, a suitable fuel cap retention means 718, 818 includes, but is not limited to, a clip (see FIGS. 7A-7C) and a bungee cord, a clip (see FIGS. 7*a*-7C) and a strap, a hook (see FIG. 8) and a bungee cord, a hook (see FIG. 8) and a strap, or any combination thereof. In an embodiment, the fuel cap retention means 718, 818 comprises a clip affixed to the fuel cap and a strap capable of being attached to the clip and disposed around an equipment fuel tank. In an embodiment, the fuel cap retention means 718, 818 comprises a hook affixed to the fuel cap and a bungee cord capable of being attached to the hook and disposed around an equipment fuel tank.

The fuel level sensor 724, 824 may be any suitable fuel level sensor. For example, a suitable fuel level sensor 724, 824 includes, but is not limited to, a capacitance fuel level sensor, a float fuel level sensor, an optical fuel level sensor, an ultrasonic fuel level sensor, or any combination thereof. In an embodiment, the fuel level sensor 724, 824 may be a capacitance fuel level sensor. In an embodiment, the fuel level sensor 724, 824 may be a float fuel level sensor. In an embodiment, the fuel level sensor 724, 824 may be an optical fuel level sensor. In an embodiment, the fuel level sensor 724, 824 may be an ultrasonic fuel level sensor.

In an embodiment, the fuel cap 700, 800 may further comprise a fuel cap sensor conduit 704, 804. In an embodiment, the fuel level sensor 724, 824 may be electrically connected to the fuel cap connector 716 through the fuel cap sensor conduit 704, 804. The fuel cap sensor conduit 704, 804 may be any suitable sensor conduit capable of protecting electrical connections and/or wiring.

In an embodiment, the fuel cap 700, 800 further comprises a flex means 708. The flex means 708 may be any suitable flex means capable of allowing the fuel level sensor to assume a vertical position. For example, a suitable flex means 708 includes, but is not limited to, a hinge, a worm drive, or any combination thereof. In an embodiment, the flex means 708 may be a hinge. In an embodiment, the flex means 708 may be a worm drive.

In an embodiment, the fuel cap 700, 800 further comprises a flex means clamp 708*a*, 808*a*. The flex means clamp 708*a*, 808*a* may be a suitable clamp. For example, a suitable flex means clamp 708*a*, 808*a* includes, but is not limited to, a clamp, a hinge clamp, a worm drive clamp, a worm drive (SAE 8 clamp), or any combination thereof. In an embodiment, the flex means clamp 708*a*, 808*a* may be a clamp. In an embodiment, the flex means clamp may be a worm drive clamp 708*a*, 808*a*. In an embodiment, the flex means clamp may be a worm drive (SAE 8) clamp 708*a*, 808*a*.

In an embodiment, the fuel cap 700, 800 further comprises a flex means sleeve 710, 810. The flex means sleeve 710, 810 may be any suitable sleeve.

The flex means sleeve 710, 810 may be made of any suitable material. For example, a suitable material includes, but is not limited to, a metal, a plastic, or any combination thereof. The metal may be any suitable metal. For example, a suitable metal includes, but not limited to, alloy steels, aluminum, brass, copper, or any combination thereof. The plastic may be any suitable plastic. For example, a suitable plastic includes, but not limited to copolymers, polymers, or any combination thereof. In an embodiment, the flex means sleeve 710*a*, 810*a* may be made of stainless steel. In an embodiment, the flex means sleeve 710*b*, 810*b* may be made of Kevlar. In an embodiment, flex means sleeve 710, 810 may be made of Kevlar-covered stainless steel.

In an embodiment, the fuel cap 700, 800 further comprises a fuel cap adapter fitting 712, 812. In an embodiment, the fuel level sensor 724, 824, may be connected to the flex means 708 and/or sleeve 710 via the fuel cap adapter fitting 712, 812. The fuel cap adapter fitting 712, 812 may be any suitable adapter fitting.

In an embodiment, the fuel cap 700, 800 further comprises a cap screw 720. In an embodiment, the fuel cap retention means 717, 818 may be attached to the fuel cap body 702, 802 via the cap screw 720. The cap screw 720 may be any suitable screw. For example, a suitable cap screw 720 includes, but is not limited to, a Hex head cap screw, a pan Phillips head cap screw, a Phillips head cap screw, a slotted head cap crew, a socket head cap screw, or any combination thereof. In an embodiment, the cap screw 720 may be a socket head cap screw.

In an embodiment, the fuel cap 700, 800 further comprises a connector screw 722. In an embodiment, the fuel cap connector 716 may be attached to the fuel cap body 702, 802 via the connector screw 722. The connector screw 722 may be any suitable screw. For example, a suitable connector screw 722 includes, but is not limited to, a Hex head screw, a pan Phillips head screw, a Phillips head screw, a slotted head screw, a socket head screw, or any combination thereof. In an embodiment, the connector screw 722 may be a pan Phillips head screw 722.

In an embodiment, the fuel cap 700, 800 further comprises a lower set collar 726*a*, 826*a*. In an embodiment, the lower set collar 726*a*, 826*a* may be disposed around a lower end of the fuel level sensor 724, 824. The fuel level sensor lower set collar 726*a*, 826*a* may be any suitable set collar capable of stopping the travel of the float 725 at a lower end of the fuel level sensor 724, 824.

In an embodiment, the fuel 700, 800 further comprises an upper set collar 726*b*, 826*b*. In an embodiment, the upper set collar 726*b*, 826*b* may be disposed around an upper end of the fuel level sensor 724, 824. The upper set collar 726*b*, 826*b* may be any suitable set collar capable of stopping the travel of the float 725 at an upper end of the fuel level sensor 724, 824.

In an embodiment, the fuel cap 700, 800 further comprises a set collar screw 728. In an embodiment, the lower set collar 726*a*, 826*a* may be disposed around the lower end of the fuel level sensor 724, 824 and attached to the fuel level sensor 724, 824 via the set collar screw. In an embodiment, the upper set collar 726*b*, 826*b* may be disposed around the upper end of the fuel level sensor 724, 824 and attached to the fuel level sensor 724, 824 via the set collar screw 728. The set collar screw 728 may be any suitable screw. For example, a suitable set collar screw 728 includes, but is not limited to, a Hex head screw, a pan Phillips head screw, a Phillips head screw, a slotted head screw, a socket head screw, or any combination thereof. In an embodiment, the set collar screw 728 may be a Hex head screw 728.

In an embodiment, the fuel cap 700, 800 further comprises a fuel cap body sleeve 730. The fuel cap body sleeve 730, 830 may be any suitable fuel cap body sleeve.

The fuel cap body sleeve 730, 830 may be any suitable shape compatible with the fuel cap body. For example, a suitable shape includes, but is not limited to, a conical shape, a cylinder shape, a hemispherical shape a truncated cone shape (i.e., cup shaped), or any combination thereof. In an embodiment, the fuel cap body sleeve 730, 830 may be a cone shape. In an embodiment, the fuel cap body sleeve 730, 830 may be a cylinder shape. In an embodiment, the fuel cap body sleeve 730, 830 may be a truncated cone shape (i.e., cup shape).

The fuel cap body sleeve 730, 830 may be any suitable material. For example, a suitable material includes, but is not limited to, an elastomer, a metal, a plastic, or any combination thereof. The elastomer may be any suitable elastomer. For example, a suitable elastomer includes, but not limited to a fluoroelastomer, a nitrile elastomer, a rubber, or any combination thereof. The metal may be any suitable metal. For example, a suitable metal includes, but is not limited to, alloy steel, aluminum, brass, copper, or any combination thereof. The plastic may be any suitable plastic. For example, a suitable plastic includes, but is not limited to, copolymers, polymers, or any combination thereof. In an embodiment, the fuel cap body sleeve 730, 830 may be made of rubber. In an embodiment, the fuel cap body sleeve 730, 830 may be made of brass. In an embodiment, the fuel cap body sleeve 730, 830 may be made of Teflon.

Control System/Computing Device for System

Figure 9:
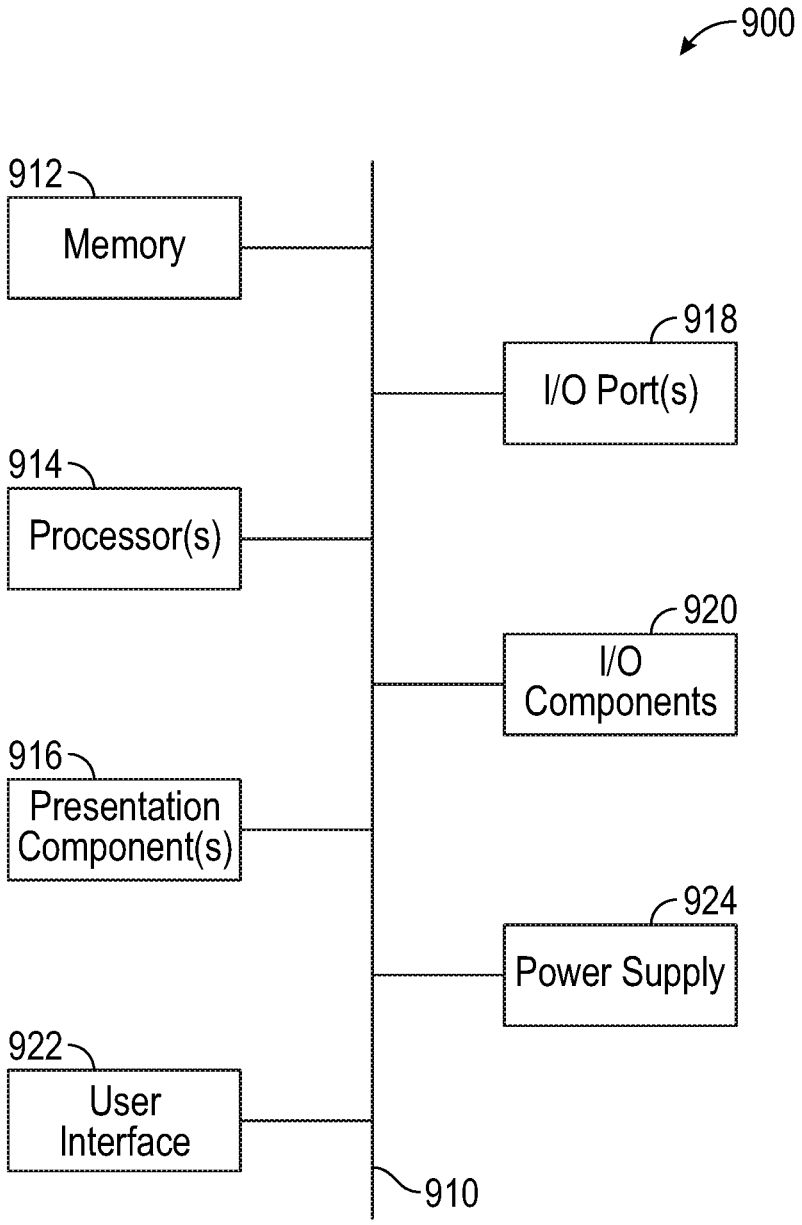
FIG. 9 illustrates a schematic of a computing device for a fuel control and distribution system.

FIG. 9 illustrates a schematic of a computing device for a fuel control and distribution system. Referring to the drawings in general, and initially to FIGS. 1A-1E and 9 in particular, an exemplary operating environment for implementing embodiments of the present invention is shown and designated generally as a computing device 900 for the fuel control and distribution system. The computing device 900 is but one example of a suitable computing environment and is not intended to suggest any limitation as to the scope of use or functionality of the invention. Neither should the computing device 900 be interpreted as having any dependency or requirement relating to any one or combination of components illustrated.

With continued reference to FIG. 9, the computing device 900 of the fuel control and distribution system includes a bus 910 that directly or indirectly couples the following devices: memory 912, one or more processors 914, one or more presentation components 916, one or more input/output (I/O) ports 918, I/O components 920, a user interface 922 and an illustrative power supply 924. The bus 910 represents what may be one or more busses (such as an address bus, data bus, or combination thereof). Although the various blocks of FIG. 9 are shown with lines for the sake of clarity, in reality, delineating various components is not so clear, and metaphorically, the lines would more accurately be fuzzy. For example, one may consider a presentation component such as a display device to be an I/O component. Additionally, many processors have memory. The inventors recognize that such is the nature of the art, and reiterate that the diagram of FIG. 9 is merely illustrative of an exemplary computing device that can be used in connection with one or more embodiments of the present invention. Further, a distinction is not made between such categories as "workstation," "server," "laptop," "mobile device," etc., as all are contemplated within the scope of FIG. 9 and reference to "computing device."

The computing device 900 of the fuel control and distribution system typically includes a variety of computer-readable media. Computer-readable media can be any available media that can be accessed by the computing device 900 and includes both volatile and nonvolatile media, removable and non-removable media. By way of example, and not limitation, computer-readable media may comprise computer-storage media and communication media. The computer-storage media includes volatile and nonvolatile, removable and non-removable media implemented in any method or technology for storage of information such as computer-readable instructions, data structures, program modules or other data. Computer-storage media includes, but is not limited to, Random Access Memory (RAM), Read Only Memory (ROM), Electronically Erasable Programmable Read Only Memory (EEPROM), flash memory or other memory technology, CD-ROM, digital versatile disks (DVD) or other holographic memory, magnetic cassettes, magnetic tape, magnetic disk storage or other magnetic storage devices, or any other medium that can be used to encode desired information and which can be accessed by the computing device 900.

The memory 912 includes computer-storage media in the form of volatile and/or nonvolatile memory. The memory 912 may be removable, non-removable, or a combination thereof. Suitable hardware devices include solid-state memory, hard drives, optical-disc drives, etc. The computing device 900 of the fuel control and delivery system includes one or more processors 914 that read data from various entities such as the memory 912 or the I/O components 920.

The presentation component(s) 916 present data indications to a user or other device. In an embodiment, the computing device 900 outputs present data indications including separation rate, temperature, pressure and/or the like to a presentation component 916. Suitable presentation components 916 include a display device, speaker, printing component, vibrating component, and the like.

The user interface 922 allows the user to input/output information to/from the computing device 900. Suitable user interfaces 922 include keyboards, key pads, touch pads, graphical touch screens, and the like. For example, the user may input a type of signal profile into the computing device 900 or output a separation rate to the presentation component 916 such as a display. In some embodiments, the user interface 922 may be combined with the presentation component 916, such as a display and a graphical touch screen. In some embodiments, the user interface 922 may be a portable hand-held device. The use of such devices is well-known in the art.

The one or more I/O ports 918 allow the computing device 900 to be logically coupled to other devices including an optional first pump inlet shut-off valve 118*a*, an optional second pump inlet shut-off valve 118*b*, an optional third pump inlet shut-off valve 118*c*, an optional first pump outlet shut-off valve 122*a*, an optional second pump outlet shut-off valve 122*b*, an optional third pump outlet shut-off valve 122*c*, a first pressure regulator 136*a*, a second pressure regulator 136*b*, a first flow meter 140*a*, a second flow meter 140*b*, a first CARTT pressure regulator 174*a*, a second CARTT pressure regulator 174*b*, a first CARTT flow meter 176*a*, a second CARTT flow meter 176*b*, a first CARTT valve 178*a*, and a second CARTT valve 178*b*, and other I/O components 920, some of which may be built in. Examples of other I/O components 920 include a printer, scanner, wireless device, and the like.

Method of Using the Fuel Control and Distribution System

Figure 10A:
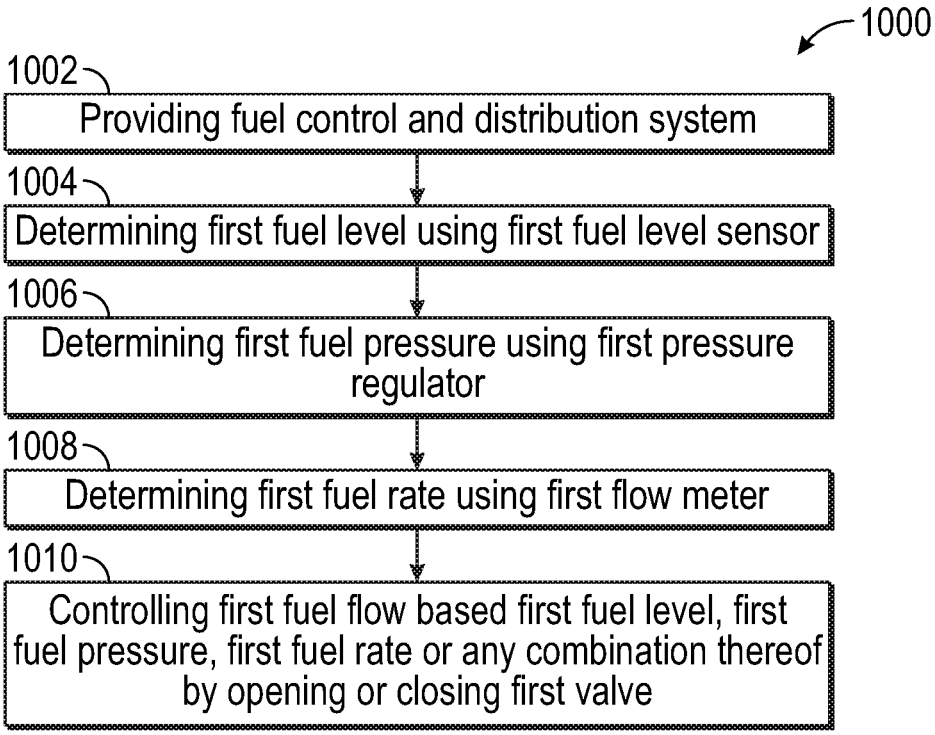
FIG. 10A is a flow diagram of a method of using the fuel control and distribution system.
Figure 10B:
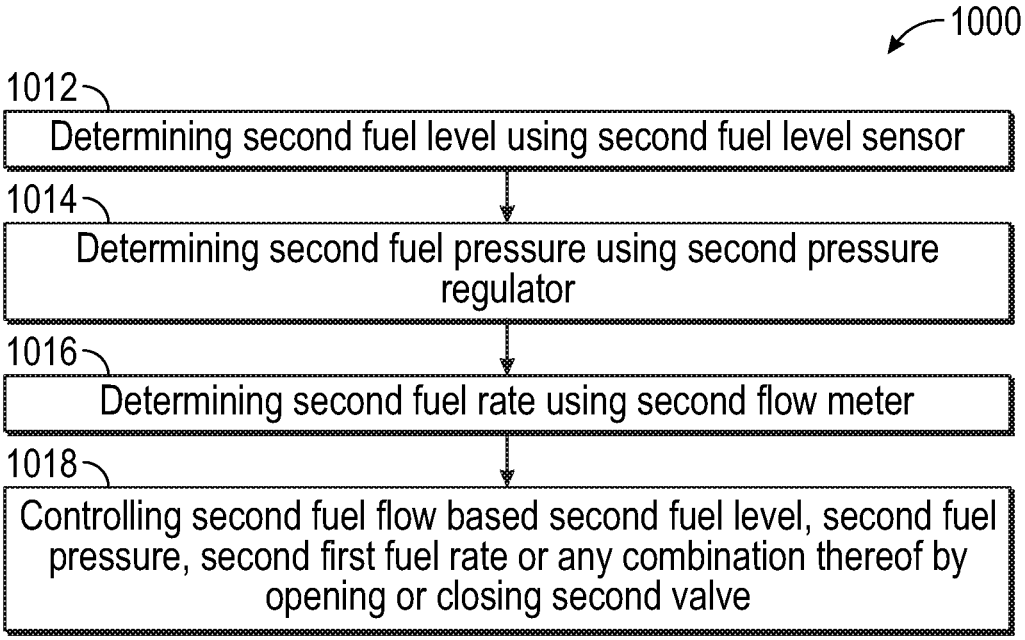
FIG. 10B is a flow diagram for the method in FIG. 10A, showing optional steps.

FIG. 10A is a flow diagram of a method of using the fuel control and distribution system 1000; and FIG. 10B is a flow diagram for the method 1000 in FIG. 10A, showing optional steps As shown in FIG. 10A, the method 1000 comprises providing the fuel control and distribution system as discussed herein 1002, determining a first fuel level using the first fuel level sensor 1004, determining a first fuel pressure using the first pressure regulator 1006, determining a first fuel rate using the first flow meter 1008, and controlling a first fuel flow based the first fuel level, the first fuel pressure, the first fuel rate or any combination thereof by opening or closing the first valve.

In an embodiment, the method 1000 further comprises selecting a first predetermined fuel level, and controlling the first fuel flow based the first fuel level, the first fuel pressure, the first fuel rate, the first predetermined fuel level or any combination thereof by opening or closing the first valve.

In an embodiment, the method 1000 further comprises determining a first time (related to the first fuel flow) using a first timer, and controlling the first fuel flow based the first fuel level, the first fuel pressure, the first fuel rate, the first time or any combination thereof by opening or closing the first valve.

As shown in FIG. 10B, the method 1000 further comprises determining a second fuel level using a second fuel level sensor 1012, determining a second fuel pressure using a second pressure regulator 1014, determining a second fuel rate using a second flow meter 1016, and controlling a second fuel flow based the second fuel level, the second fuel pressure, the second fuel rate or any combination thereof by opening or closing a second valve 1018.

In an embodiment, the method 1000 further comprises selecting a second predetermined fuel level, and controlling the second fuel flow based the second fuel level, the second fuel pressure, the second fuel rate, the second predetermined fuel level or any combination thereof by opening or closing the second valve.

In an embodiment, the method 1000 further comprises determining a second time (related to the second fuel flow) using a second timer, and controlling the second fuel flow based the second fuel level, the second fuel pressure, the second fuel rate, the second time or any combination thereof by opening or closing the second valve.

In an embodiment, the first valve may be operated independently to shut off the first fuel flow at any time. In an embodiment, the second valve may be operated independently to shut off the second fuel flow at any time.

In an embodiment, the first valve may be shut off when the first fuel level reaches a first predetermined level. In an embodiment, the second valve may be shut off when the second fuel level reaches a second predetermined level.

In an embodiment, the first pressure regulator and/or the first flow meter may regulate the first fuel rate. In an embodiment, the second pressure regulator and/or the second flow meter may regulate the second fuel rate.

The embodiments and examples set forth herein are presented to best explain the present invention and its practical application and to thereby enable those skilled in the art to make and utilize the invention. However, those skilled in the art will recognize that the foregoing description and examples have been presented for the purpose of illustration and example only. The description as set forth is not intended to be exhaustive or to limit the invention to the precise form disclosed. Many modifications and variations are possible in light of the above teaching without departing from the spirit and scope of the following claims. The invention is specifically intended to be as broad as the claims below and their equivalents.

DEFINITIONS

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor.

Combinations of the above are also included within the scope of machine-readable media. Machine-executable instructions include, for example, instructions and data which cause a general purpose computer, special purpose computer, or special purpose processing machines to perform a certain function or group of functions.

It is important to note that the construction and arrangement of the fuel control and distribution system is shown in the various exemplary embodiments is illustrative only. Additionally, any element disclosed in one embodiment may be incorporated or utilized with any other embodiment disclosed herein

INCORPORATION BY REFERENCE

All patents and patent applications, articles, reports, and other documents cited herein are incorporated by reference to the extent they are not inconsistent with the technology described in this application. To the extent that any meaning or definition of a term in this written document conflicts with any meaning or definition of the term in a document incorporated by reference, the meaning or definition assigned to the term in this written document shall govern.

What is claimed is:

1. A fuel control and distribution system, the system comprising:

a fuel source having an outlet;

a fuel line having an inlet and an outlet, wherein the outlet of the fuel source is fluidly connected to the inlet to the fuel line;

a fuel pump having an inlet and an outlet, wherein the outlet of the fuel line is fluidly connected to the inlet of the fuel pump;

a main fuel line having an inlet and an outlet, wherein the main fuel line comprises a pressure regulator and a flow meter and wherein the outlet of the fuel pump is fluidly connected to the inlet to the main fuel line;

a first remote transport truck having an inlet, a first outlet and a second outlet, wherein the first remote transport truck comprises a first remote transport truck fuel line having an inlet and an outlet, wherein the outlet of the main fuel line is fluidly connected to the inlet of the first remote transport truck and wherein the inlet of the first remote transport truck fuel line is fluidly connected to the first outlet of the first remote transport truck;

a first tap line having an inlet and an outlet, wherein the first tap line comprises, a first pressure regulator, a first flow meter, and a first valve, wherein the second outlet of the first remote transport truck is fluidly connected to the inlet of the first tap line; and a first fuel cap having an inlet and an outlet, wherein the first fuel cap comprises a first fuel level sensor, wherein the outlet of the first tap line is fluidly connected to the inlet of the first fuel cap and wherein the first fuel cap is adapted to be removably attached to a first equipment fuel tank.

2. The system of claim 1, wherein the fuel source is a fuel tanker.

3. The system of claim 1, wherein the fuel source is an ISO tank.

4. The system of claim 1, wherein the fuel pump is a centrifugal pump, a dynamic pump, a positive displacement pump, a reciprocating pump, a rotary pump, or any combination thereof.

5. The system of claim 1, wherein the pressure regulator is capable of controlling fuel pressure from about 18 to about 20 psi.

6. The claim of claim 1, wherein the flow meter is a differential pressure flow meter, a mass flow meter, an open-channel flow meter, a positive displacement flow meter, a velocity flow meter, or any combination thereof.

7. The system of claim 1, wherein the first flow meter is a differential pressure meter, a mass flow meter, an open-channel flow meter, a positive displacement flow meter, a velocity flow meter, or any combination thereof.

8. The system of claim 1, wherein the first fuel level sensor is a capacitance fuel level sensor, a float fuel level sensor, an optical fuel level sensor, an ultrasonic fuel level sensor, or any combination thereof.

9. The system of claim 1, wherein the first valve is a shut-off valve, a zero-drip connector, or any combination thereof.

10. The system of claim 1 further comprising:
a first flow control box comprising:
the inlet of the first remote transport truck;
the first outlet of the first remote transport truck;
the second outlet of the first remote transport truck;
the first pressure regulator;
the first flow meter; and
the first valve.

11. The system of claim 1 further comprising:
a trailer comprising:
a pump and spool shelter comprising:
the fuel pump;
a spool, wherein an outlet of the fuel pump is fluidly connected to an inlet to the spool and an outlet to the spool is connected to the inlet of the main fuel line.

12. The system of claim 1, wherein the first tap line further comprises a first check valve.

13. The system of claim 1, wherein the main fuel line further comprises a fuel filter and a pop-off pump gauge, and wherein the fuel filter is a bowl-type fuel filter, a cartridge-type fuel filter, a coalescence-type fuel filter, or any combination thereof.

14. The system of claim 13, wherein the fuel filter is a coalescence-type fuel filter.

15. The system of claim 1 further comprising a spool, wherein an outlet of the fuel pump is fluidly connected to an inlet to the spool and an outlet to the spool is connected to the inlet of the main fuel line.

16. The system of claim 15, wherein the spool is capable of spooling the main fuel line.

17. A method for using a fuel control and distribution system, the method comprising:
providing the fuel control and distribution system of claim 1;
determining a first fuel level using the first fuel level sensor;
determining a first fuel pressure using the first pressure regulator;
determining a first fuel rate using the first flow meter; and
controlling a first fuel flow based the first fuel level, the first fuel pressure, the first fuel rate or any combination thereof by opening or closing the first valve.

18. The method of claim 17 further comprising:
determining a second fuel level using a second fuel level sensor;
determining a second fuel pressure using a second pressure regulator;
determining a second fuel rate using a second flow meter; and
controlling a second fuel flow based the second fuel level, the second fuel pressure, the second fuel rate or any combination thereof by opening or closing the second valve.

19. The system of claim 1 further comprising:
a second remote transport truck having an inlet, a first outlet and a second outlet, wherein the first outlet of the first remote transport truck fuel line is fluidly connected to the inlet of the second remote transport truck;
a second tap line having an inlet and an outlet, wherein the second tap line comprises a second pressure regulator, a second flow meter and a second valve, wherein the second outlet to the second remote transport truck is fluidly connected to the inlet of the second tap line; and
a second fuel cap having an inlet and an outlet, wherein the second fuel cap comprises a second fuel level sensor, wherein the outlet of the second tap line is fluidly connected to the inlet of the second fuel cap, and wherein the second fuel cap is adapted to be removably attached to a second equipment fuel tank.

20. The system of claim 19, wherein the second flow meter is a differential pressure meter, a mass flow meter, an open-channel flow meter, a positive displacement flow meter, a velocity flow meter, or any combination thereof.

21. The system of claim 19, wherein the second fuel level sensor is a capacitance fuel level sensor, a float fuel level sensor, an optical fuel level sensor, an ultrasonic fuel level sensor, or any combination thereof.

22. The system of claim 19, wherein the second valve is a shut-off valve, a zero-drip connector, or any combination thereof.

23. The system of claim 19 further comprising:
a second flow control box comprising:
the inlet of the second remote transport truck;
the first outlet of the second remote transport truck;
the second outlet of the second remote transport truck;
the second pressure regulator;
the second flow meter; and
the second valve.

24. The system of claim 19, wherein the second tap line further comprises a second check valve.

25. A fuel control and distribution system, the system comprising:
a fuel source having an outlet;
a fuel line having an inlet and an outlet, wherein the outlet of the fuel source is fluidly connected to the inlet to the fuel line;
a fuel pump having an inlet and an outlet, wherein the outlet of the fuel line is fluidly connected to the inlet of the fuel pump;
a main fuel line having an inlet and an outlet, wherein the main fuel line comprises a pressure regulator and a flow meter, wherein the outlet of the fuel pump is fluidly connected to the inlet to the main fuel line;
a first remote transport truck having an inlet, a first outlet and a second outlet, wherein the first remote transport truck comprises a first remote transport truck fuel line having an inlet and an outlet, wherein the outlet of the main fuel line is fluidly connected to the inlet of the first remote transport truck and wherein the first outlet of the first remote transport truck is fluidly connected to the inlet of the first remote transport truck fuel line;
a first tap line having an inlet and an outlet, wherein the first tap line comprises a first pressure regulator, a first flow meter and a first valve, wherein the second outlet to the first remote transport truck is fluidly connected to the inlet to the first tap line;
a first fuel cap having an inlet and an outlet, wherein the first fuel cap comprises a first fuel level sensor, wherein the outlet of the first tap line is fluidly connected to the inlet of the first fuel cap, and wherein the first fuel cap is adapted to be removably attached to a first equipment fuel tank; and
a control system comprising one or more processors and computer-readable instructions that when executed by the one or more processors, cause the one or more processors to:
determine a first fuel level outputted by the first fuel level sensor;
determine a first fuel pressure outputted by the first pressure regulator;

determine a first fuel rate outputted by the first flow meter; and control a first fuel flow based the first fuel level outputted by the first fuel level sensor, the first fuel pressure outputted by the first pressure regulator, the first fuel rate outputted by the first flow meter, or any combination thereof by opening or closing the first valve.

26. The system of claim 25, wherein the fuel source is a fuel tanker.

27. The system of claim 25, wherein the fuel source is an ISO tank.

28. The system of claim 25, wherein the fuel pump is a centrifugal pump, a dynamic pump, a positive displacement pump, a reciprocating pump, a rotary pump, or any combination thereof.

29. The system of claim 25, wherein the pressure regulator is capable of controlling fuel pressure from about 18 to about 20 psi.

30. The claim of claim 25, wherein the flow meter is a differential pressure flow meter, a mass flow meter, an open-channel flow meter, a positive displacement flow meter, a velocity flow meter, or any combination thereof.

31. The system of claim 25, wherein the first flow meter is a differential pressure meter, a mass flow meter, an open-channel flow meter, a positive displacement flow meter, a velocity flow meter, or any combination thereof.

32. The system of claim 25, wherein the first fuel level sensor is a capacitance fuel level sensor, a float fuel level sensor, an optical fuel level sensor, an ultrasonic fuel level sensor, or any combination thereof.

33. The system of claim 25, wherein the first valve is a shut-off valve, a zero-drip connector, or any combination thereof.

34. The system of claim 25 further comprising:

a first flow control box comprising:

the inlet of the first remote transport truck;

the first outlet of the first remote transport truck;

the second outlet of the first remote transport truck;

the first pressure regulator;

the first flow meter; and the first valve.

35. The system of claim 25 further comprising:

a trailer comprising:

a control shelter comprising:

the control system;

a pump and spool shelter comprising:

the fuel pump;

a spool, wherein an outlet of the fuel pump is fluidly connected to an inlet to the spool and an outlet to the spool is connected to the inlet of the main fuel line.

36. The system of claim 25, wherein the first tap line further comprises a first check valve.

37. The system of claim 25, wherein the main fuel line further comprises a fuel filter and a pop-off pump gauge, and wherein the fuel filter is a bowl-type fuel filter, a cartridge-type fuel filter, a coalescence-type fuel filter, or any combination thereof.

38. The system of claim 37, wherein the fuel filter is a coalescence-type fuel filter.

39. The system of claim 25 further comprising a spool, wherein the wherein an outlet of the fuel pump is fluidly connected to an inlet to the spool and an outlet to the spool is connected to the inlet of the main fuel line.

40. The system of claim 39, wherein the spool is capable of spooling the main fuel line.

41. A method for using a fuel control and distribution system, the method comprising:

providing the fuel control and distribution system of claim 21;

determining a first fuel level outputted by the first fuel level sensor disposed inside a first equipment tank;

determining a first fuel pressure outputted by the first pressure regulator;

determining a first fuel rate outputted by the first flow meter; and controlling a first fuel flow based the first fuel level, the first fuel pressure, the first fuel rate or any combination thereof by opening or closing the first valve.

42. The method of claim 41 further comprising:

determining a second fuel level outputted by a second fuel level sensor disposed inside a second equipment tank;

determining a second fuel pressure outputted by a second pressure regulator;

determining a second fuel rate outputted by a second flow meter; and controlling a second fuel flow based the second fuel level, the second fuel pressure, the second fuel rate or any combination thereof by opening or closing the second valve.

43. The system of claim 25 further comprising:

a second remote transport truck having an inlet, a first outlet and a second outlet, wherein the outlet of the first remote transport truck fuel line is fluidly connected to the inlet of the second remote transport truck;

a second tap line having an inlet and an outlet, wherein the second tap line comprises, a second pressure regulator, a second flow meter and a second valve, wherein the second fuel outlet of the second remote transport truck is fluidly connected to the inlet to the second tap line;

a second fuel cap having an inlet and an outlet, wherein the second fuel cap comprises a second fuel level sensor, wherein the outlet of the second tap line is fluidly connected to the inlet of the second fuel cap, and wherein the second fuel cap is adapted to be removably attached to a second equipment fuel tank; and the control system further comprising computer-readable instructions that when executed by the one or more processors, cause the one or more processors to:

determine a second fuel level outputted by the second fuel level sensor;

determine a second fuel pressure outputted by the second pressure regulator;

determine a second fuel rate outputted by the second flow meter; and control a second fuel flow based the second fuel level outputted by the second fuel level sensor, the second fuel pressure outputted by the second pressure regulator, the second fuel rate outputted by the second flow meter, or any combination thereof by opening or closing the second valve.

44. The system of claim 43, wherein the second flow meter is a differential pressure meter, a mass flow meter, an open-channel flow meter, a positive displacement flow meter, a velocity flow meter, or any combination thereof.

45. The system of claim 43, wherein the second fuel level sensor is a capacitance fuel level sensor, a float fuel level sensor, an optical fuel level sensor, an ultrasonic fuel level sensor, or any combination thereof.

46. The system of claim 43, wherein the second valve is a shut-off valve, a zero-drip connector, or any combination thereof.

47. The system of claim 43 further comprising:
a second flow control box comprising:
the inlet of the second remote transport truck;
the first outlet of the second remote transport truck;
the second outlet of the second remote transport truck;
the second pressure regulator;
the second flow meter; and
the second valve.

48. The system of claim 43 further comprising:
a trailer comprising:
a control shelter comprising:
the control system;
a pump and spool shelter comprising:
the fuel pump;
a spool, wherein an outlet of the fuel pump is fluidly connected to an inlet to the spool and an outlet to the spool is connected to the inlet of the main fuel line.

49. A method for using a fuel control and distribution system, the method comprising:
providing the fuel control and distribution system of claim 34;
determining a first fuel level outputted by the first fuel level sensor disposed inside a first equipment tank;
determining a first fuel pressure outputted by the first pressure regulator;
determining a first fuel rate outputted by the first flow meter; and
controlling a first fuel flow based the first fuel level, the first fuel pressure, the first fuel rate or any combination thereof by opening or closing the first valve; and
determining a second fuel level outputted by the second fuel level sensor disposed inside the second equipment tank;
determining a second fuel pressure outputted by the second pressure regulator;
determining a second fuel rate outputted by the second flow meter; and
controlling a second fuel flow based the second fuel level, the second fuel pressure, the second fuel rate or any combination thereof by opening or closing the second valve.

50. The system of claim 43, wherein the second tap line further comprises a second check valve.

51. A remote transport truck system comprising:
a first remote transport truck having a first inlet, a first outlet and a second outlet, wherein the first remote transport truck comprises:
a first remote transport truck fuel line having an inlet and an outlet, wherein the inlet of the first remote transport truck fuel line is fluidly connected to the first outlet of the first remote transport truck;
a first tap line having an inlet and an outlet, wherein the first tap line comprises a first pressure regulator a first flow meter, and a first valve, and wherein the second outlet of the first remote transport truck is fluidly connected to the inlet of the first tap line; and
a first fuel cap having an inlet and an outlet, wherein the first fuel cap comprises a first fuel level sensor, wherein the outlet of the first tap line is fluidly connected to the inlet of the first fuel cap, and wherein the first fuel cap is adapted to be removably attached to a first equipment fuel tank.

52. The system of claim 51, wherein the first flow meter is a differential pressure meter, a mass flow meter, an open-channel flow meter, a positive displacement flow meter, a velocity flow meter, or any combination thereof.

53. The system of claim 51, wherein the first fuel level sensor is a capacitance fuel level sensor, a float fuel level sensor, an optical fuel level sensor, an ultrasonic fuel level sensor, or any combination thereof.

54. The system of claim 51, wherein the first valve is a shut-off valve, a zero-drip connector, or any combination thereof.

55. The system of claim 51 further comprising:
a first flow control box comprising:
the first inlet of the first remote transport truck;
the first outlet of the first remote transport truck;
the second outlet of the first remote transport truck;
the first pressure regulator;
the first flow meter; and
the first valve.

56. The system of claim 51 further comprising:
a first cart having a plurality of wheels, wherein the plurality of wheels are attached to the bottom of the first cart;
the first cart comprising:
a first flow control box comprising:
the first inlet of the first remote transport truck;
the first outlet of the first remote transport truck;
the second outlet of the first remote transport truck;
the first pressure regulator;
the first flow meter; and
the first valve.

57. The system of claim 56, wherein the first cart further comprises a first spill tray disposed below the first flow control box, wherein the first spill tray is attached to the first cart.

58. The system of claim 57, wherein the first cart further comprises a first lower tray disposed below the first spill tray, wherein the first spill tray is attached to the first cart.

59. The system of claim 58, wherein the first cart further comprises a first upper tray disposed above the first flow control box, wherein the first upper tray is attached to the first cart.

60. The system of claim 59, wherein the first upper tray comprises a first fuel line spool, wherein the first fuel line spool is attached to the first upper tray.

61. The system of claim 60, wherein the first cart further comprises a first tap line spool, wherein the first tap line spool is attached to the first cart, the first lower tray and/or first upper tray.

62. The system of claim 61, wherein the first tap line spool further comprises a first communication and/or power line spool.

63. The system of claim 61, wherein the first cart further comprises a first communication and/or power line spool, wherein the first communication and/or power line spool is attached to the first cart, the first lower tray and/or the first upper tray.

64. The system of claim 61, wherein the first cart further comprises a first fuel cap storage tube, wherein the first fuel cap storage tube is attached to the first cart, the first lower tray and/or the first upper tray.

65. The system of claim 61, wherein the first cart further comprises a first local control box, wherein the first local control box comprises a first local control system and a first communication and/or power connector, wherein the first local control box is attached to the first cart, the first lower tray and/or the first upper tray.

66. The system of claim 65, wherein the first cart further comprises a first handle, wherein the first handle is attached to the first cart, the first lower tray and/or the first upper tray.

67. A fuel cap system comprising:

a first fuel cap body having a fuel inlet, a fuel outlet, wherein the first fuel cap body is adapted to mate with and seal to a first equipment tank, and wherein the fuel inlet is adapted to be connected to a first tap line and the fuel outlet is adapted to be disposed inside the first equipment tank;

a fuel level sensor, wherein the fuel level sensor is adapted to be disposed inside the first equipment tank;

a retention means, wherein the retention means is removably attached the fuel cap body to the first equipment tank.

68. The fuel cap system of claim 67, wherein the fuel level body is a conical shape, a cylinder shape, a hemispherical shape, a truncated cone shape, or any combination thereof.

69. The fuel cap system of claim 67 further comprising a fuel cap connector, wherein the fuel level sensor is electrically connected to the fuel cap connector.

70. The fuel cap system of claim 69 further comprising a sensor conduit, wherein the fuel level sensor is electrically connected to the fuel cap connector through the sensor conduit.

71. The fuel cap system of claim 67 further comprising a flex means capable of allowing the fuel level sensor to assume a vertical position when the fuel level sensor is disposed inside the first equipment tank, wherein the flex means is attached to the fuel cap body.

72. The fuel cap system of claim 71, wherein the flex means includes a flex, a hinge, a worm drive, or any combination thereof.

73. The fuel cap system of claim 67, wherein the fuel level sensor is a capacitance fuel level sensor, a float fuel level sensor, an optical fuel level sensor, an ultrasonic fuel level sensor, or any combination thereof.

74. The fuel cap system of claim 73, wherein the fuel level sensor is a float fuel level sensor.

75. The fuel cap system of claim 67, wherein the fuel cap retention means includes a first clip and a first bungee cord, the first clip and a first strap, a first hook and a the first bungee cord, the first hook and the first strap, or any combination thereof.

76. The fuel cap system of claim 75, wherein the fuel cap retention means is the first clip and the first strap.

77. The fuel cap system of claim 67, wherein the fuel cap body is made of a metal, a plastic, or any combination thereof.

78. The fuel cap system of claim 77, wherein the fuel cap body further comprises a gasket.

79. The fuel cap system of claim 78, wherein the gasket is made of an elastomer.

* * * * *